US008337314B2

(12) United States Patent
Waxman et al.

(10) Patent No.: US 8,337,314 B2
(45) Date of Patent: Dec. 25, 2012

(54) SYSTEMS AND METHODS FOR IMPROVING A BUTTON ASSEMBLY

(75) Inventors: Thomas D. Waxman, Reno, NV (US); Gregory A. Silva, Reno, NV (US); Jacquelyn S. Combs, Sparks, NV (US); Nathan D. LaBrosse, Reno, NV (US); Brandon J. Bohling, Reno, NV (US)

(73) Assignee: IGT, Reno, NV (US)

( * ) Notice: Subject to any disclaimer, the term of this patent is extended or adjusted under 35 U.S.C. 154(b) by 1017 days.

(21) Appl. No.: 12/291,501

(22) Filed: Nov. 10, 2008

(65) Prior Publication Data

US 2009/0131168 A1 May 21, 2009

Related U.S. Application Data

(63) Continuation-in-part of application No. 11/558,860, filed on Nov. 10, 2006, now abandoned, and a continuation-in-part of application No. 11/558,853, filed on Nov. 10, 2006, now Pat. No. 8,070,609.

(51) Int. Cl.
*A63F 9/24* (2006.01)

(52) U.S. Cl. ..... 463/46

(58) Field of Classification Search ..... 463/46
See application file for complete search history.

(56) References Cited

U.S. PATENT DOCUMENTS

| | | | | |
|---|---|---|---|---|
| 4,070,568 | A * | 1/1978 | Gala | 362/311.09 |
| 4,141,614 | A | 2/1979 | Piccirillo | |
| 4,191,871 | A * | 3/1980 | Coyle | 200/530 |
| 4,658,375 | A | 4/1987 | Onogi et al. | |
| 4,856,787 | A | 8/1989 | Itkis | |
| 5,393,067 | A | 2/1995 | Paulsen | |
| 5,547,192 | A | 8/1996 | Ishibashi | |
| 5,655,961 | A | 8/1997 | Acres et al. | |
| 5,752,882 | A | 5/1998 | Acres | |
| 5,833,538 | A | 11/1998 | Weiss | |
| 5,836,817 | A | 11/1998 | Acres et al. | |

(Continued)

FOREIGN PATENT DOCUMENTS

AU 2005202951 2/2006

(Continued)

OTHER PUBLICATIONS

European Examination Report dated Oct. 29, 2009, EP Application No. 07 864 156.0-1238.

(Continued)

*Primary Examiner* — Pierre E Elisca
(74) *Attorney, Agent, or Firm* — Weaver Austin Villeneuve & Sampson LLP

(57) ABSTRACT

A button assembly is described. The button assembly includes a light emitting device that emits light. The button assembly further includes a lens cap that protects the light emitting device from being damaged. The lens cap has a top surface, a first cap side, a second cap side, a third cap side, and a fourth cap side. The second cap side connected to the first cap side, the third cap side connected to the second cap side, and the fourth cap side connected to the first cap side and the third cap side to form a plane. A first perpendicular distance between the plane and a first point on the top surface is different than a second perpendicular distance between the plane and a second point on the top surface. Additionally, a system for increasing life of a pixel is described.

33 Claims, 42 Drawing Sheets

U.S. PATENT DOCUMENTS

| | | | | |
|---|---|---|---|---|
| 5,877,633 | A | 3/1999 | Ng et al. | |
| 6,102,394 | A | 8/2000 | Wurz et al. | |
| 6,117,010 | A | 9/2000 | Canterbury et al. | |
| 6,139,360 | A | 10/2000 | Hayashi et al. | |
| 6,251,014 | B1 | 6/2001 | Stockdale et al. | |
| 6,283,858 | B1 | 9/2001 | Hayes, Jr. et al. | |
| 6,393,165 | B1 | 5/2002 | Yeh | |
| 6,394,900 | B1 | 5/2002 | McGlone et al. | |
| 6,443,839 | B2 | 9/2002 | Stockdale et al. | |
| 6,454,649 | B1 | 9/2002 | Mattice et al. | |
| 6,488,585 | B1 | 12/2002 | Wells et al. | |
| 6,503,147 | B1 | 1/2003 | Stockdale et al. | |
| 6,514,145 | B1 | 2/2003 | Kawabata et al. | |
| 6,569,013 | B1 | 5/2003 | Taylor | |
| 6,572,475 | B1 | 6/2003 | Okabe et al. | |
| 6,575,832 | B1 | 6/2003 | Manfredi et al. | |
| 6,597,197 | B1 | 7/2003 | Mosley et al. | |
| 6,628,939 | B2 | 9/2003 | Paulsen | |
| 6,629,184 | B1 | 9/2003 | Berg et al. | |
| 6,652,378 | B2 | 11/2003 | Cannon et al. | |
| 6,663,487 | B1 | 12/2003 | Ladner | |
| 6,676,510 | B1 | 1/2004 | Bittman et al. | |
| 6,688,981 | B2 | 2/2004 | Shigeno | |
| 6,695,696 | B1 | 2/2004 | Kaminkow | |
| 6,798,359 | B1 | 9/2004 | Ivancic | |
| 6,811,486 | B1 | 11/2004 | Luciano, Jr. | |
| 6,846,238 | B2 | 1/2005 | Wells | |
| 6,855,054 | B2 | 2/2005 | White et al. | |
| 6,866,581 | B2 | 3/2005 | Martinek et al. | |
| 6,878,063 | B2 | 4/2005 | Manfredi et al. | |
| 6,890,254 | B2 | 5/2005 | Kaminkow | |
| 6,899,627 | B2 | 5/2005 | Lam et al. | |
| 6,910,962 | B2 | 6/2005 | Marks et al. | |
| 6,935,946 | B2 | 8/2005 | Yoseloff et al. | |
| 6,979,266 | B2 | 12/2005 | LeMay et al. | |
| 6,994,626 | B1 | 2/2006 | D'Achard Van Enschut | |
| 7,047,338 | B1 | 5/2006 | Nguyen et al. | |
| 7,048,630 | B2 | 5/2006 | Berg et al. | |
| 7,063,617 | B2 | 6/2006 | Brosnan et al. | |
| 7,071,845 | B2 | 7/2006 | Ivancic | |
| 7,804,037 | B2 * | 9/2010 | Cove | 200/520 |
| 8,070,609 | B2 | 12/2011 | Waxman et al. | |
| 2002/0010014 | A1 | 1/2002 | Parra et al. | |
| 2002/0045474 | A1 | 4/2002 | Singer | |
| 2002/0052230 | A1 * | 5/2002 | Martinek et al. | 463/10 |
| 2002/0077168 | A1 | 6/2002 | Jones et al. | |
| 2002/0107059 | A1 | 8/2002 | Katayama | |
| 2002/0142825 | A1 | 10/2002 | Lark et al. | |
| 2002/0142846 | A1 | 10/2002 | Paulsen | |
| 2002/0151360 | A1 | 10/2002 | Durham | |
| 2002/0183105 | A1 | 12/2002 | Cannon et al. | |
| 2003/0054868 | A1 | 3/2003 | Paulsen | |
| 2003/0073490 | A1 | 4/2003 | Hecht et al. | |
| 2003/0083132 | A1 | 5/2003 | Berg | |
| 2003/0148812 | A1 | 8/2003 | Paulsen | |
| 2003/0191809 | A1 | 10/2003 | Mosley et al. | |
| 2003/0199295 | A1 | 10/2003 | Vancura | |
| 2004/0018877 | A1 | 1/2004 | Tastad et al. | |
| 2004/0023709 | A1 | 2/2004 | Beaulieu et al. | |
| 2004/0048650 | A1 | 3/2004 | Mierau et al. | |
| 2004/0054840 | A1 | 3/2004 | Berg et al. | |
| 2004/0054952 | A1 | 3/2004 | Morrow et al. | |
| 2004/0106446 | A1 | 6/2004 | Cannon et al. | |
| 2004/0137987 | A1 | 7/2004 | Nguyen et al. | |
| 2004/0209683 | A1 | 10/2004 | Okada | |
| 2005/0020348 | A1 | 1/2005 | Thomas et al. | |
| 2005/0037837 | A1 | 2/2005 | Rowe | |
| 2005/0043089 | A1 | 2/2005 | Nguyen et al. | |
| 2005/0043090 | A1 | 2/2005 | Pryzby et al. | |
| 2005/0049037 | A1 | 3/2005 | Anderson et al. | |
| 2005/0054441 | A1 | 3/2005 | Landrum et al. | |
| 2005/0059458 | A1 | 3/2005 | Griswold et al. | |
| 2005/0059485 | A1 | 3/2005 | Paulsen et al. | |
| 2005/0101383 | A1 | 5/2005 | Wells | |
| 2005/0113163 | A1 | 5/2005 | Mattice et al. | |
| 2005/0130728 | A1 | 6/2005 | Nguyen et al. | |
| 2005/0130731 | A1 | 6/2005 | Englman et al. | |
| 2005/0130737 | A1 | 6/2005 | Englman et al. | |
| 2005/0143169 | A1 | 6/2005 | Nguyen et al. | |
| 2005/0148384 | A1 | 7/2005 | Marks et al. | |
| 2005/0150753 | A1 | 7/2005 | Hsu | |
| 2005/0187011 | A1 | 8/2005 | Kaminkow | |
| 2005/0192081 | A1 | 9/2005 | Marks et al. | |
| 2005/0239542 | A1 | 10/2005 | Olsen | |
| 2005/0243046 | A1 | 11/2005 | Hong | |
| 2005/0288096 | A1 | 12/2005 | Walker et al. | |
| 2006/0009285 | A1 | 1/2006 | Pryzby et al. | |
| 2006/0019746 | A1 | 1/2006 | Seelig et al. | |
| 2006/0030412 | A1 | 2/2006 | Cole | |
| 2006/0035696 | A1 | 2/2006 | Walker et al. | |
| 2006/0035707 | A1 | 2/2006 | Nguyen et al. | |
| 2006/0046830 | A1 | 3/2006 | Webb | |
| 2006/0063584 | A1 | 3/2006 | Brill et al. | |
| 2006/0068875 | A1 | 3/2006 | Cregan et al. | |
| 2006/0068909 | A1 | 3/2006 | Pryzby et al. | |
| 2006/0073900 | A1 | 4/2006 | Cole | |
| 2006/0111171 | A1 | 5/2006 | Berg et al. | |
| 2006/0111186 | A1 | 5/2006 | Hattori | |
| 2006/0208764 | A1 | 9/2006 | Puar et al. | |
| 2007/0060352 | A1 * | 3/2007 | Cole | 463/37 |
| 2008/0073190 | A1 * | 3/2008 | Cove | 200/314 |
| 2008/0076506 | A1 * | 3/2008 | Nguyen et al. | 463/16 |
| 2008/0113737 | A1 | 5/2008 | Waxman | |
| 2008/0113766 | A1 | 5/2008 | Waxman et al. | |
| 2010/0139329 | A1 * | 6/2010 | Yoon et al. | 68/139 |
| 2011/0096541 | A1 * | 4/2011 | Lien et al. | 362/235 |
| 2011/0132736 | A1 * | 6/2011 | Mittleman et al. | 200/345 |
| 2012/0080296 | A1 * | 4/2012 | Schechtel et al. | 200/310 |

FOREIGN PATENT DOCUMENTS

| | | |
|---|---|---|
| CA | 2453758 | 7/2004 |
| DE | 7511873 | 9/1978 |
| DE | 102007001703 | 8/2007 |
| EP | 1453022 | 9/2004 |
| EP | 1571618 | 9/2005 |
| EP | 2084683 | 8/2009 |
| EP | 2089864 | 8/2009 |
| GB | 2403429 | 1/2005 |
| WO | WO01/88724 | 11/2001 |
| WO | 2008/060962 | 5/2008 |
| WO | 2008/061009 | 5/2008 |
| WO | 2010/053631 | 5/2010 |

OTHER PUBLICATIONS

PCT Invitation to Pay Fees and Partial Search dated Dec. 10, 2009, PCT Application No. PCT/US2009/058249.

European Examination Report dated Oct. 20, 2009, EP Application No. 07 864 209.7-2221.

U.S. Appl. No. 11/122,344, filed May 4, 2005 for "Ticket Drawing Games Having Escalating Discrete Prize Levels."

International Search Report and Written Opinion of the International Searching Authority dated Apr. 25, 2008, for related PCT Application No. PCT/US2007/084172.

International Search Report and Written Opinion of the International Searching Authority dated May 8, 2008, for related PCT Application No. PCT/US2007/084271.

Summons to Attend Oral Proceedings dated Apr. 8, 2010, EP Application No. 07 864 209.7-2221.

International Search Report and Written Opinion dated May 25, 2010 from Application No. PCT/US2009/058249 (now Publication No. WO 2010/053631).

International Preliminary Report on Patentability dated May 12, 2009 from Application No. PCT/US2007/084271 (now Publication No. WO 2008/061009).

International Preliminary Report on Patentability dated May 12, 2009 from Application No. PCT/US2007/084172 (now Publication No. WO 2008/060962).

US Office Action dated Sep. 3, 2010, U.S. Appl. No. 11/558,853.

US Final Office Action dated Feb. 4, 2011, U.S. Appl. No. 11/558,853.

US Notice of Allowance dated Aug. 9, 2011, U.S. Appl. No. 11/558,853.
US Office Action dated Sep. 3, 2010, U.S. Appl. No. 11/558,860.
US Final Office Action dated Apr. 1, 2011, U.S. Appl. No. 11/558,860.
US Office Action dated Nov. 14, 2011, U.S. Appl. No. 11/558,860.
PCT International Preliminary Report on Patentability dated May 19, 2011 issued issued in PCT/US2009/058249 (WO 2010/053631).
"Preliminary Specification Product Name: RGC11096096YW000 Product No. 9918201000," RITEK Group RiTdisplay Corporation, Feb. 12, 2007 [online] http://www.ritdisplay.com.
US Office Action dated Mar. 6, 2012, U.S. Appl. No. 13/282,893.
US Final Office Action dated Apr. 27, 2012, U.S. Appl. No. 11/558,860.

* cited by examiner

SYSTEMS AND METHODS FOR IMPROVING A BUTTON ASSEMBLY

CROSS-REFERENCE TO RELATED APPLICATIONS

This application is a continuation-in-part of claims the benefit of co-pending U.S. patent application Ser. No. 11/558,860, filed on Nov. 10, 2006, titled "DYNAMIC DISPLAY SYSTEMS FOR GAMING MACHINES", which is incorporated by reference herein in its entirety and for all purposes.

This application is a continuation-in-part of and claims the benefit of co-pending U.S. patent application Ser. No. 11/558,853, filed on Nov. 10, 2006, titled "FLEXIBLY CONFIGURABLE BUTTON PANELS FOR GAMING MACHINES", which is incorporated by reference herein in its entirety and for all purposes.

BACKGROUND OF THE INVENTION

This invention relates generally to a button assembly and particularly to systems and methods for improving the button assembly.

Electronic devices and machines have become an everyday part of life in modern times, as even many traditionally non-electronic items and machines have now gone "high-tech." While machines such as coin-operated video games, ticket purchasing machines and other types of vending machines have long been electronic, items such as automobiles, washing machines, coffee makers and other appliances now tend to be electronic as well. Many of these electronic machines and items include various input, output and/or functional result devices and components, such that the overall design, manufacture, use and repair of such electronic machines has become increasingly complex.

Casinos and other forms of gaming are a particular example of an industry where electronic machines, such as, for example, microprocessor based gaming machines, are extremely popular. In a typical electronic gaming machine, such as a slot machine, video poker machine, video keno machine or the like, a game play is first initiated through a player wager of money or credit, whereupon the gaming machine determines a game outcome, presents the game outcome to the player and then potentially dispenses an award of some type, including a monetary award, depending upon the game outcome. Electronic and microprocessor based gaming machines can include a variety of hardware and software components to provide a wide variety of game types and game playing capabilities, with such hardware and software components being generally well known in the art. A typical electronic gaming machine can include hardware devices and peripheral such as bill validators, coin acceptors, card readers, keypads, buttons, levers, touch screens, coin hoppers, player tracking units and the like. In addition, each gaming machine can have various audio and visual display components that can include, for example, speakers, display panels, belly and top glasses, exterior cabinet artwork, lights, and top box dioramas, as well as any number of video displays of various types to show game play and other assorted information, with such video display types including, for example, a cathode ray tube ("CRT"), a liquid crystal display ("LCD"), a light emitting diode ("LED"), a flat panel display and a plasma display, among others.

As noted above, the design and manufacture of such gaming machines and other electronic machines has become increasingly complex, particularly with the advent of multiple displays, sound output devices, touchscreens, buttons, currency acceptors, card acceptors and an assortment of other peripheral devices that may be part of such machines. One type of item that can be found on many such machines is a "button panel" having a plurality of input buttons that are arranged or configured in a particular fashion for a user of the machine. As is generally known, buttons for such button panels tend to be relatively large and spaced apart from each other in a fashion that is distinctive from smaller keypad types of buttons and arrangements. In particular, such button panels can be found, for example, on coin-operated video games, video poker machines, video keno machines, electronic slot machines, and the like. One example of a generally well-known button panel could be the arrangement of buttons that typically exist on a video poker machine, the button panel for which can include one hold/drop button for each video poker card, a deal/draw button, a repeat bet button, one or more other betting buttons, a cash out button, and/or a service button, among others. While the entire collection of these buttons on the front panel of the video poker machine can be generally be referred to as the "button panel" for that machine, such a button panel might also include one or more other buttons located elsewhere about the machine, or could be a subset of all of the buttons on the front panel of the machine, as may be desired.

While button panels such as the general video poker button panel as noted above can be the same or substantially similar on the same type of machines, the numbers and configurations of such buttons can differ substantially between different models and types of machines. For example, while one slot machine or video game might have six rectangular buttons arranged in a line on a front button panel, the next slot machine or video game might have seven circular buttons arranged or configured in a more artful fashion on an otherwise similar front button panel. Because the numbers and configurations of such button panels can vary widely from one machine type or model to another, it is typical for each of such differing types and models of machine to be designed and manufactured in a customized manner. That is, every different model of gaming machine or other similar electronic device having a button panel typically requires that a separate assessment be made of the buttons, wiring and other parts needed to construct its particular button panel.

As is generally known, such button panels for gaming machines and other similar devices are typically made with customized wiring that runs from each button to another button and/or to one or more processing devices adapted to process input from the various buttons. While such wiring can be organized in various ways, such as through the use of harnesses and/or coupling devices so as to streamline the manufacturing and/or repair processes, it is typically incumbent upon those making the machine to individually connect and solder the endpoints of each wire. This can tend to be a labor intensive process, requiring the expenditure of significant amounts of time and resources to simply wire each button individually. Such customized wiring of buttons individually for each machine can lead to additional problems whenever a mistake is made in the wiring process, the detection and resolution of which can also be costly and time consuming. Furthermore, the repair or switching out of buttons or other defective components can also be costly and time consuming processes where such buttons have been individually wired in a customized manner.

Various attempts have been made to provide improved button panels, details of which may be found, for example, in U.S. Pat. Nos. 6,102,394 and 6,117,010, as well as U.S. Patent Publication No. 2004/0018877, which references are each incorporated herein by reference. While the various features of these references may provide some benefits regarding button panels, there still remain a variety of drawbacks. For example, the overall configurable and reconfigurable nature of these button panels is not as flexible as may be desired for some manufacturing and repair situations. Furthermore, it does not appear that these button panels have any particularized identifying features, nor are there any specialized processing components or arrangements associated with these button panels, such as to identify missing, malfunctioning or wrongly configured buttons on the button panel.

While existing designs and systems for providing button panels in electronic devices and machines have been adequate in the past, improvements are usually welcomed and encouraged.

SUMMARY OF THE INVENTION

In light of the foregoing, it is thus desirable to develop a more universal and flexible button panel that is adapted to be used in different models of machines, such that the manufacture, use and repair of such a button panel would be streamlined significantly.

Regarding such a more universal and flexible button panel, it is generally known that sophisticated buttons now exist having small display screens thereupon. For example, U.S. Pat. Nos. 6,798,359, and 7,071,845, which are each incorporated herein by reference, both teach of buttons having 16×16 pixel LCD screens disposed thereupon. While these particular buttons are used within the context of a keypad, it is generally known that such uses may extend to non-keypad type buttons and button panels. However, the use of such display embedded buttons within wager based gaming machines can present additional problems unique to gaming machines.

As is generally known, electronic wager based gaming machines typically include a master gaming controller ("MGC") that is responsible for many or all primary gaming machine functions, particularly all random number generator and game determination outcomes, outcome displays, monetary and ticket intake, payouts, user input processing, and various security functions. In addition, the burden for processing many other gaming machine functions tend to be placed on the MGC, with such other functions typically including video and display processing. With the advent of secondary, tertiary and further displays, however, as well as more sophisticated animations, displays and video, the display processing burdens alone that can now be placed on the MGC have become immense. Adding further displays for a plurality of buttons, along with the accompanying processing needs, can only serve to aggravate this existing problem.

Accordingly, while existing gaming machine architectures and designs for providing multiple display processing have been adequate in the past, improvements are usually welcomed and encouraged. In light of the foregoing, it is thus desirable to develop a more dynamic display system that is adapted to be used in sophisticated gaming machines having multiple displays, such that the burdens and drawbacks of relying upon a master gaming controller to do all or much of the display processing for the entire gaming machine can be significantly reduced.

Moreover, a plurality of display elements of the display screen have limited life. Life is an amount of time when an intensity of light emitted by one of the display elements degrades down by a certain percentage. For example, life is an amount of time when an intensity of light emitted by an organic light emitting diode (OLED) degrades down by 50%. The display screen may be replaced when life of at least one of the display elements ends. Accordingly, the faster the life ends, the higher the number of times the display screen may be replaced and the higher the cost of replacement. Further, the faster the life ends, the faster a ghosting effect is created on pixels close to one of the display elements. In the ghosting effect, an image displayed by the one of the display elements is also displayed in the pixels close to the display element. Moreover, the faster the life ends, a difference in intensities of light emitted by one of the display elements and a pixel adjacent to the display element becomes evident faster.

Furthermore, while playing a game by using the electronic devices and machines, a player may enjoy a drink, such as beer or soda. The player may spill the drink on the button panel. The drink enters circuitry inside the electronic devices and machines and may damage the circuitry.

In one aspect, a power control system for increasing the life of a light emitting element is described. The system includes a light emitting element that emits light and receives an indication that main power generated is less than a threshold value before power supplied to the light emitting element is removed. The system further includes a main power supply that generates the main power and a power storage device that stores a portion of the main power to generate stored power. The power storage device supplies the stored power. A portion of the stored power is received by the light emitting element for a limited time period after the power generated by main power supply falls below the threshold value.

The system includes a power detector that monitors the main power supplied by the main power supply and determines whether the main power supplied is less than the threshold value. The power detector generates a signal indicating that the main power is below the threshold value upon determining that the main power supplied is less than the threshold value. The signal generated by the power detector informs a light emitting element that the main power is less than the threshold value before power supplied to the light emitting element is removed.

The system further includes a light emitting device controller that controls the light emitting element by controlling a plurality of storage devices including a plurality of parameters. A logic device of the system receives the signal indicating that the main power is less than the threshold value and sends a command to the light emitting device controller to change the parameters. The light emitting device controller controls the storage devices to turn off the light emitting device upon receiving the command.

In another aspect, a button assembly is described. The button assembly includes a light emitting device that emits light and a lens cap that protects the light emitting device from being damaged. The lens cap has a top surface, a first cap side, a second cap side, a third cap side, and a fourth cap side. The second cap side connected to the first cap side, the third cap side connected to the second cap side, and the fourth cap side connected to the first cap side and the third cap side to form a plane. The plane passes through a portion of the first cap side, a portion of the second cap side, a portion of the third cap side, and a portion of the fourth cap side. A first perpendicular distance between the plane and a first point on the top surface is different than a second perpendicular distance between the plane and a second point on the top surface. The top surface may be curved, such as dome-shaped.

The button assembly further includes a lens cap holder that holds the lens cap. The lens cap extends below an edge of the lens cap holder to prevent a liquid from flowing from outside the lens cap to inside the lens cap. The button assembly also includes a button housing that receives at least a portion of the lens cap and has a threaded portion that prevents the liquid from entering from outside the button assembly to within the button assembly.

A gasket of the button assembly surrounds at least a section of the threaded portion to prevent a liquid from entering the button assembly. The button housing includes a housing notch that facilitates passage of the liquid from inside the button housing to outside the button housing.

The button assembly further includes a clamp that may also be referred to as a spacer. The clamp also includes a clamp notch that facilitates passage of the liquid from inside the clamp to outside the clamp. The button assembly includes a nut that has a length dimension to prevent a flow of the liquid from outside the nut to inside the nut.

The button assembly includes a switch housing further including a plurality of switch assembly prongs. A button mating component of the button housing connects to a cable connector connected to a flexible cable. One of the switch assembly prongs is configured to extend through an opening in the flexible cable to prevent the button assembly from disengaging from the flexible cable.

In yet another aspect, a controller is described. The controller is used to increase the life of a light emitting element. The controller determines whether an event occurs within a pre-defined time window. The controller inverts a first intensity of a pixel including the light emitting element upon determining that the event does not occur within the pre-defined time window and generates an inverted intensity upon inverting the first intensity.

The controller further generates a reduced intensity. The reduced intensity is generated by reducing the inverted intensity by a fixed percentage. The controller restores the pixel to the first intensity upon determining that the event occurs after generating the inverted intensity or the reduced intensity.

BRIEF DESCRIPTION OF THE DRAWINGS

The included drawings are for illustrative purposes and serve only to provide examples of possible structures and process steps for the disclosed inventive systems and methods for improving a button assembly

DETAILED DESCRIPTION OF THE INVENTION

Figure 1:
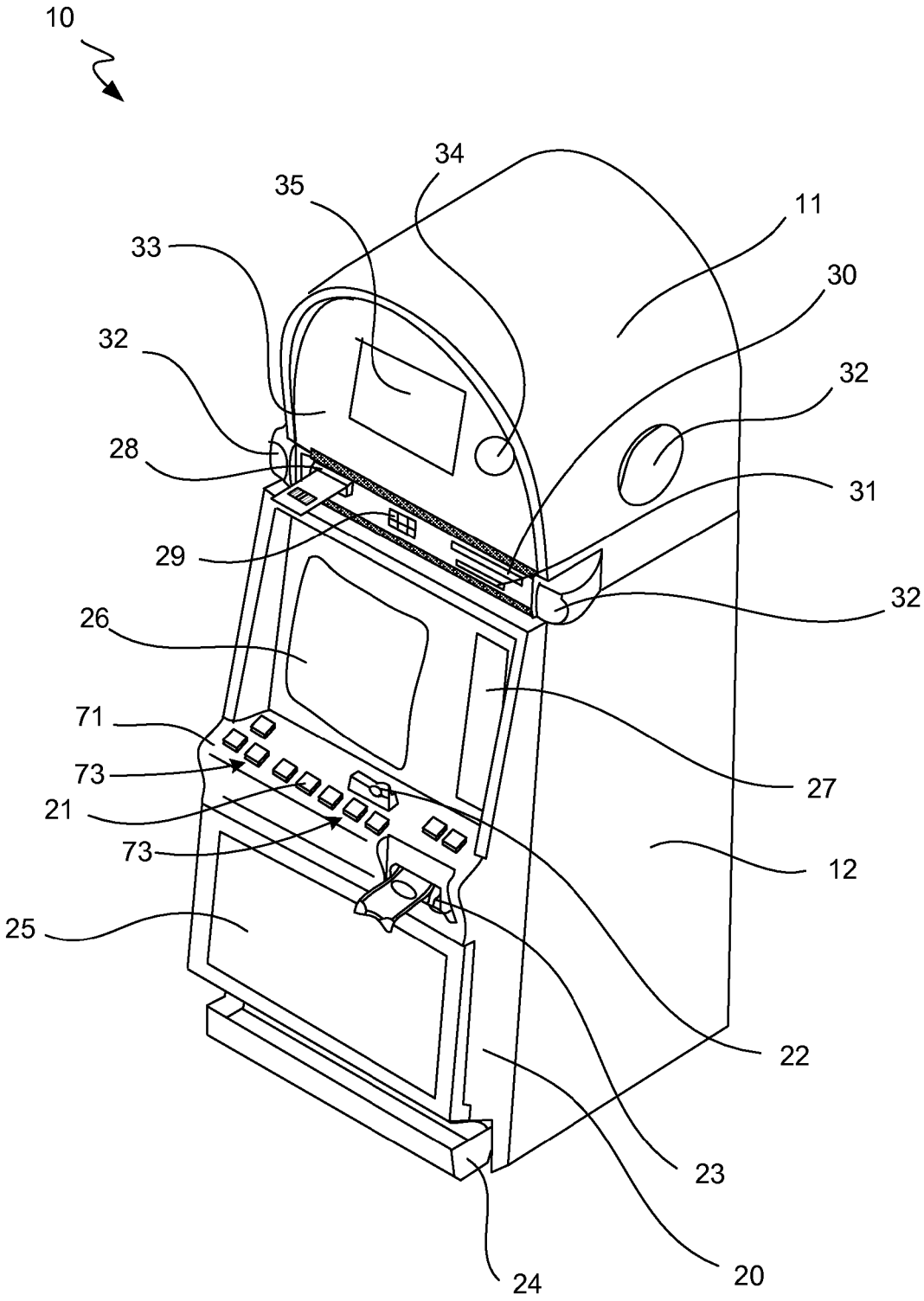
FIG. 1 illustrates in perspective view an exemplary gaming machine.

Exemplary applications of methods and systems for improving a button assembly are described as follows. These examples are being provided solely to add context and aid in the understanding of the methods and systems. It will thus be apparent to one skilled in the art that the present methods and systems may be practiced without some or all of these specific details. In other instances, well known processes have not been described in detail in order to avoid unnecessarily obscuring the present methods and systems. Other applications are possible, such that the following examples should not be taken as definitive or limiting in scope or setting. Although these examples are described in sufficient detail to enable one skilled in the art to practice the methods and systems, it will be understood that they are not limiting, such that other embodiments may be used and changes may be made without departing from the spirit and scope of the invention.

An advantage of the herein described systems and methods includes increasing life of light emitting element. The light emitting element turns off after a controller controlling the light emitting element and the light emitting element are notified that power from a power supply fell below a limit. The turning off after the notification provides notice in advance to the light emitting element and increases the life of the light emitting element.

Another advantage of the systems and methods includes increasing life of a light emitting element within a pixel by dimming an intensity of the pixel. Yet another advantage of the systems and methods include reducing the ghosting effect by inverting the intensity. The inversion of the intensity provides a substantial uniform intensity across all pixels of a display device to reduce the ghosting effect. The dimming is performed by reducing an intensity of light emitting element.

Yet another advantage of the herein described systems and methods for improving a button assembly include providing a curved surface of a button assembly. The curved surface strengthens the button assembly and protects the button assembly from hard hits received from a game player who may be frustrated with his or her performance in a game or having a bad day or is impatient.

Still another advantage includes providing a plurality of openings within a button assembly. The openings provide an outlet for a liquid that may be spilled by a player and has entered within the button assembly. The openings protect any circuitry within the button assembly and on bottom of the button assembly from damage, such as a short circuit.

Other advantages include providing a gasket, such as a washer, within a button assembly and extending various portions of the button assembly to prevent the liquid from entering the button assembly. Yet other advantages include providing a plurality of prongs to provide additional support to a connection between the button assembly and a flexible cable.

Although a majority of the systems and methods focuses on the use of button assemblies within a wager based gaming machine as illustrative examples, it will be readily understood that the button assemblies can similarly be used in a variety of other electronic devices, such as coin-operated video games, vending machines, ticket purchase machines, and other similar devices having input buttons that are spaced apart in non-keypad type arrangements. Accordingly, it is to be understood that the various flexibly configurable button panels disclosed herein are not restricted to gaming machine applications in all instances. Continuing with the example of gaming machines solely for illustrative purposes within this application, various gaming machines and gaming systems will be presented next, followed by specific details regarding the systems and methods for improving a button assembly.

Referring first to FIG. 1, an exemplary gaming machine 10 is illustrated in perspective view. Gaming machine 10 includes a top box 11 and a main cabinet 12, which generally surrounds the machine interior (not shown) and is viewable by users, such as administrators, casino operators, and game players. This top box and/or main cabinet can together or separately form an exterior housing adapted to contain a plurality of internal gaming machine components therein. Main cabinet 12 includes a main door 20 on the front of the gaming machine, which preferably opens to provide access to the gaming machine interior. Attached to a panel 71 of the main door 20 are typically one or more player-input switches or buttons 21, which collectively form a button panel, one or more money or credit acceptors, such as a coin acceptor 22 and a bill or ticket validator 23, a coin tray 24, and a belly glass 25. Panel 71 includes a plurality of panel openings 73. Viewable through main door 20 is a primary video display monitor 26 adapted to present a game, such as a game of chance or a game of skill, and one or more information panels 27. The primary video display monitor 26 will typically be a cathode ray tube, high resolution flat-panel liquid crystal display (LCD), plasma/light emitting diode (LED) display or other conventional or other type of appropriate video monitor. Alternatively, a plurality of gaming reels can be used as a primary gaming machine display in place of display monitor 26, with such gaming reels preferably being electronically controlled, as will be readily appreciated by one skilled in the art.

Top box 11, which typically rests atop of the main cabinet 12, may contain a ticket dispenser 28, a key pad 29, one or more additional displays 30, a card reader 31, one or more speakers 32, a top glass 33, one or more cameras 34, and a secondary video display monitor 35, which can similarly be a cathode ray tube, a high resolution flat-panel LCD, a plasma/LED display or any other conventional or other type of appropriate video monitor. Alternatively, secondary display monitor 35 might also be foregone in place of other displays, such as gaming reels or physical dioramas that might include other moving components, such as, for example, one or more movable dice, a spinning wheel or a rotating display. It will be understood that many makes, models, types and varieties of gaming machines exist, that not every such gaming machine will include all or any of the foregoing items, and that many gaming machines will include other items not described above.

With respect to the basic gaming abilities provided, it will be readily understood that gaming machine 10 can be adapted for presenting and playing any of a number of gaming events, particularly games of chance involving a player wager and potential monetary payout, such as, for example, a wager on a sporting event or general play as a slot machine game, a keno game, a video poker game, a video blackjack game, and/or any other video table game, among others. Other features and functions may also be used in association with gaming machine 10, and it is specifically contemplated that the present invention can be used in conjunction with such a gaming machine or device that might encompass any or all such additional types of features and functions.

With respect to electronic gaming machines in particular, the electronic gaming machines made by International Game Technology™ (IGT) corporation are provided with special features and additional circuitry that differentiate them from general-purpose computers, such as a laptop or desktop personal computer ("PC"). Because gaming machines are highly regulated to ensure fairness, and in many cases are operable to dispense monetary awards of millions of dollars, hardware and software architectures that differ significantly from those of general-purpose computers may be implemented into a typical electronic gaming machine in order to satisfy security concerns and the many strict regulatory requirements that apply to a gaming environment. A general description of many such specializations in electronic gaming machines relative to general-purpose computing machines and specific examples of the additional or different components and features found in such electronic gaming machines will now be provided.

At first glance, one might think that adapting PC technologies to the gaming industry would be a simple proposition, since both PCs and gaming machines employ microprocessors that control a variety of devices. However, because of such reasons as 1) the regulatory requirements that are placed upon gaming machines, 2) the harsh environment in which gaming machines operate, 3) security requirements and 4) fault tolerance requirements, adapting PC technologies to a gaming machine can be quite difficult. Further, techniques and methods for solving a problem in the PC industry, such as device compatibility and connectivity issues, might not be adequate in the gaming environment. For instance, a fault or a weakness tolerated in a PC, such as security holes in software or frequent crashes, may not be tolerated in a gaming machine because in a gaming machine these faults can lead to a direct loss of funds from the gaming machine, such as stolen cash or loss of revenue when the gaming machine is not operating properly.

Accordingly, one difference between gaming machines and common PC based computers or systems is that gaming machines are designed to be state-based systems. In a state-based system, the system stores and maintains its current state in a non-volatile memory, such that in the event of a power failure or other malfunction the gaming machine will return to its current state when the power is restored. For instance, if a player were shown an award for a game of chance and the power failed before the award was provided, the gaming machine, upon the restoration of power, would return to the state where the award was indicated. As anyone who has used a PC knows, PCs are not state machines, and a majority of data is usually lost when a malfunction occurs. This basic requirement affects the software and hardware design of a gaming machine in many ways.

A second important difference between gaming machines and common PC based computer systems is that for regulation purposes, the software on the gaming machine used to generate the game of chance and operate the gaming machine must be designed as static and monolithic to prevent cheating by the operator of gaming machine. For instance, one solution that has been employed in the gaming industry to prevent cheating and satisfy regulatory requirements has been to manufacture a gaming machine that can use a proprietary processor running instructions to generate the game of chance from an electrically programmable read only memory (EPROM) or other form of non-volatile memory. The coding instructions on the EPROM are static (non-changeable) and must be approved by a gaming regulator in a particular jurisdiction and installed in the presence of a person representing the gaming jurisdiction. Any change to any part of the software required to generate the game of chance, such as, for example, adding a new device driver used by the master gaming controller to operate a device during generation of the game of chance, can require a new EPROM to be burnt, approved by the gaming jurisdiction, and reinstalled on the gaming machine in the presence of a gaming regulator. Regardless of whether the EPROM solution is used, to gain approval in most gaming jurisdictions, a gaming machine must demonstrate sufficient safeguards that prevent an operator of the gaming machine from manipulating hardware and software in a manner that gives the operator an unfair or even illegal advantage over a player. The code validation requirements in the gaming industry affect both hardware and software designs on gaming machines.

A third important difference between gaming machines and common PC based computer systems is that the number and kinds of peripheral devices used on a gaming machine are not as great as on PC based computer systems. Traditionally in the gaming industry, gaming machines have been relatively simple in the sense that the number of peripheral devices and the number of functions on the gaming machine have been limited. Further, the functionality of a gaming machine tends to remain relatively constant once the gaming machine is deployed, in that new peripheral devices and new gaming software is infrequently added to an existing operational gaming machine. This differs from a PC, where the users tend to buy new and different combinations of devices and software from different manufacturers, and then connect or install these new items to a PC to suit their individual needs. Therefore, the types of devices connected to a PC may vary greatly from user to user depending on their individual requirements, and may also vary significantly over time for a given PC.

Although the variety of devices available for a PC may be greater than on a gaming machine, gaming machines still have unique device requirements that differ from a PC, such as device security requirements not usually addressed by PCs. For instance, monetary devices such as coin dispensers, bill validators, ticket printers and computing devices that are used to govern the input and output of cash to a gaming machine have security requirements that are not typically addressed in PCs. Many PC techniques and methods developed to facilitate device connectivity and device compatibility do not address the emphasis placed on security in the gaming industry. To address some of these issues, a number of hardware/software components and architectures are utilized in gaming machines that are not typically found in general-purpose computing devices, such as PCs. These hardware/software components and architectures include, but are not limited to, items such as watchdog timers, voltage monitoring systems, state-based software architectures and supporting hardware, specialized communication interfaces, security monitoring, and trusted memory.

A watchdog timer is normally used in IGT gaming machines to provide a software failure detection mechanism. In a normal operating system, the operating software periodically accesses control registers in a watchdog timer subsystem to "re-trigger" the watchdog. Should the operating software not access the control registers within a preset timeframe, the watchdog timer will time out and generate a system reset. Typical watchdog timer circuits contain a loadable timeout counter register to allow the operating software to set the timeout interval within a certain time range. A differentiating feature of some preferred circuits is that the operating software cannot completely disable the function of the watchdog timer. In other words, the watchdog timer always functions from the time power is applied to the board.

IGT gaming computer platforms preferably use several power supply voltages to operate portions of the computer circuitry. These can be generated in a central power supply or locally on the computer board. If any of these voltages falls out of the tolerance limits of the circuitry they power, unpredictable operation of the computer may result. Though most modern general-purpose computers include voltage-monitoring circuitry, these types of circuits only report voltage status to the operating software. Out of tolerance voltages can cause software malfunction, creating a potential uncontrolled condition in the gaming computer. IGT gaming machines, however, typically have power supplies with tighter voltage margins than that required by the operating circuitry. In addition, the voltage monitoring circuitry implemented in IGT gaming computers typically has two limitations of control. The first limitation generates a software event that can be detected by the operating software and an error condition generated. This limitation is triggered when a power supply voltage falls out of the tolerance range of the power supply, but is still within the operating range of the circuitry. The second limitation is set when a power supply voltage falls out of the operating tolerance of the circuitry. In this case, the circuitry generates a reset, halting operation of the computer.

The standard method of operation for IGT gaming machine game software is to use a state machine. Each function of the game (e.g., bet, play, result) is defined as a state. When a game moves from one state to another, critical data regarding the game software is stored in a custom non-volatile memory subsystem. In addition, game history information regarding previous games played, amounts wagered, and so forth also should be stored in a non-volatile memory device. This feature allows the game to recover operation to the current state of play in the event of a malfunction, loss of power, or the like. This is critical to ensure that correct wagers and credits are preserved. Typically, battery backed random access memory (RAM) devices are used to preserve this critical data. These memory devices are not used in typical general-purpose computers. Further, IGT gaming computers normally contain additional interfaces, including serial interfaces, to connect to specific subsystems internal and external to the gaming machine. The serial devices may have electrical interface requirements that differ from the "standard" EIA RS232 serial interfaces provided by general-purpose computers. These interfaces may include EIA RS485, EIA RS422, Fiber Optic Serial, optically coupled serial interfaces, current loop style serial interfaces, and the like. In addition, to conserve serial interfaces internally in the gaming machine, serial devices may be connected in a shared, daisy-chain fashion where multiple peripheral devices are connected to a single serial channel.

IGT gaming machines may alternatively be treated as peripheral devices to a casino communication controller and connected in a shared daisy chain fashion to a single serial interface. In both cases, the peripheral devices are preferably assigned device addresses. If so, the serial controller circuitry must implement a method to generate or detect unique device addresses. General-purpose computer serial ports are not able to do this. In addition, security-monitoring circuits detect intrusion into an IGT gaming machine by monitoring security switches attached to access doors in the gaming machine cabinet. Preferably, access violations result in suspension of game play and can trigger additional security operations to preserve the current state of game play. These circuits also function when power is off by use of a battery backup. In power-off operation, these circuits continue to monitor the access doors of the gaming machine. When power is restored, the gaming machine can determine whether any security violations occurred while power was off, such as by software for reading status registers. This can trigger event log entries and further data authentication operations by the gaming machine software.

Trusted memory devices are preferably included in an IGT gaming machine computer to ensure the authenticity of the software that may be stored on less secure memory subsystems, such as mass storage devices. Trusted memory devices and controlling circuitry are typically designed to not allow modification of the code and data stored in the memory device while the memory device is installed in the gaming machine. The code and data stored in these devices may include, for example, authentication algorithms, random number generators, authentication keys, operating system kernels, and so forth. The purpose of these trusted memory devices is to provide gaming regulatory authorities a root trusted authority within the computing environment of the gaming machine that can be tracked and verified as original. This may be accomplished via removal of the trusted memory device from the gaming machine computer and verification of the secure memory device contents is a separate third party verification device. Once the trusted memory device is verified as authentic, and based on the approval of verification algorithms contained in the trusted device, the gaming machine is allowed to verify the authenticity of additional code and data that may be located in the gaming computer assembly, such as code and data stored on hard disk drives.

Mass storage devices used in a general-purpose computer typically allow code and data to be read from and written to the mass storage device. In a gaming machine environment, modification of the gaming code stored on a mass storage device is strictly controlled and would only be allowed under specific maintenance type events with electronic and physical enablers required. Though this level of security could be provided by software, IGT gaming computers that include mass storage devices preferably include hardware level mass storage data protection circuitry that operates at the circuit level to monitor attempts to modify data on the mass storage device and will generate both software and hardware error triggers should a data modification be attempted without the proper electronic and physical enablers being present. In addition to the basic gaming abilities provided, these and other features and functions serve to differentiate gaming machines into a special class of computing devices separate and distinct from general-purpose computers.

Figure 2:
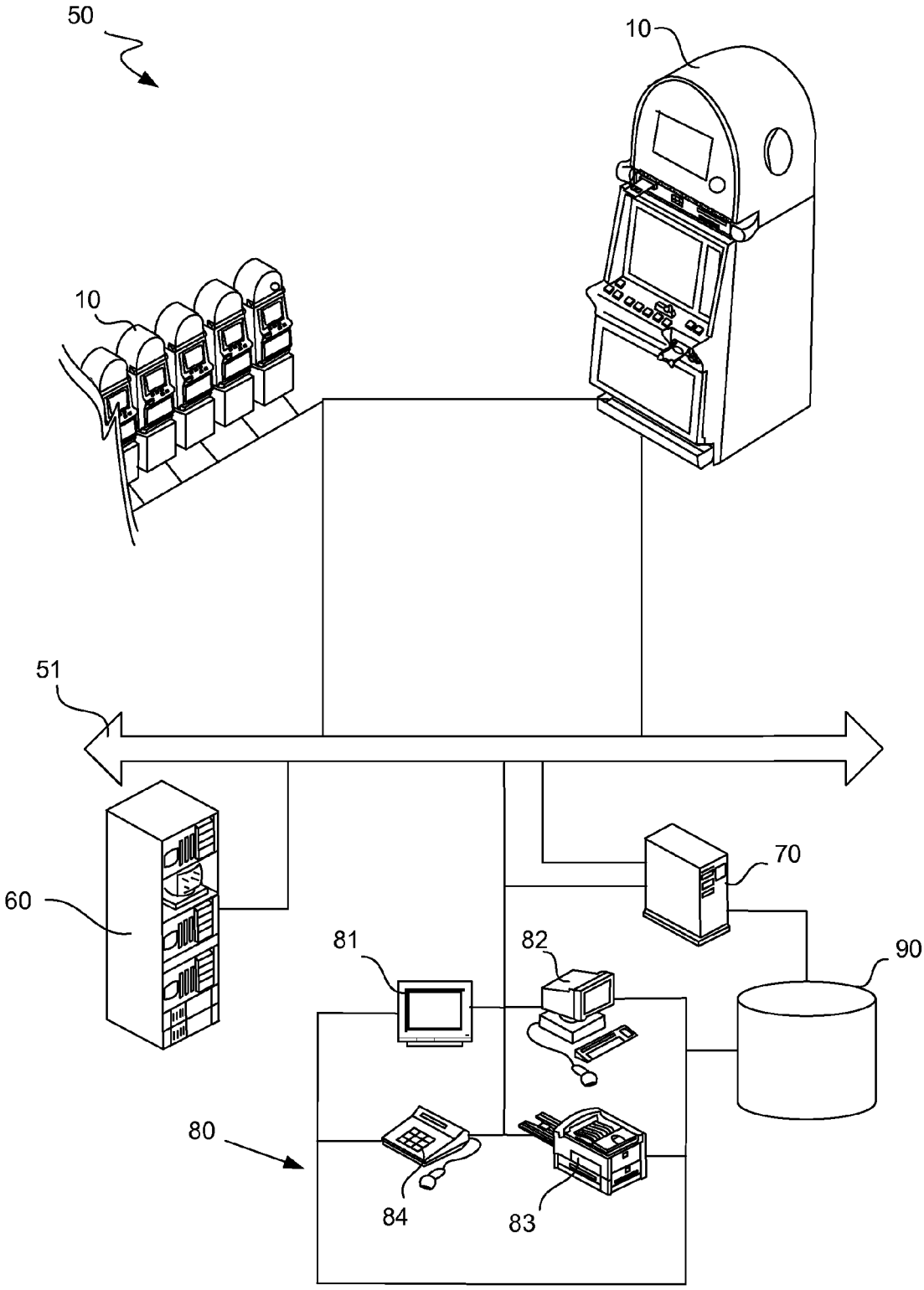
FIG. 2 illustrates in block diagram format an exemplary network infrastructure for providing a gaming system having one or more gaming machines.

Continuing with FIG. 2, an exemplary network infrastructure for providing a gaming system having one or more gaming machines is illustrated in block diagram format. Exemplary gaming system 50 has one or more gaming machines, various communication items, and a number of host-side components and devices adapted for use within a gaming environment. As shown, one or more gaming machines 10 adapted for use in gaming system 50 can be in a plurality of locations, such as in banks on a casino floor or standing alone at a smaller non-gaming establishment, as desired. Common bus 51 can connect one or more gaming machines or devices to a number of networked devices on the gaming system 50, such as, for example, a general-purpose server 60, one or more special-purpose servers 70, a sub-network of peripheral devices 80, and/or a database 90.

A general-purpose server 60 may be one that is already present within a casino or other establishment for one or more other purposes beyond any monitoring or administering involving gaming machines. Functions for such a general-purpose server can include other general and game specific accounting functions, payroll functions, general Internet and e-mail capabilities, switch board communications, and reservations and other hotel and restaurant operations, as well as other assorted general establishment record keeping and operations. In some cases, specific gaming related functions such as cashless gaming, downloadable gaming, player tracking, remote game administration, video or other data transmission, or other types of functions may also be associated with or performed by such a general-purpose server. For example, such a server may contain various programs related to cashless gaming administration, player tracking operations, specific player account administration, remote game play administration, remote game player verification, remote gaming administration, downloadable gaming administration, and/or visual image or video data storage, transfer and distribution, and may also be linked to one or more gaming machines, in some cases forming a network that includes all or many of the gaming devices and/or machines within the establishment. Communications can then be exchanged from each adapted gaming machine to one or more related programs or modules on the general-purpose server.

In one embodiment, gaming system 50 contains one or more special-purpose servers that can be used for various functions relating to the provision of cashless gaming and gaming machine administration and operation under the present methods and systems. Such a special-purpose server or servers could include, for example, a cashless gaming server, a player verification server, a general game server, a downloadable games server, a specialized accounting server, and/or a visual image or video distribution server, among others. Of course, these functions may all be combined onto a single specialized server. Such additional special-purpose servers are desirable for a variety of reasons, such as, for example, to lessen the burden on an existing general-purpose server or to isolate or wall off some or all gaming machine administration and operations data and functions from the general-purpose server and thereby increase security and limit the possible modes of access to such operations and information.

Alternatively, exemplary gaming system 50 can be isolated from any other network at the establishment, such that a general-purpose server 60 is essentially impractical and unnecessary. Under either embodiment of an isolated or shared network, one or more of the special-purpose servers are preferably connected to sub-network 80, which might be, for example, a cashier station or terminal. Peripheral devices in this sub-network may include, for example, one or more video displays 81, one or more user terminals 82, one or more printers 83, and one or more other input devices 84, such as a ticket validator or other security identifier, among others. Similarly, under either embodiment of an isolated or shared network, at least the specialized server 70 or another similar component within a general-purpose server 60 also preferably includes a connection to a database or other suitable storage medium 90. Database 90 is preferably adapted to store many or all files containing pertinent data or information for a particular purpose, such as, for example, data regarding visual image data, video clips, other displayable items, and/or related data, among other potential items. Files, data and other information on database 90 can be stored for backup purposes, and are preferably accessible at one or more system locations, such as at a general-purpose server 60, a special purpose server 70 and/or a cashier station or other sub-network location 80, as desired.

While gaming system 50 can be a system that is specially designed and created new for use in a casino or gaming establishment, it is also possible that many items in this system can be taken or adopted from an existing gaming system. For example, gaming system 50 could represent an existing cashless gaming system to which one or more of the inventive components or controller arrangements are added, such as controllers, storage media, and/or other components that may be associated with a dynamic display system adapted for use across multiple gaming machines and devices. In addition to new hardware, new functionality via new software, modules, updates or otherwise can be provided to an existing database 90, specialized server 70 and/or general-purpose server 60, as desired. Other modifications to an existing system may also be necessary, as might be readily appreciated.

As noted above, many electronic devices include a "button panel" having a plurality of input buttons that are arranged or configured in a particular fashion for the user of the machine. As is generally known, buttons for such button panels tend to be relatively large and spaced apart from each other in a fashion that is distinctive from smaller keypad types of buttons. As also noted above, such button panels tend to be manufactured through individual wiring and soldering techniques, which tend to involve substantial amounts of skilled labor and increasing messiness as the number of buttons increases. Even in the improved examples set forth in U.S. Pat. Nos. 6,102,394 and 6,117,010, as well as U.S. Patent Publication No. 2004/0018877, as noted above, the levels of flexibility in configuring buttons and ease in manufacture and use of button panels is not fully maximized.

Figure 3A:
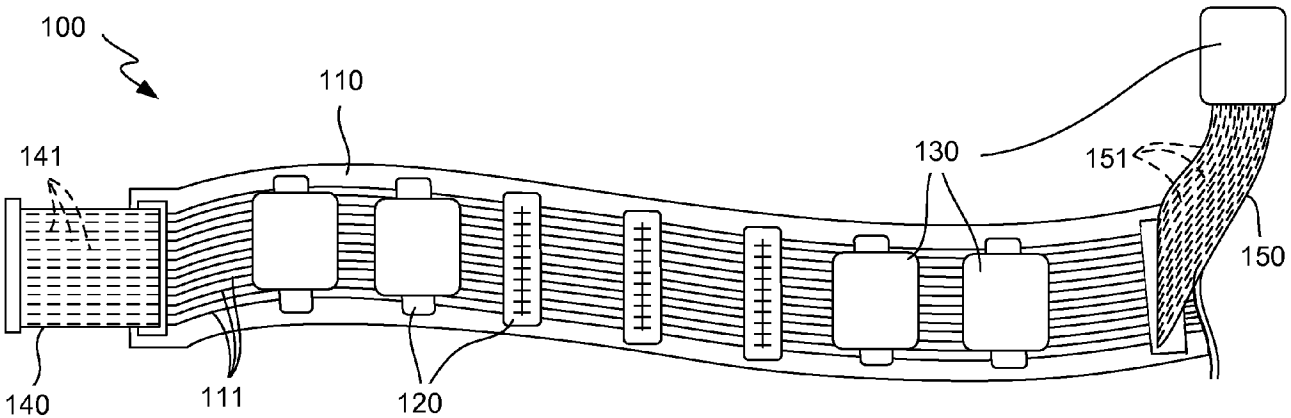
FIG. 3A illustrates in top plan view an exemplary section of a flexibly configurable button panel having multiple buttons coupled thereto according to one embodiment of the present invention.
Figure 3B:
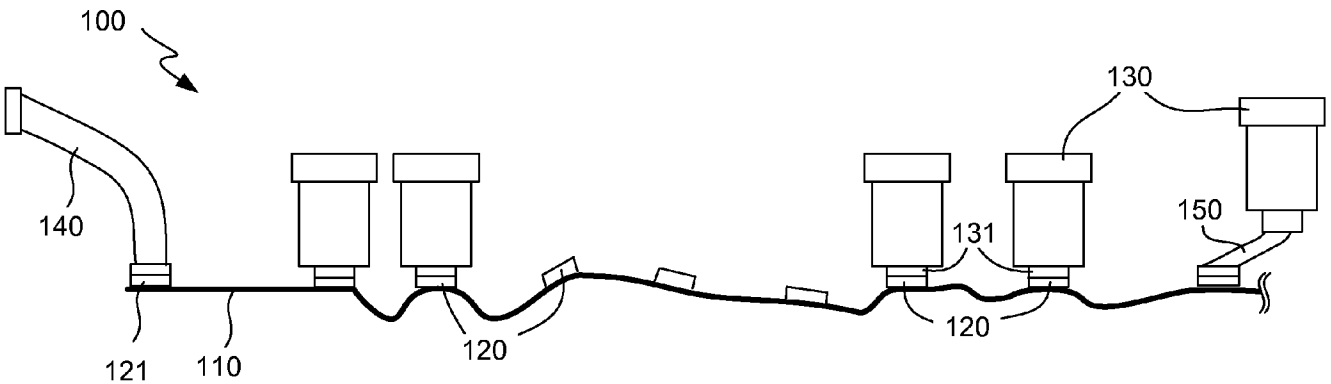
FIG. 3B illustrates in side elevation view the exemplary section of a flexibly configurable button panel of FIG. 3A.

Turning now to FIGS. 3A and 3B, an exemplary section of a flexibly configurable button panel having multiple buttons coupled thereto according to one embodiment of the present invention is illustrated in top plan and side elevation views. Flexibly configurable button panel 100 includes a flexible cable 110 having a plurality circuit lines 111. Although a variety of items can suffice as such a flexible cable having circuit lines, a flat flex circuit having printed circuit lines is thought to work well for this purpose. While such an item could conceivably be an off the shelf model flat flex circuit, it is generally understood in the art that many flat flex circuits are custom designed and manufactured for particular applications. Preferably then, such an item could be custom designed or manufactured by any suitable flexible cable or flat flex circuit manufacturer. Although a flat flex circuit is thought to work well, alternative items can also be used instead. For example, a specially adapted ribbon cable or appropriately bundled and insulated cluster of wires can also suffice as such a flexible cable 110.

As illustrated, flexible cable 110 preferably includes various separate access locations where the printed circuits or other suitable wiring within the flexible cable can be accessed. Such access locations can comprise, in the case of a flat flex circuit for example, a grouped set of contacts that are exposed through the insulating exterior of the flat flex circuit material, such that some or all of the circuits within the flexible cable are accessible at the access point. Flexible cable 110, and in particular one or more processors that may be associated therewith, is preferably adapted to physically address each such access location, as described in greater detail below.

Such access locations are preferably spaced apart along the length of the flexible cable, with spacing between consecutive access locations being subject to variable designs. For example, such spacing can be on the order of a fraction of an inch, one inch, or several inches or more for some or all spacings between flexible cable access locations. In some embodiments, spacing between such access locations can vary, with the shortest spacing being a fraction of an inch and the longest being several inches or more. In one particular example, a flat flex circuit having sixteen access locations and variable spacings therebetween can be provided, with such variable spacings ranging from one to six inches. As will be readily appreciated, the amounts of and spacings between flexible cable access locations are simply a matter of design, and all such numbers of access locations and spacings therebetween are contemplated for use with the present invention. As will also be appreciated, the actual respective physical locations of any attachments to consecutive access locations can range from zero to the actual length of flexible cable between those attachments, due to the flexible nature of the cable.

Cable connectors 120, 121 can be coupled to the flexible cable 110 at some or all such access locations, so as to provide electrical access to the circuit lines along the flexible cable. Such cable connectors can include, for example, surface mount, through-hole and/or press-fit connectors, although one or more other suitable types of cable connectors can be used along with or instead of these connector types. As will be readily appreciated, each cable connector 120, 121 can be adapted to provide access to all circuit lines or some subset thereof, as may be appropriate for any given design. In various embodiments, such cable connectors 120, 121 can serve as "plug in" type connectors, such that buttons and/or other appropriate devices may be removably interchanged along the flexible cable via the cable connectors. Also, while some embodiments may involve a cable connector 120, 121 being installed at every access location along the flexible cable, others may involve only a subset of access locations with cable connectors being installed. In such instances, caps, covers or other suitable materials may be used to close off unused access points.

As shown in this particular example of flexibly configurable button panel 100, cable connectors 120 are preferably adapted for mating with button assemblies or switches, while cable connector 121 is preferably adapted for mating with a harness or other suitable connecting component that leads to a processing unit and/or other circuit board within the overall electronic device. As such, cable connectors 120 and 121 are preferably different in size, shape and/or electrical connections made, such that an improper button assembly, switch, harness, processor board or other component cannot be improperly plugged into the wrong cable connector. For example, while each button assembly cable connector 120 might be adapted to connect to only a subset of the circuit lines 111, processor cable connector 121 might be adapted to connect to all of the circuit lines, such that activity on every circuit line can be processed via this processor cable connector. It will be readily appreciated that other cable connector types for other components that might be included on button panel 100 might similarly be different, in the event that advanced designs might call for components other than those described herein.

Switches or button assemblies 130 can be plugged into, installed at or otherwise coupled to one or more cable connectors 120. In various embodiments, each button assembly 130 can include a button mating component 131 that is adapted to mate or otherwise interface with one or more appropriate button assembly cable connectors 120. As will be readily appreciated, not every cable connector must have an associated switch, button assembly or other component. For example, the illustrated section of flexible cable 110 includes eight cable connectors 120 for button assemblies or switches 130, but only five switches being installed, with three open and unused cable connectors. It is specifically contemplated that this five button arrangement be an acceptable and working flexibly configurable button panel 100, with the open and unused cable connectors simply being superfluous in this case. Of course, many other numbers and arrangements of total cable connectors, mating button assemblies and unused cable connectors may also be possible for any given button panel. In some embodiments, it may be desirable to cap, cover or otherwise close off unused cable connectors for a given button panel 100.

As set forth herein, all switches, button assemblies or "buttons" 130 are interconnected along the flexible cable 110 in a manner that enables the overall button panel 100 and/or other external components to physically address each button separately. Each button 130 is provided a unique address due to the circuitry design of the flexible cable 110, such that communications can be provided at each individual button as may be appropriate. Each button 130 receives communications through a communications stream, as the flexible cable 110 via its associated circuit lines 111 serves as a communications bus for all buttons coupled thereto. Of course, such communications are made between the button panel 100 and an outside source, such as a processor, which processor can be connected to the button panel via a suitable processor cable connector 121.

As shown in the illustrated example, processor harness 140 having circuit lines 141 can be coupled to flexible cable 110 via processing cable connector 121. As noted above, processor harness 140 can be used to connect the entire flexible cable 110 and thereby all switches and buttons thereupon to an externally located processor or other component within the overall electronic device. As will be appreciated, there can be a one-to-one correspondence with circuit lines 111 and 141, such that all power, communications and/or signals that are sent along flexible cable 110 are also sent along harness or other processor connector 140. In some embodiments, harness 140 may be foregone in favor of plugging or otherwise coupling a board, processing unit or other component directly to processing cable connector 121.

In some embodiments, not all button assemblies 130 need be plugged into or otherwise coupled to cable connectors 120 directly. For example, one or more button harnesses 150 may be used, whereupon the associated button assembly is thereby flexibly locatable with respect to said flexible cable itself. Such a button harness 150 can contain a number of button harness circuit lines 151, which can be in one-to-one correspondence with the connections made on button cable connector 120 and button mating component 131. Such a button harness 150 can be particularly advantageous in instances where the ordinary configurability of button panel 100 is not flexible enough for a given application. For example, a button harness might be desirable in a custom application where one or more buttons are to be placed in a remote location away from the rest of the buttons in the button panel, such as in a top box or on the side of the gaming machine. Or, it may simply be the case that the spacing for a given button panel is simply not long enough for a particular button or two, whereupon a button harness 150 can be used to provide any needed slack.

Both processor harness 140 and button harness 150 can be similar to flexible cable 110 with respect to their flexible nature and inclusion of circuit lines. Alternatively one or both types of harnesses may be of a different size, structure or even type of cable with respect to the primary flexible cable 110. As in the case of flexible cable 110, harnesses 140 and 150 can be flat flex circuits with printed circuit lines, ribbon cables, appropriately bundled and insulated clusters of wires, or any other suitable arrangement that achieves the multiple circuit connections as needed.

Figure 4:
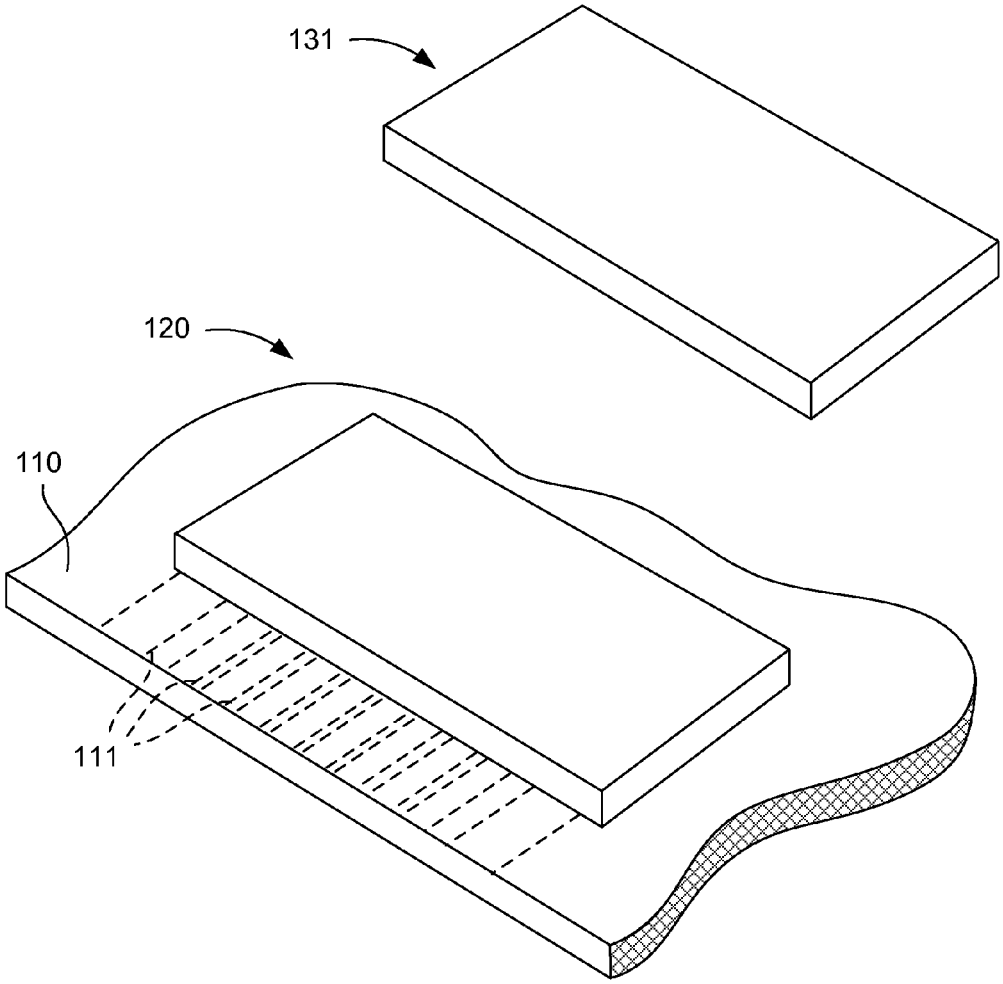
FIG. 4 illustrates in a perspective view an exemplary cable connector and button mating component according to one embodiment of the present invention.

Moving next to FIG. 4, an exemplary cable connector and button mating component are shown in a perspective view. Button cable connector 120 can be any of a variety of cable connector types, as noted above. For purposes of illustration here, cable connector 120 is a surface mount type connector. As shown, the surface mount connector used as cable connector 120 is mounted to the surface of the flexible cable 110 such that the various leads of the cable connector connect to the circuit lines 111 of the flexible cable. The cable connector 120 is preferably arranged such that a suitable button mating component 131 can be plugged into the cable connector. As will be readily appreciated, such a button mating component is preferably attached to an appropriate switch button assembly, so as to facilitate the ready installation or removal of such a switch or button assembly.

Although any number of suitable cable connectors may be used, including cable connectors other than surface mount connectors, it is thought that a 21-position surface mount connector is particularly suitable for such a cable connector 120. In some embodiments, these same parts can be used repeatedly for all button cable connectors 120 and button mating components 131 on the button panel. Similar items having more positions so as to connect to all circuit lines can be used for the processor connector 121 and mating component from processor harness 140.

FIGS. 5A through 5D illustrate in top, side, front and partially exploded perspective views an exemplary button assembly according to one embodiment of the present invention. As will be readily appreciated, button assembly 130 may also be and/or referred to as a simple switch, button or other similar actuating component that can be included as part of button panel 100. Such a switch, button, button assembly or other suitable component can be any of a wide variety of components that can be used in conjunction with the flexible cable, cable connectors and other components of the inventive button panels disclosed herein. In fact, any of the various examples of buttons set forth in U.S. Pat. Nos. 6,102,394; 6,117,010; 6,798,359, and 7,071,845, as well as U.S. Patent Publication No. 2004/0018877, all incorporated above, can be suitably used as buttons in the present flexibly configurable button panel. Various other switches and button assemblies might also be used, and it is specifically contemplated that the present invention is not limited in any way by the number, types or models of switches or buttons that are used therewith.

In general, button assembly can include a top face 132 as part of an actuating top portion or "button" 133, a top receiving portion 134 adapted to receive the actuating button, and a non-moving lower body 135. Such a basic actuating button assembly is generally well understood within the art. While additional collars, sleeves, knobs, contacts, screws and/or other components may be present, the detailed design of such a button assembly is not critical to the overall scope of the present invention, and all such detailed button assembly designs may be used.

In various preferred embodiments, button assembly 130 can include a small display screen 136 embedded therein, which display screen can be adapted to display static images, animations and/or video on the button itself. Accordingly, top face 132 is preferably made of a clear or non-opaque material, such that the contents of display screen 136 can be seen therethrough. Again, such a display screen can be similar to that which is described for a button display screen in U.S. Pat. Nos. 6,798,359, and 7,071,845, as noted above, and other button display screen types may also be used. As one alternative to the foregoing, a more detailed display screen of, for example, 96×96 pixels or 128×128 pixels may be used. As will be readily appreciated, such a small LCD type display screen for a button is typically of the type that is custom designed and manufactured, with any of a number of suitable LCD manufacturers being able to produce such screens to the desired specifications.

With the use of such a display screen, it is specifically contemplated that such a display screen enhanced button assembly also be outfitted with a small controller, logic device and/or chip or other storage device, so as to aid in the display of images, animations and/or video on the button itself. Such a logic device or small controller can be used to facilitate the display of static images, animations or video on its subject button, as will be readily appreciated. Another button feature that can be used in conjunction with or separate from a button display screen can involve the use of backlighting within the button display area. Such backlighting can be facilitated, for example, through the use of red, green and blue LED backlights (not shown), which can then be lit up in different degrees and combinations to produce a wide variety of backlight colors on the face of the button. For example, a combination of the red, green, and blue LED backlights may be used to generate white light. As in the case of the display screen, such backlights can also be controlled by a small controller, logic device and/or chip installed within the button itself for display control purposes.

Figure 6A:
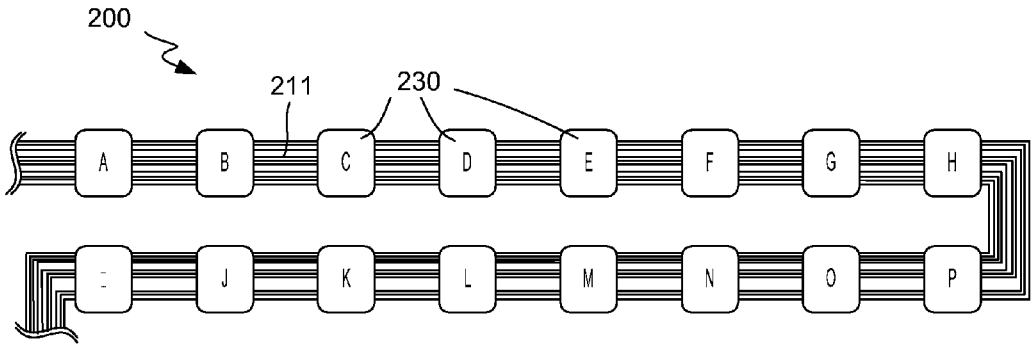
FIG. 6A illustrates a partial electrical diagram of an alternative flexibly configurable button panel according to one embodiment of the present invention.

Turning next to FIG. 6A a simple electrical diagram for an alternative flexibly configurable button panel according to one embodiment of the present invention are provided. Alternative flexibly configurable button panel 200 can be substantially similar in many regards with respect to the exemplary flexibly configurable button panel 100 described above. For example, button panel 200 can include a plurality of identical or similar circuit lines 211, and a plurality of identical or similar installed button assemblies 230. Unlike shorter button panel 100, it can be seen that longer button panel 200 can include up to 16 switches or buttons, designated here as buttons A through P, as opposed to just the eight switches or buttons that can be used on the exemplary strip of button panel 100. Again, the number of buttons or connections for such buttons is not intended to be limited, and it is specifically contemplated that similar button panels having less or more than 16 switches, buttons or connections for such may be provided. Further, as in the example above, it is not necessary that every connector or position be filled by an actual button assembly or switch, such that various empty connectors or positions may be present.

It may be preferable in some manufacturing operations to have "short", "medium", and "long" lengths of flexibly configurable button panels, such that gaming machines requiring small, regular or particularly large amounts of buttons on a button panel can be provided with appropriate length flexible button panels. For example, it can be designated that a manufacturer keep inventory parts that include three types of flexible cable strips for all flexibly configurable button panels—an 8 button flexible cable strip, such as that shown in panel 100 above, a 10 button flexible cable strip, and a 16 button flexible cable strip, such as that shown in panel 200 here. Thus, any gaming machine having a button panel requiring connections for 8 buttons can be provided with the "short" length strip, any gaming machine having a button panel requiring connections for 10 buttons can be provided with the "medium" length strip, and any gaming machine having a button panel requiring connections for 16 buttons can be provided with the "long" length strip. In the event that a given gaming machine might require more than 16 buttons for a button panel, an even longer button strip may be designed, or multiple strips of the provided lengths in inventory could be used. In another embodiment, in the event that a given gaming machine might require more than 16 buttons for a button panel, multiple button systems may be used. For example, a first one of the button systems accommodates buttons 1-16 and a second one of the button systems accommodates the remaining buttons starting from button 17.

Figure 6B:
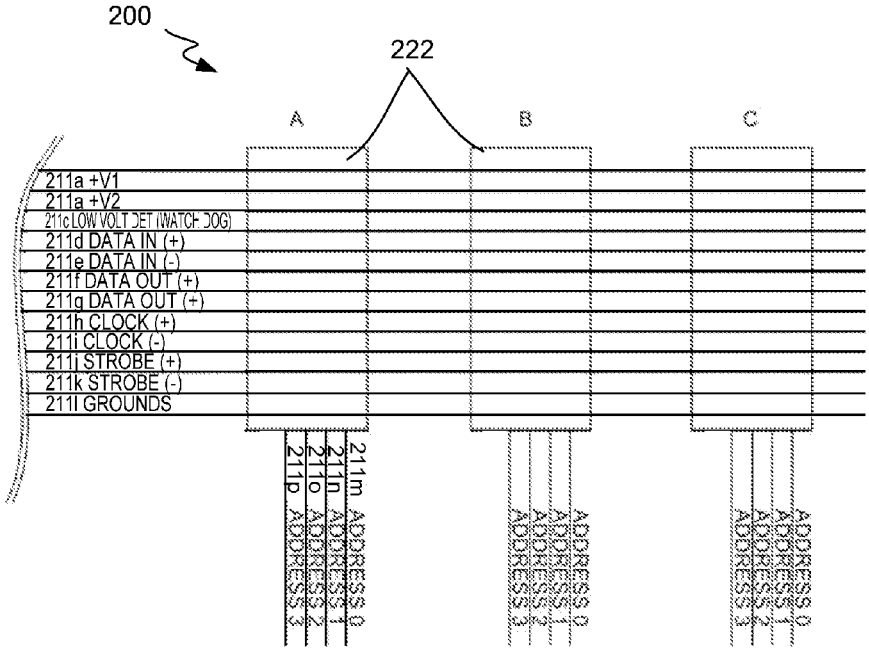
FIG. 6B illustrates a selected portion of the electrical diagram of FIG. 6A in greater detail.

Continuing on to FIG. 6B, a selected portion of the electrical diagram of FIG. 6A in shown in greater detail. In this figure, only the section of flexibly configurable button panel 200 from button positions A through C is depicted, with such positions being shown as simply access locations 222 for purposes of illustration. As will be readily appreciated, some of circuit lines 211 are made available to all buttons (i.e., access locations) in parallel, and others being made available only to select buttons or access locations. In particular, specific address lines can be created such that only certain buttons and button positions are connected to certain address lines. As shown, the various commonly accessible circuit lines comprise lines 211*a* through 211*l*, which can include, for example, various power lines, data lines, a low voltage detection line, programming lines, clock lines, strobe lines and ground lines, among others. The low voltage detection line is a dedicated line. It will be readily appreciated that more or fewer and/or different types of circuit lines may be used, as the needs of a particular design may require, and that the present example is only provided for illustrative purposes.

Figure 7:
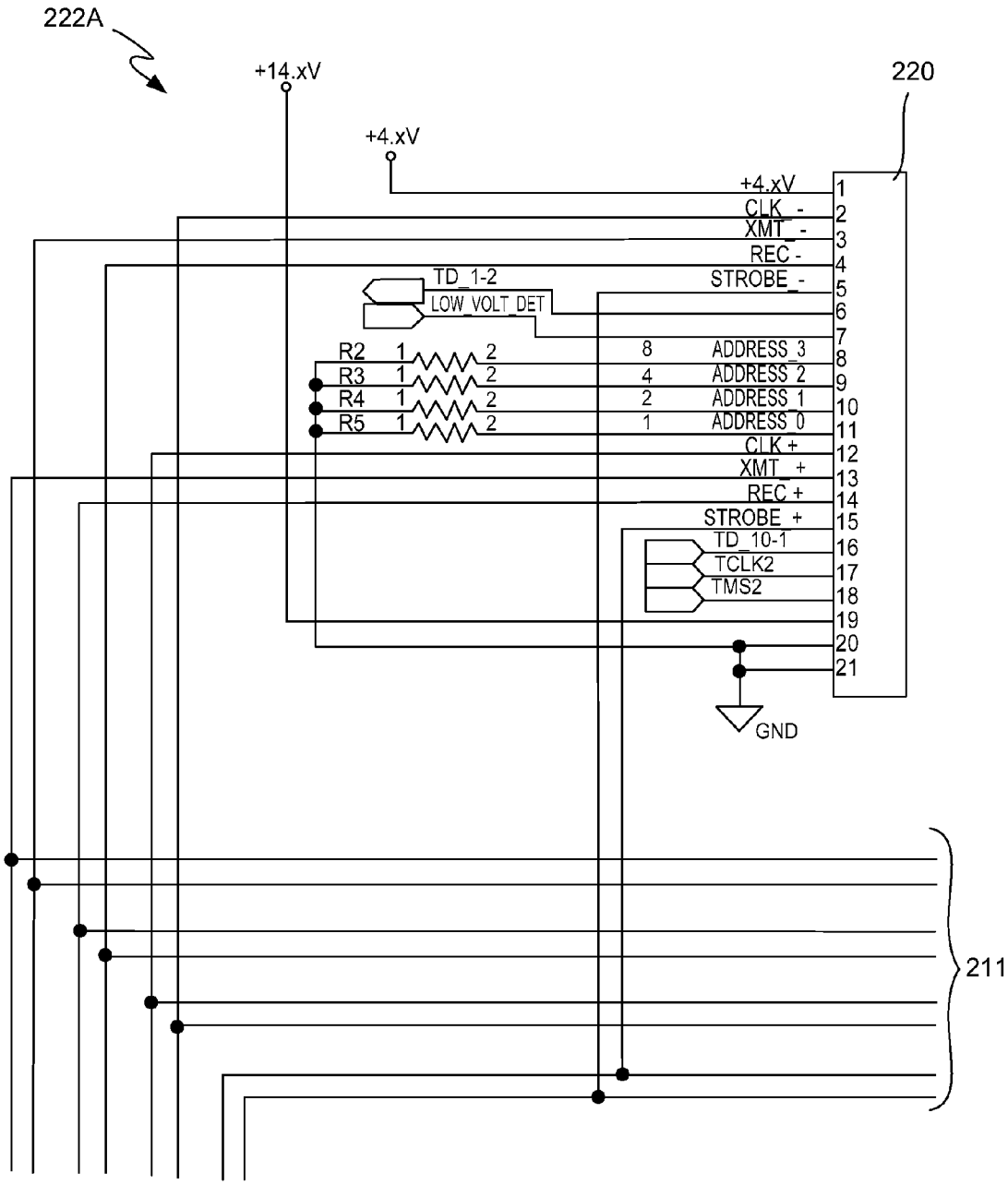
FIG. 7 illustrates an electrical diagram for an exemplary button assembly to flexible cable interface according to one embodiment of the present invention.

FIG. 7 illustrates an electrical diagram for an exemplary button assembly to flexible cable interface according to one embodiment of the present invention. Again, such an electrical schematic is presented only for illustrative purposes, and it will be readily appreciated that a wide variety of alternative electrical arrangements may be suitably used with the present invention. As shown, access location 222A can be the same access location set forth in FIG. 6B. Such an access location is wired for a 21-position cable connector 220. As noted above with respect to FIG. 6B, the various circuit lines 211 and separate address lines connecting to the cable connector 220 can be of various types. In this particular embodiment, positions 1 and 19 of cable connector 220 connect to a set of power lines, while positions 2 and 12 connect to clock lines. A logic device, described below, receives power, such as 13.X V or 14.X volts (V), via position 19 of cable connector 220 at a time when a main power supply, described below, is supplying power greater than or equal to a threshold value, also described below. The logic device receives the power via position 19 to operate on data, where X is a real number. The logic device receives another amount of power, such as 3.X V or 4.X V, via position 1 of cable connector 220 to operate on a logic signal. Positions 3 and 13 connect to "XMT" or transmit data lines, while positions 4 and 14 connect to "REC" or receive data lines. Positions 5 and 15 connect to strobe or synchronization lines, while positions 6 and 16-18 connect to respective in-system programming lines TD_1-2, TD_10-1, TCLK2, and TMS2. Positions 20-21 connect to ground lines, while positions 8-11 connect to the address lines, which are used to provide each access location with its own unique address along the flexible cable. Position 7 connects to the low voltage detection line. It will be readily appreciated that the electrical layouts for each of access locations 222B, 222C and so forth are substantially similar, albeit with different properties along the set of four address lines, so as to create the unique address for each access location and thus button assembly that may be installed thereupon. All circuit lines 211*a*-211*l* are incorporated within flexible cable 110.

Figure 8A:
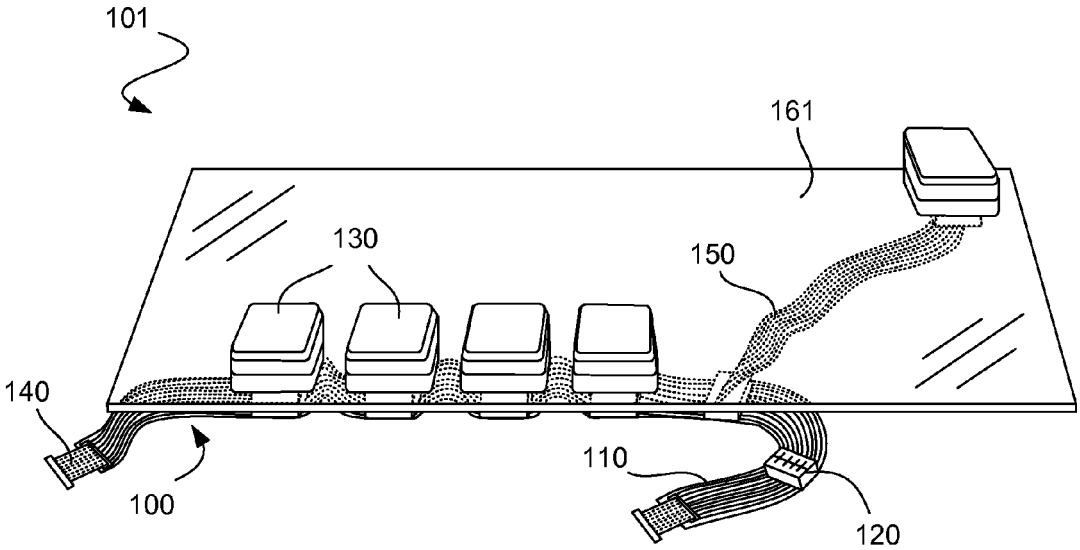
FIG. 8A illustrates in top perspective view one exemplary physical configuration of buttons for the flexibly configurable button panel of FIGS. 3A and 3B according to one embodiment of the present invention.

Moving next to FIG. 8A an exemplary physical configuration of buttons for the flexibly configurable button panel of FIGS. 3A and 3B is illustrated in top perspective view according to one embodiment of the present invention. As shown, physical button panel configuration 101 can involve an actual button configuration and installation into an appropriate electronic device, such as a gaming machine, coin-operated video game, or the like. Physical button panel configuration 101 includes the use of the previously described flexibly configurable button panel 100, having a flexible cable 110, cable connectors 120, button assemblies 130 and harnesses 140, 150. As will be readily appreciated, other different button panels might also be used to arrive at the same physical button panel configuration 101. For example, a button panel having a flexible cable with 15 button locations might also be used to achieve the same end configuration result with five used buttons. Configuration 101 results in the five buttons 130 of the flexibly configurable button panel being arranged such that the first four buttons are in an evenly spaced straight line, while the fifth button is located at some distance above and to the right of the other four buttons.

Such a resulting button configuration can be aided by the use of specific holes or locations set forth in a mounting support plate 161 or other suitable cover plate or device that can be used for locating the buttons for the button panel. Mounting support plate 161 can be included as part of a flexibly configurable button panel or electronic device having such a button panel, although such a button panel may not always require such a mounting support plate or other cover device. Such a mounting support plate can be formed from a rigid material that is sufficiently sturdy for installation into a gaming machine or other electronic device. Holes can be created within the support plate or cover device, such that the various switches, button assemblies and/or other similar components of the button panel can be located through the holes and mounted to or with respect to the mounting support plate or cover plate. In some embodiments, button assemblies can be attached directly to the mounting support plate, with the sturdy nature of the support plate then providing support for the mounted buttons. Alternatively, the plate can function simply as a cover device, with the buttons being mounted to a device frame or some other support beneath the cover plate.

Figure 8B:
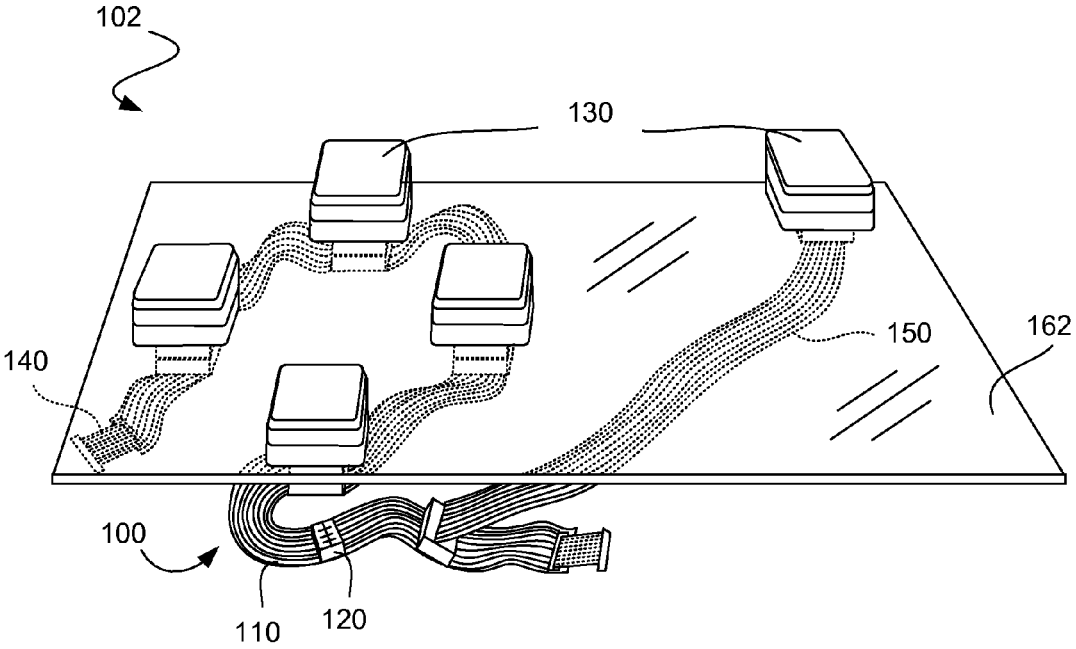
FIG. 8B illustrates in top perspective view an alternative exemplary physical configuration of buttons for the flexibly configurable button panel of FIGS. 3A and 3B according to one embodiment of the present invention.

FIG. 8B illustrates in top perspective view an alternative exemplary physical configuration of buttons for the flexibly configurable button panel of FIGS. 3A and 3B. While configuration 101 of FIG. 8A had the first four buttons of flexibly configurable button panel 100 in an evenly spaced line, alternative physical button panel configuration 102 provides that the same buttons 130 from the same button panel 100 can alternatively be arranged into a circle instead. As will be appreciated, all components from configurations 101 and 102 can be identical, with the exception of the respective mounting support plates. As such, mounting support plate 162 for configuration 102 is alternatively adapted to have holes such that the buttons 130 can be arranged in a circular formation. It is specifically contemplated that the same flexibly configurable button panel 100 from FIG. 8A could be removed from the support plate 161 and configuration 101 depicted there, and then readily installed into configuration 102 with support plate 162 as shown in FIG. 8B. Such flexibility and reconfigurability are made possible through the flexible, twistable and bendable nature of flexible cable 110, to which the buttons 130 are attached.

As will be readily appreciated, a wide variety of configurations having differing numbers of buttons can be used, and it is specifically contemplated that the flexibly configurable button panels disclosed herein can be reconfigured from one to another configuration in many such instances. For example, where a third different button configuration (not shown) having seven buttons in a triangular shape might be desired, two buttons could be added to open connectors 120 along button panel 100, and the flexible cable 110 then readjusted such that the buttons can all align in a triangle. Although the ability to reconfigure for different numbers of buttons and relative button locations is useful, another significant application for the flexibly configurable button panels disclosed herein can be the streamlined manufacture of many such button panels for installation into different model gaming machines having different button numbers and configuration requirements. To this end, additional features such as different button panel specifications and identification numbers or codes for such specs can be useful. Dedicated button panel processors can also be particularly useful for such flexibly configurable button panels.

Figure 9:
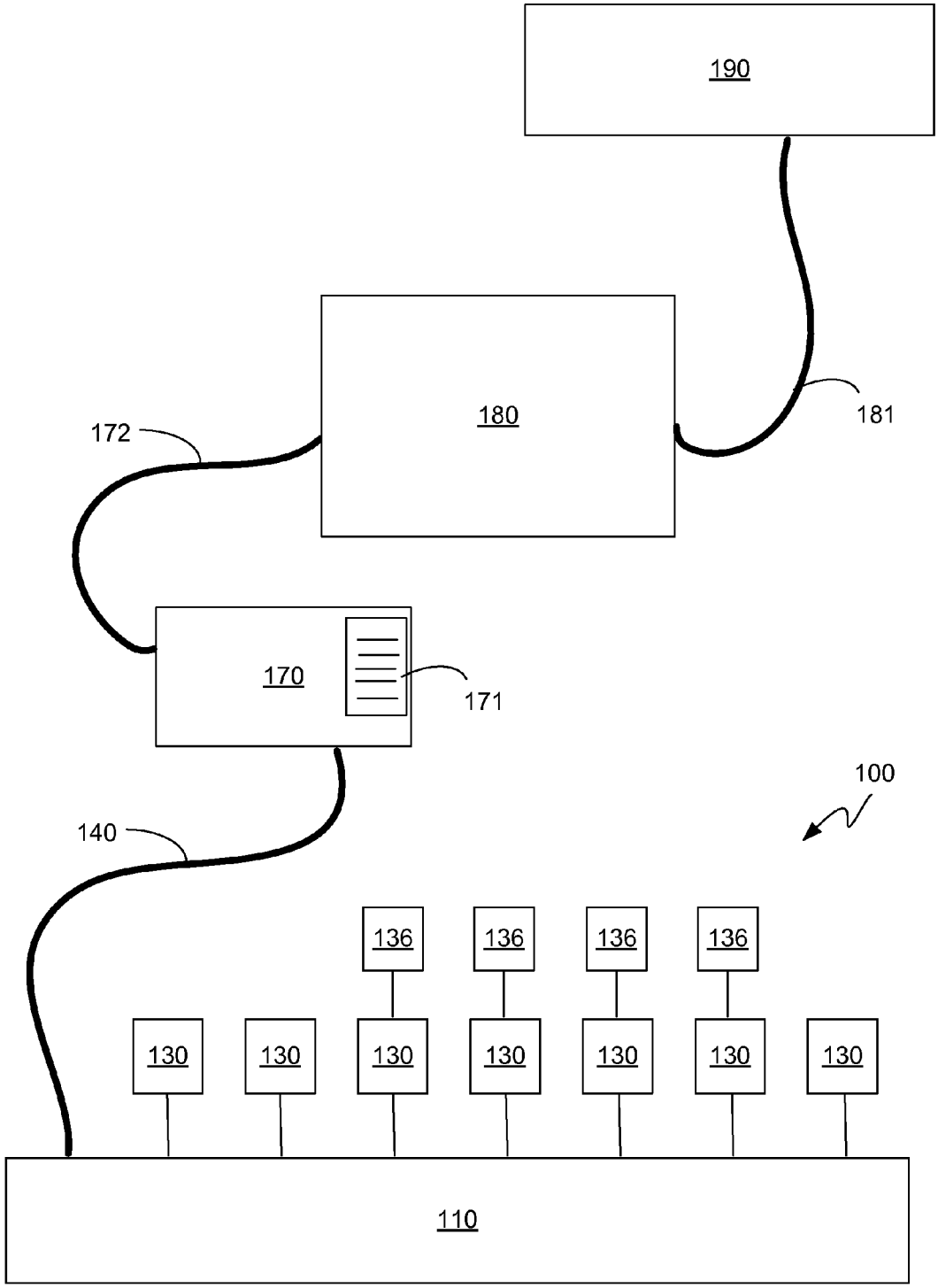
FIG. 9 illustrates a block diagram of an exemplary flexibly configurable button panel and associated processing components according to one embodiment of the present invention.

Referring now to FIG. 9, a block diagram of an exemplary flexibly configurable button panel and various associated processing components is provided according to one embodiment of the present invention. Flexibly configurable button panel 100 can be identical or substantially similar to foregoing embodiments, and as such may have flexible cable 110 connecting a plurality of buttons 130, some or all of which may have a button display screen 136 embedded therein. A processor harness 140 can be used to connect flexible cable 110 to a button panel identification device 170, which button panel identification (ID) device may include an ID component 171 having a particular identifying number or code. The button panel ID device 170 may also be in communication with a dedicated dynamic button panel controller 180, such as by a further extending communication line 172. The dynamic button panel controller 180 may then in turn be in communication with a master gaming controller 190 of a gaming machine or other CPU type component of an alternative electronic device via communication line 181.

As will be readily appreciated, the exact general arrangement depicted herein is not intended to be limiting, and other arrangements are certainly possible. For example, it is possible to have button panel ID device 170 and/or dynamic button panel controller 180 be disposed on a single board into which flexible cable 110 is directly plugged, such that harness 140 and a coupling communication line 172 are then unnecessary. In some embodiments, button panel ID device 170 and dynamic button panel controller 180 can be located on the same board or even on the same chipset or chip, as may be desired.

In various embodiments, button panel ID device can be used to identify the exact associated button panel 100, such as a manufacturer's serial number, although preferably such an ID number or code can correspond to a particular callout of button assemblies that should be present at specific cable connectors along the flexible cable 110. In this manner, the particular number or code on ID component 171 can be used to designate the number of buttons to be used on the button panel, the types of buttons to be used, the exact locations or addresses for such buttons on the various open connectors of the button panel, and/or the numbers and locations of open connectors to which no items should be plugged or directly coupled. The actual ID component can be any of a variety of item, such as, for example, a set of switches that can be set manually or electrically, or a small processing unit and/or memory or other storage device adapted to contain the appropriate ID number or code. In the event that manual switches are used, DIP switches are thought to work well, although other forms of manual switches may certainly be substituted.

Dynamic button panel controller 180 can be adapted to perform a number of button related functions, including, for example, the polling or checking of buttons, button diagnostics, button programming, button input processing, and video or visual image processing for button having display screens, among other pertinent functions. It is worth noting that dynamic button panel controller 180 is set apart from master gaming controller 190, such that the bulk of processing for the entire button panel 100 can be accomplished by this dedicated controller 180, thereby alleviating some of the processing burdens on the MGC, which can be particularly useful for instances where large numbers of buttons are being used. Although a variety of connection types can be used, it is thought that a universal serial bus ("USB") type connection 181 between the dynamic button panel controller 180 and MGC 190 is particularly suitable.

While dedicated dynamic button panel controller 180 is preferably adapted to process input from each of the various button assemblies 130 on the button panel 100, such a button panel controller may also be used to determine whether the number of buttons and/or configuration of buttons is proper. As noted above, button panel ID device 170 having particular ID component 171 can be used to set forth the exact number, type and arrangement of buttons along flexible cable 110. In some embodiments, button panel ID device can be a relatively "dumb" communications and power processing device, such that the actual button panel controller 180 is adapted to read the ID code from the ID component, and then poll the various button addresses to ensure that the proper component or no component is present at each such address. Alternatively, button panel ID device can be adapted to perform this function as well. Such a polling or checking function can be one that is performed during the manufacturing process, during a startup or boot process, during a diagnostics check, or at any other time as may be appropriate. In some embodiments, such a function can be used to detect broken or malfunctioning buttons during regular operations, such that an alert can be given if a problem is detected.

In addition to the foregoing functions, button panel controller 180 can also be a video or display processing device for each of the button displays 136 on the associated buttons 130. Such a processing device can be responsible not only for uploading images, animations and/or video clips to each individual button display, but can also be a storage location for holding such display items as well. Associated memory components (not shown) may be used to facilitate such a function. For this specialized functionality, controller 180 is preferably a video type processor, with a wide variety of such processors being suitable for use with the present invention. Although other brands and models may certainly be used, it is thought that the ADSP-BF534 Blackfin® model processor by Analog Devices™ Inc., of Norwood Mass. is suitable for such a purpose. Such a processor can be used to control all desired display and other functionalities with respect to button panel 100, and in the event that multiple button panels are used in a given gaming machine or other electronic device, such multiple panels may also be controlled by such a Blackfin® processor.

Figure 10:
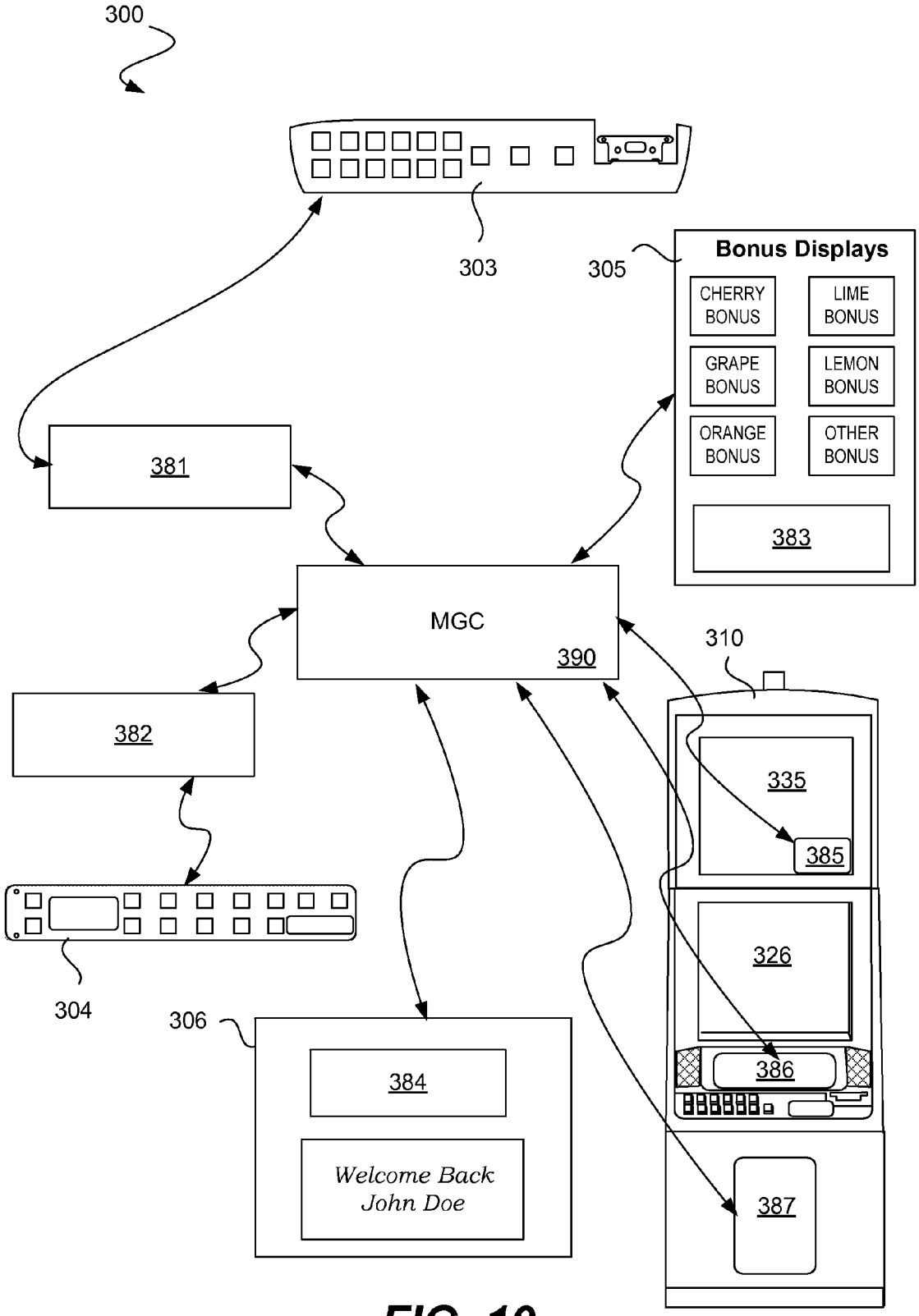
FIG. 10 illustrates a block diagram of an exemplary dynamic display system for a gaming machine having dynamic display buttons according to one embodiment of the present invention.

As described above with respect to the use of a dedicated button panel controller that can be used to control and drive the displays of various buttons, similar considerations can be made with respect to some or all displays in a gaming machine. Moving now to FIG. 10, a block diagram of an exemplary system 300 for a. gaming machine having dynamic display buttons according to one embodiment of the present invention is provided. Several components of overall system 300 can be identical or substantially similar to previously disclosed items. For example, gaming machine 310 can be similar to gaming machine 10, gaming machine displays 326 and 335 can be similar to displays 26 and 35, master gaming controller 390 can be similar to master gaming controller 190, flexibly configurable button panels 303 and 304 can be similar to flexibly configurable button panels 100 and 200, and dynamic button panel controllers 381 and 382 can be similar to dynamic button panel controller 180. As in the foregoing embodiments, various buttons from one or both button panels can be equipped with "dynamic displays," such that the respective dynamic button panel controller should be a display controller as well. Additional components can include other dynamic displays, such as, for example, a player tracking device with display 306, a panel of bonus displays 305, and specialized dynamic displays 385, 386 and 387 distributed about the gaming machine.

While primary gaming machine display 326 and top box display 335 may be driven and directly controlled by one or more elements within MGC 390, various other dynamic displays are preferably driven and directly controlled by display controllers that are located outside the province of MGC 390. For example, the dynamic button panel controller 381 and subject dynamic button panel 303 can be arranged as set forth above in the examples of FIG. 9, and a similar arrangement can be had for controller 382 and its subject button panel 304. Alternatively, only one dynamic button panel controller 381 might be used for both button panels 303, 304 bearing buttons with dynamic displays, with controller 382 either not being used or being included into a combination controller board with controller 381. Also, dynamic display controller 383 might be used to control the displays of a bonus dynamic display panel 305, with such a dynamic display controller being similar set apart from MGC 390. In fact, dynamic display controller 383 may even be built into bonus dynamic display panel 305, as shown. Similarly, dynamic display controller 384 can be adapted for the control of a dynamic display on a player tracking device 306, and may also be built into that device or otherwise located away from MGC 390.

Additional dynamic displays with associated dedicated dynamic display controllers may be located elsewhere on and about gaming machine 310, such as dynamic displays having built in dynamic display controllers at display windows 385 in the top box, 386 above a button panel, and 387 in the belly glass of the gaming machine, among other locations. Such dynamic displays may all be controlled directly by one or more dedicated dynamic display controllers that are separate from the MGC of the gaming machine, thereby reducing the overall display processing burdens that are typically placed upon the MGC (also sometimes called a "brain box" of the gaming machine). In some instances, such separate display controllers 381-387 can be adapted to control their respective displays in isolation, although it is preferable that there be at least some high level form of communications between the MGC and each separate display controller, such as via a USB or other suitable connection. For example, the MGC may instruct a given display controller to provide a celebration display on one or more of its display units, whereupon the display controller has the autonomy to select and process the actual type and sequence of celebration to be displayed.

In some embodiments, there can be five, ten, or even 32 or more dynamic displays, particularly where a large number of dynamic display type buttons are used, since each individual display type button can be considered a separate dynamic display. Each dynamic display can be adapted to display a variety of still or static images, animations, video clips, "attract-mode" or other default images, diagnostic images to aid in the test and repair of various machine components, and/or any combination of the foregoing items. In some embodiments, each dynamic display can also be associated with one or more dedicated memory devices or other storage units, such that various images, animations, clips and the like can be stored at the dynamic display for ready retrieval and display with minimal processing and/or downloading of display materials being needed. Alternatively, or in addition to such storage being possible at a dynamic display device, one or more of the various dynamic display controllers can be similarly adapted to have dedicated memory or storage units that have stored static visual images, animations, video clips and/or other display materials for use with one or more respectively controlled dynamic displays.

In still further embodiments, one or more of the various dynamic display controllers can be adapted to download display materials for display on its controlled display devices and/or for storage near the dynamic display controller for ready access and use at a later time. Such downloaded materials may come from MGC 390 and/or from any other suitable outside source, such as a specialized download server or other external server associated with gaming machine 310. Various arrangements for such a download server and associated gaming machines and other components distributed across a gaming network are generally known in the art, and examples of such are also provided in greater detail above with respect to FIG. 2. In some embodiments, such downloaded materials may first be provided to MGC 390, upon which the materials are then relayed to the various appropriate dynamic display controllers by the MGC, such as via USB or other suitable connections.

In this manner, the MGC can be charged with accessing downloaded materials from a remote server and then distributing them to the various dynamic display controllers as may be appropriate, without then being further burdened by any display processing that may be incumbent upon the use of such downloaded materials. Although there are countless examples of how such applications might be implemented for any given gaming machine or system, a particular example might involve the use of downloadable games and the different displays that are to be used for the various button displays from game to game. For example, a card based game existing on gaming machine 310 may call for buttons labeled "hold," "drop," "deal," "bet" and "redraw," among others. When a player or casino personnel might then elect to download a reel based game to gaming machine 310, the labels for some or all of these buttons might need to be changed and/or blacked out, in the event that fewer buttons are to be used with the new reel based game. In such an instance, the MGC 390 might request the new downloaded game and a host of associated images and other applications, which could include new button labels. Such new button labels might include, for example, "spin," "respin," "nudge," and "bonus bet," among others. Upon receiving the display images for these new button labels, the MGC could then simply pass these display images along to the responsible dynamic display controller 381, where such display images are then stored locally and/or provided to the individual buttons for display in association with the new game.

As in the case of controllers 381 and 382 being combined into one control unit for two button panels, it is also contemplated that any particular dynamic display controller be adapted to control dynamic displays on disparate devices. For example, the same controller might be used to control dynamic displays on a button panel and a player tracking device, as well as a belly glass dynamic display. In such instances where multi-functional dynamic display controllers are used, it is also preferable that such controllers also be adapted to perform diagnostics checks and be able to detect which kinds of devices with which the display controller is communicating. For example, if dynamic display controller 382 were removed, belly glass dynamic display 387 did not have a built in display controller, and both button panel 304 and belly glass dynamic display 387 were connected to dynamic display controller 381, such controller 381 is preferably adapted to poll both new devices to determine their device type and whether controller 381 is able to support the needs of these disparate display devices. Again, it is thought that a Blackfin® type display controller device can be used for such applications.

It will be readily appreciated that the various methods and illustrative flowcharts provided herein are merely exemplary, and that the present invention may be practiced in a wide variety of suitable ways. While the provided flowcharts may be comprehensive in some respects, it will be readily understood that not every step provided is necessary, that other steps can be included, and that the order of steps might be rearranged as desired by a given manufacturer, as desired.

Figure 11:
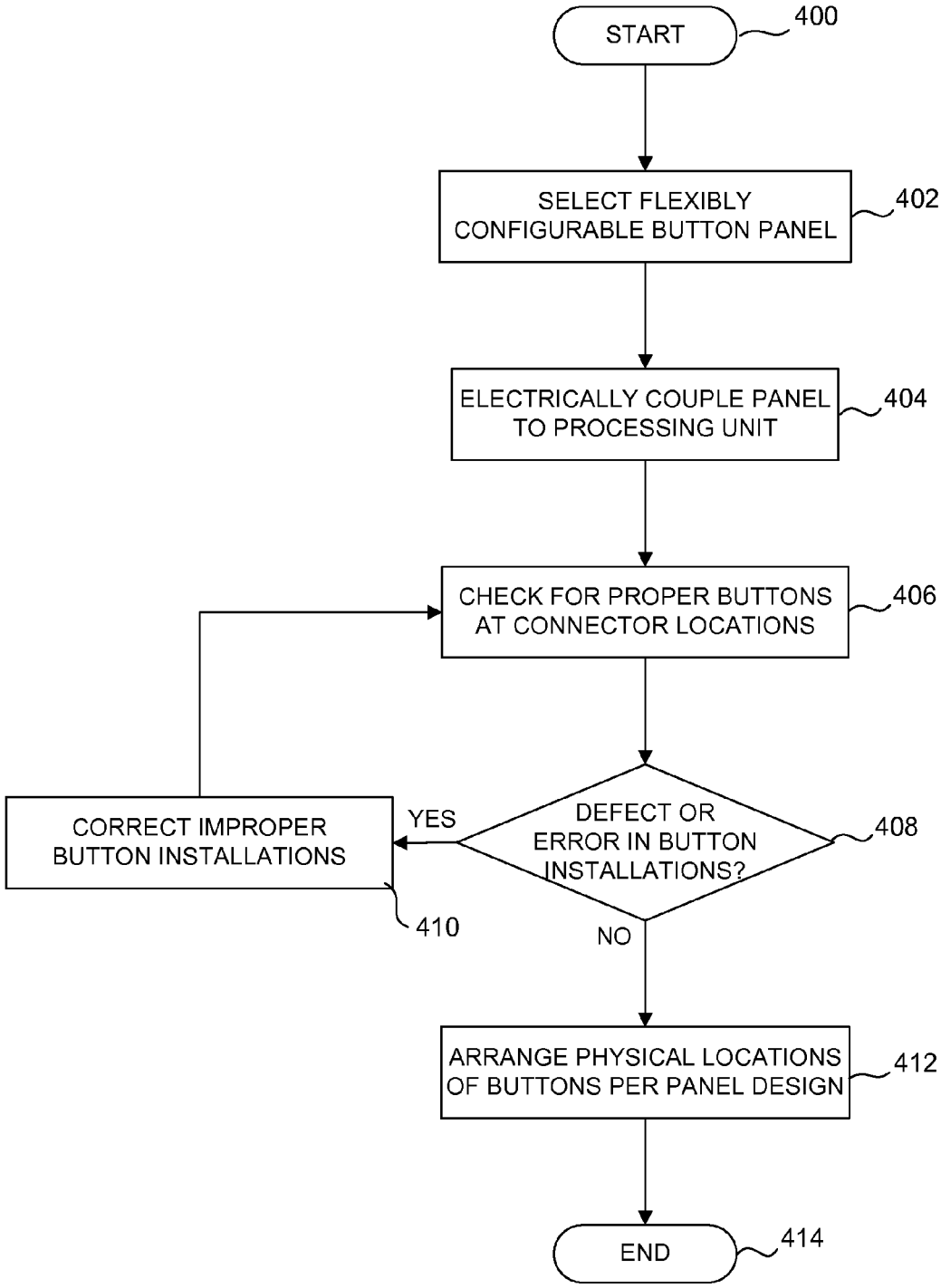
FIG. 11 illustrates a flowchart of an exemplary method of manufacturing an electronic device having a flexibly configurable button panel according to one embodiment of the present invention.

FIG. 11 shows a flowchart illustrating an exemplary method of manufacturing an electronic device using a flexibly configurable button panel. In particular, after start step 400, a first process step 402 involves selecting a flexibly configurable button panel. Such a button panel can be, for example, any of the exemplary flexibly configurable button panels as described above, such as button panel 100, for instance. Process step 404 then involves electrically coupling the selected button panel to a processing unit for the electronic device. Such a processing unit could be, for example, a dynamic button panel controller, a button panel ID device, a master gaming controller, or any other suitable controller adapted for interaction with the flexible button panel. The method then continues to process step 406, where a check is made for the proper buttons, other devices and/or appropriate lack thereof being installed on the button panel in general, as well such buttons and/or devices being installed as at the proper locations or addresses along the button panel, as described above in greater detail. Such a check can also determine whether the installed buttons are functioning properly, as may be desired.

At a subsequent decision step 408, an inquiry is made as to whether there are any defective, missing or otherwise improperly installed buttons or other devices on the button panel. If so, then the method moves to process step 410, where the improper button installations and/or defective buttons can be corrected. From step 410, the method can then revert back to step 406, such that further checks can be made until there are no defects or errors in the button installations along the flexibly configurable button panel. In the event that there are indeed no such defects or errors, then the method continues to process step 412, where the physical locations of the various buttons and/or other items can be arranged with respect to each other according to a pre-designed panel configuration. Examples of such arrangements and designs are provided above in FIGS. 8A and 8B, along with the descriptions thereto. With respect to step 412, a mounting support plate may be used if desired. After the physical locations of the buttons are arranged at step 412, the method then finishes at end step 414. Of course, additional steps may also apply to such a manufacturing process, such as for example, plugging in or coupling individual buttons to the button panel, setting a panel ID either manually or electronically, and designing the actual button panel configuration or arrangement as it is to be installed.

Figure 12:
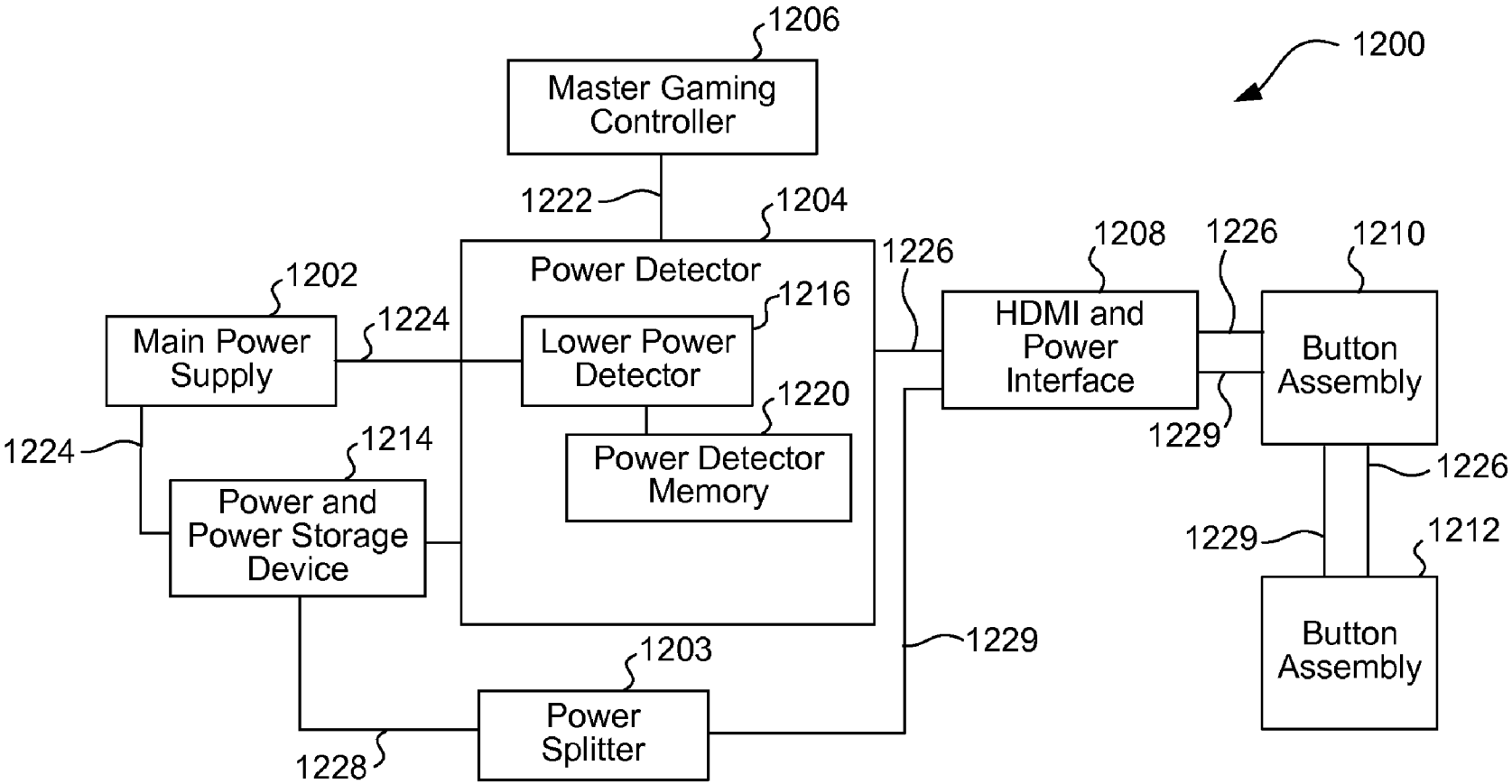
FIG. 12 is a block diagram of an embodiment of a system for increasing life of a light emitting element.
Figure 13:
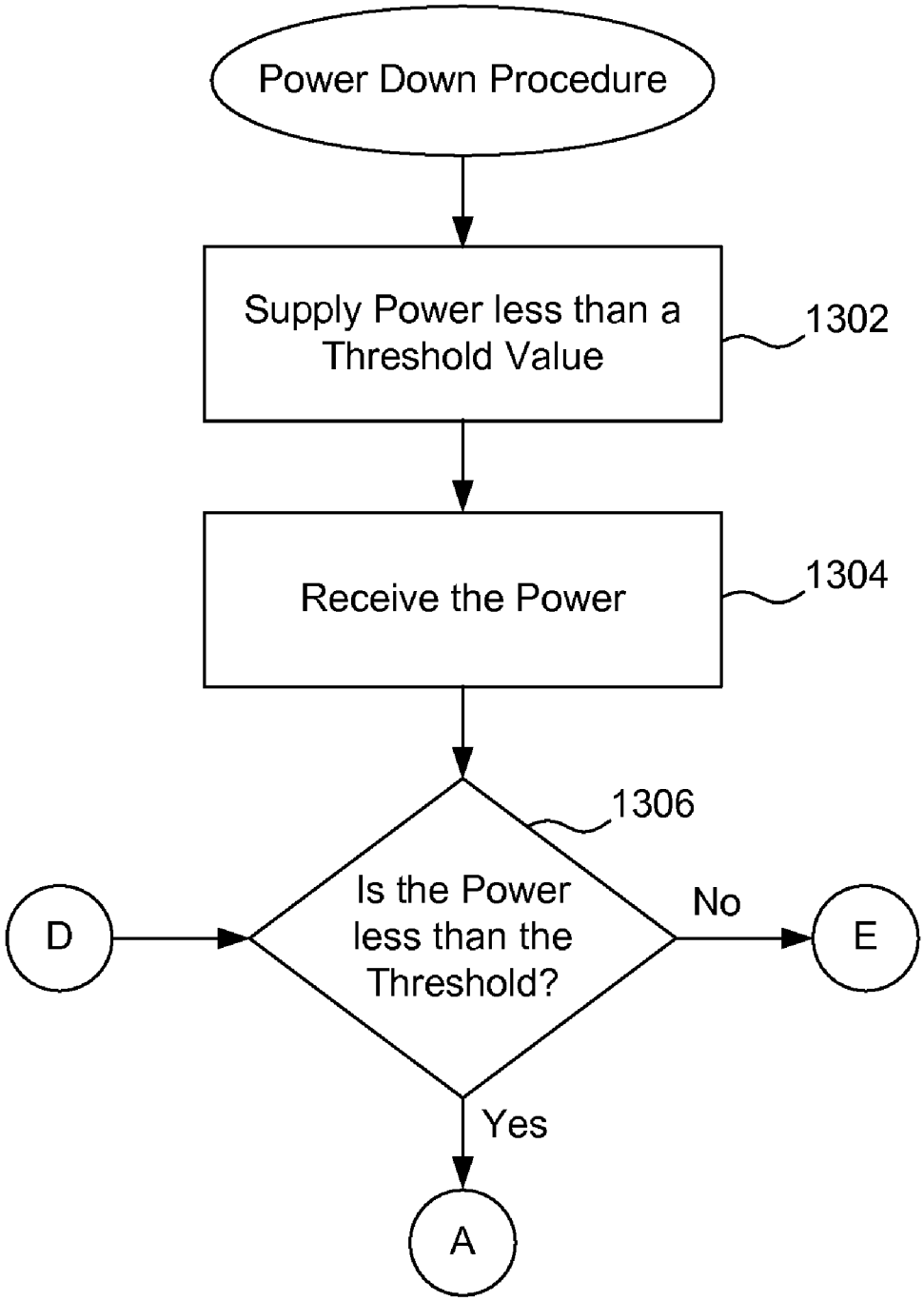
FIG. 13 is a flowchart of an embodiment of a power down procedure for increasing life of a light emitting element executed by using the system of FIG. 12.
Figure 14:
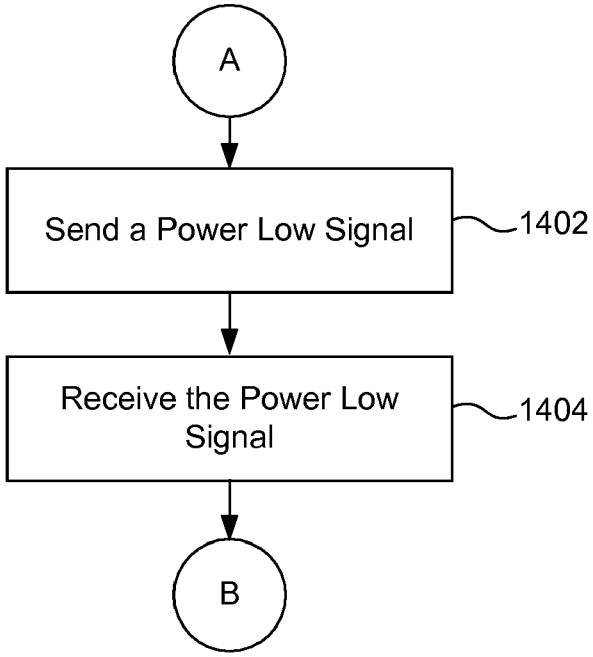
FIG. 14 is a continuation of the flowchart of FIG. 13.
Figure 15:
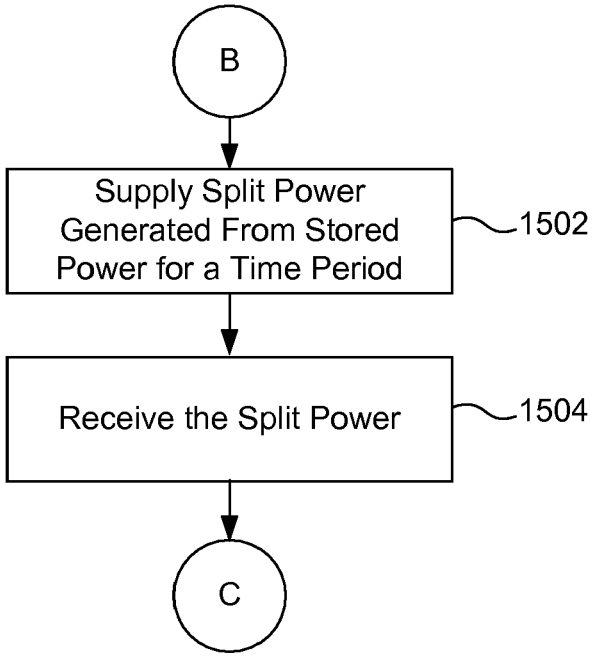
FIG. 15 is a continuation of the flowchart of FIG. 14.

FIG. 12 is a block diagram of an embodiment of a system 1200 for increasing life of a light emitting element and FIGS. 13, 14, and 15 are flowcharts of a method for increasing the life by using system of FIG. 12. FIGS. 13-15 are used to describe an embodiment of a power down procedure.

System 1200 includes a main power supply 1202, a power splitter 1203, a power detector 1204, an MGC 1206, a high definition multimedia interface (HDMI) and power interface 1208, a plurality of button assemblies 1210 and 1212, and a power and power storage device 1214. Button assembly 130 (FIGS. 3A, 3B, 5A, 8A, 8B, and 9) is an example of each button assembly 1210 and 1212. Further, button assembly 230 (FIG. 6A) is another example of each button assembly 1210 and 1212. Each MGC 190 (FIG. 9) and MGC 390 (FIG. 10) is an example of MGC 1206. An example of main power supply 1202 includes a voltage power supply supplying a voltage ranging from and including 13 V to 15 V.

Main power supply 1202 supplies power to all or a majority of electrical components of gaming machine 10 (FIG. 1). For example, main power supply 1202 supplies power to ticket validator 23, video display monitor 26, ticket dispenser 28, one or more additional displays 30, speakers 32, card reader 31, secondary video display monitor 35, and MGC 1206.

Power detector 1204 includes a low power detector 1218 and a power detector memory 1220. Power detector memory 1220 may be a RAM. Low power detector 1218 may be a processor, an application specific integrated circuit (ASIC), or a field programmable gate array (FPGA). Power and power storage device 1214 may be a capacitor or a rechargeable battery. MGC 1206 connects to power detector 1204 via a cable 1222, such as a USB cable or another serial cable, and performs primary gaming functions, such as a executing a game code to generate a game determination outcome.

Referring to FIGS. 12 and 13-15, main power supply 1202 supplies 1302 power 1224 less than a threshold value, such as 24 V, 25 V, or 26V, to low power detector 1218. The threshold value is provided by the user via an input device (not shown), such as a mouse or a keyboard, to low power detector 1218. Low power detector 1218 receives 1304 power 1224 and determines 1306 whether power 1224 falls below the threshold value. As an example, power 1224 falls below the threshold value at a time of power failure or other malfunction of main power supply 1202. Upon determining that power 1224 is less than the threshold value, low power detector 1218 generates and sends 1402 a power low signal 1226 indicating that power 1224 fell below the threshold value to button assemblies 1210 and 1212 via HDMI and power interface 1208.

Button assembly 1210 receives 1404 power low signal 1226 and extends life of a light emitting element within the button assembly by executing a method for extending life of a light emitting element. Similarly, button assembly 1212 receives 1404 power low signal 1226 and extends life of a light emitting element within the button assembly by executing a method for extending life of a light emitting element.

At a time power supplied by main power supply 1202 is not less than the threshold value, power and power storage device 1214 stores power, such as a portion of power supplied by main power supply 1202 or another power supply, which is not used by button assemblies 1210 and 1212, to generate stored power 1228. Power and power storage device 1214 supplies 1502 stored power 1228 to power splitter 1203. Power splitter 1203 splits stored power 1228 to generate split power 1229. An example of split power 1229 includes power having a voltage of 13.X V. Another example of split power 1229 includes a power having a voltage of 14.X V. As yet another example, power splitter 1203 splits stored power 1228 into D volts, E volts, and F volts. Examples of D volts include 13.X volts and 14.X volts. Examples of E volts include 3.X volts and 4.X volts. Examples of F volts include a difference between stored power 1229 and a sum of D and E) volts.

Power splitter 1203 supplies the split power 1229 via HDMI and power interface 1208 at a time power 1224 is less than the threshold value to button assemblies 1210 and 1212 and continues to supply split power 1229 for a time period, such as ranging from and including 1 millisecond (ms) to 10 ms, after power 1224 supplied by main power supply 1202 falls below the threshold value. For example, power splitter 1203 supplies split power 1229 having 14.3 V to button assembly 1210 until an end of a 2 ms time period after power 1224 supplied falls below 25 V. As another example, power splitter 1203 supplies split power 1229 having 14.3 V to button assembly 1210 for at least 2 ms after power 1224 supplied falls below 26 V. Split power 1229 supplied by power splitter 1203 until the time period satisfies the power requirements for operating each button assembly 1210 and 1212. Button assemblies 1210 and 1212 receive 1504 split power 1229 and operate based on the split power 1229 until an end of the time period after power 1224 supplied by main power supply 1202 falls below the threshold value.

In another embodiment, instead of supplying power to a majority or all electrical components of gaming machine 10 (FIG. 1), main power supply 1202 supplies power to specific electrical components of gaming machine 10 (FIG. 1), such as, button assemblies 1210 and 1212. In yet another embodiment, power detector 1204 includes a comparator that compares power 1224 supplied by main power supply 1202 to the threshold value to output a signal indicating whether the power 1224 is less than the threshold value. In still another embodiment, system does not include HDMI and power interface 1208.

In another embodiment, low power detector 1218 stores power low information, such as a time, a date, and an amount of power 1224, at a time at which power 1224 is less than the threshold value. In yet another embodiment, HDMI and power interface 1208 receives power low signal 1226 and may convert power low signal 1226 into a differential power low signal.

In still another embodiment, a power regulator that regulates power supplied by main power supply 1202 to generate regulated power is connected between main power supply 1202 and power detector 1204 and between main power supply 1202 and power and power storage device 1214. For example, the power regulator transforms, amplifies or deamplifies, by a limited amount, power supplied by main power supply 1202 to make the power compatible with a set of power requirements of each button assembly 1210 and 1212. As another example, the power regulator stabilizes, such as filters, power supplied by main power supply 1202 to remove noise within the power. In another embodiment, system 1200 includes at least one button assembly, such as more or less than two button assemblies 1210 and 1212. Line 211*c* (FIG. 6B) communicates power low signal 1226 to button assemblies 1210 and 1212 (FIG. 12) and line 211*b* (FIG. 6B) communicates split power 1229 to the button assemblies.

Figure 16:
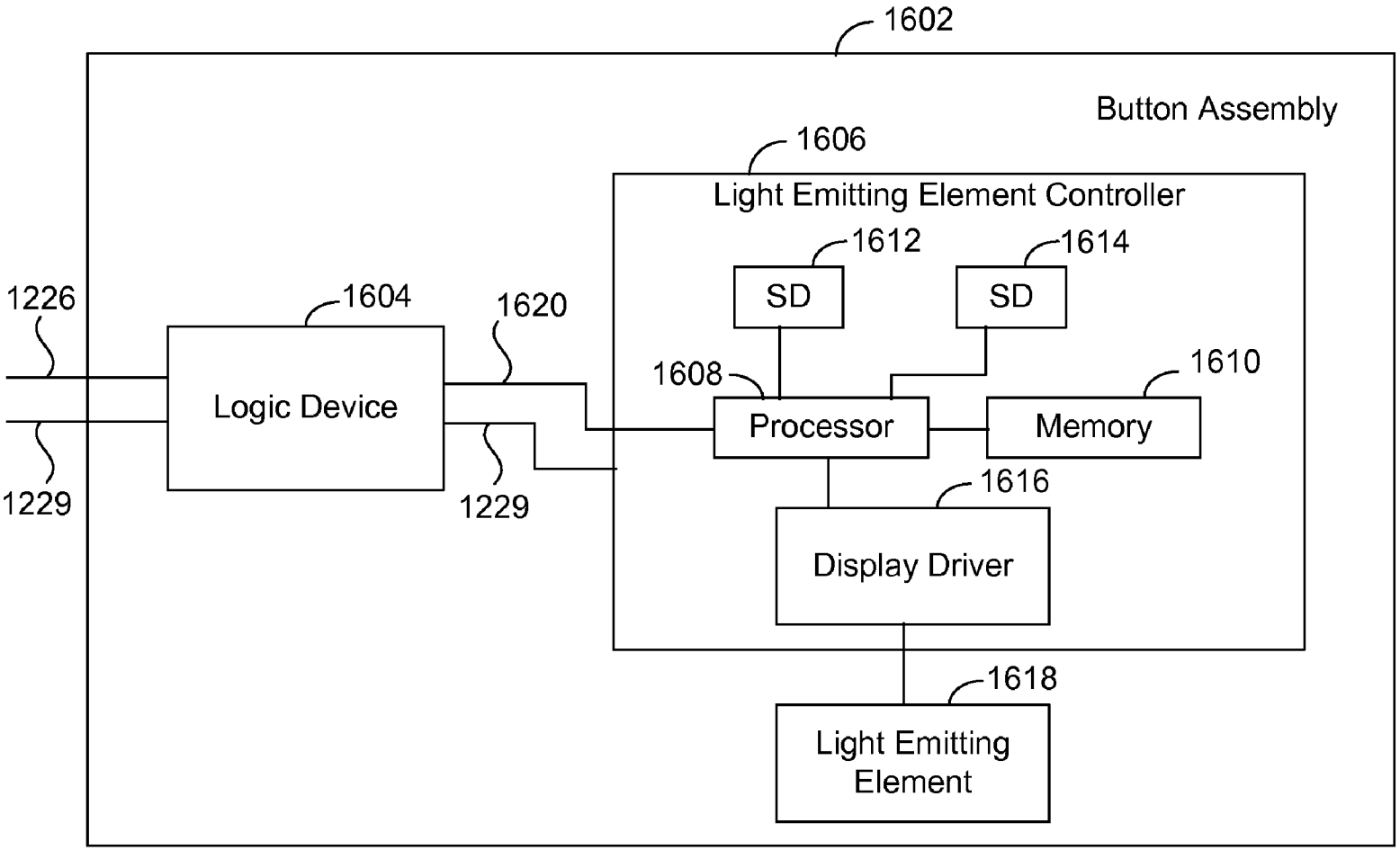
FIG. 16 is a block diagram of an embodiment of a button assembly for increasing life of a light emitting element within the assembly.
Figure 17:
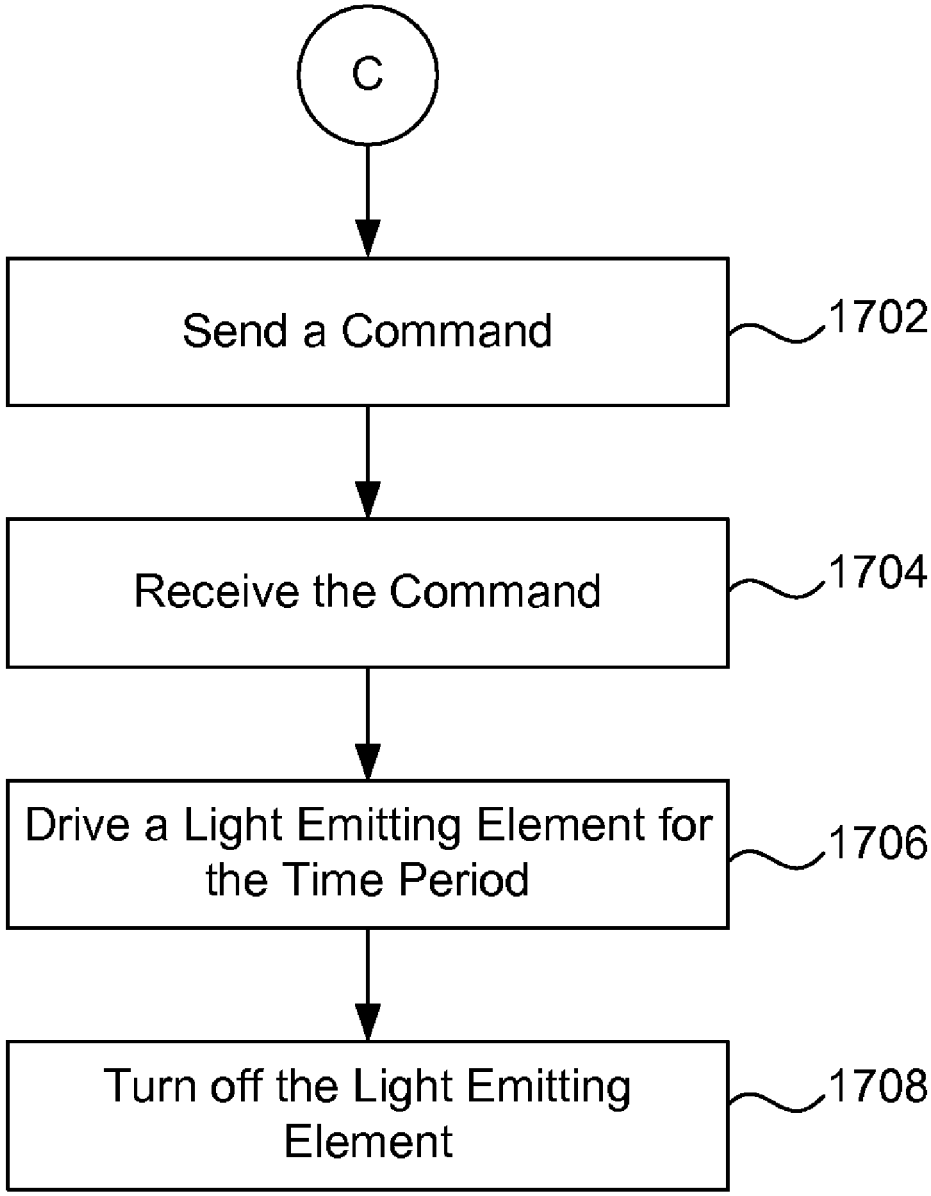
FIG. 17 is a flowchart of an embodiment of a method of increasing life of a light emitting element executed by using the button assembly of FIG. 16.

FIG. 16 is a block diagram of a button assembly 1602 for increasing life of a light emitting element 1618 and FIG. 17 is a flowchart of an embodiment of a method of increasing life of a light emitting element. Button assembly 1602 may be button assembly 1210 (FIG. 12) or button assembly 1212 (FIG. 12). Button assembly 1602 includes a logic device 1604, a light emitting element controller (LEC) 1606, and a light emitting element 1618. Light emitting element 1618 may be an organic LED (OLED), an LED, a transparent OLED (TOLED), an electro luminescence (EL) element, or an LCD element. Examples of logic device 1604 include an FPGA, an ASIC, and a processor.

LEC 1606 includes an LEC processor 1608, an LEC memory 1610, a plurality of storage devices (SDs) 1612 and 1614, and a display driver 1616. An example of display driver 1616 includes a transistor, such as a bipolar junction transistor (BJT) or a field effect transistor (FET), that generates a current that drives light emitting element 1618. Each storage device 1612 and 1614 may be a shift register, a latch, or a flip-flop.

LEC memory 1610 includes a RAM. During the time period, logic device 1604 receives 1504 (FIG. 15) split power 1229 from power splitter 1203 and supplies the split power 1229 to light emitting element 1618 via LEC 1606. Light emitting element 1618 operates, such as remains on, upon receiving split power 1229 for the time period. LEC 1606 stores a plurality of parameters, such as a voltage amount and a refresh rate, in storage devices 1612 and 1614. For example, LEC 1606 stores the voltage amount in storage device 1612 and the refresh rate in storage device 1614.

LEC processor 1608 provides the voltage amount at the refresh rate to display driver 1616 and display driver 1616 generates an amount of current at the refresh rate to drive light emitting element 1618 at the refresh rate. LEC processor 1608 generates the voltage amount and the refresh rate based on data stored within LEC memory 1610. The data stored within LEC memory 1610 corresponds to data signals received via circuit lines 211*d* (FIG. 6B) and 211*e* (FIG. 6B), and is generated by MGC 1206 or by button panel controller 180 (FIG. 9) from primary gaming machine functions, such as functions within a game code, performed by MGC 1206.

Referring to FIGS. 16 and 17, upon receiving 1404 (FIG. 14) power low signal 1226 from power detector 1204 during the time period, logic device 1604 sends 1702 a command 1620 to LEC processor 1608 to change the voltage amount within storage device 1612 to zero and the refresh rate within storage device 1614 to zero. LEC processor 1608 receives 1704 command 1620 from logic device 1604 during the time period and changes the voltage amount within storage device 1612 to zero and the refresh rate to zero. LEC processor 1608 changes the voltage amount and the refresh rate to zero during the time period.

LEC processor 1608 provides the voltage amount, which is zero, and the refresh rate, which is also zero, to display driver 1616 and display driver 1616 drives light emitting element 1618 based on zero current, which is generated from the zero voltage amount at the zero refresh rate. Display driver 1616 drives 1706 light emitting element 1618 for the time period. After the time period, since main power supply 1202 providing power 1224 is below the threshold value and stored power 1228 falls below the threshold value, the power requirements for operation of light emitting element 1618 are not met and light emitting element 1618 turns off at 1708.

A technical effect of the herein described systems and methods for increasing life of a light emitting element includes increasing life of light emitting element 1618. Since light emitting element 1618 turns off after notifying LEC processor 1608 and light emitting element 1618 that power 1224 from main power supply 1202 fell below the threshold value, life of the light element 1618 is increased. The notification is provided by sending command 1620 to change the voltage amount within storage device 1612 to zero and/or the refresh rate within storage device 1614 to zero before the stored power 1228 becomes insufficient to operate light emitting element 1618 and driving light emitting element 1618 based on the zero voltage amount and the zero refresh rate. The time period provides an additional time for the notification to extend life of light emitting element 1618.

Figure 5A:
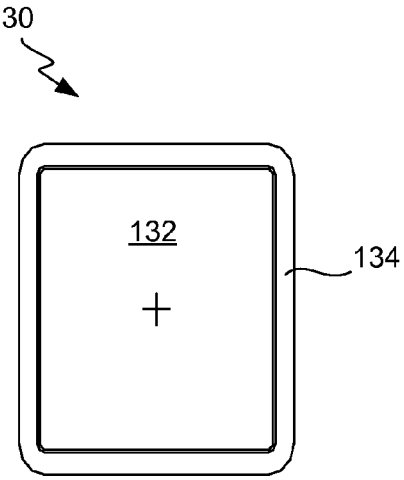
FIGS. 5A through 5D illustrate in top, side, front and partially exploded perspective views an exemplary button assembly according to one embodiment of the present invention.
Figure 5B:
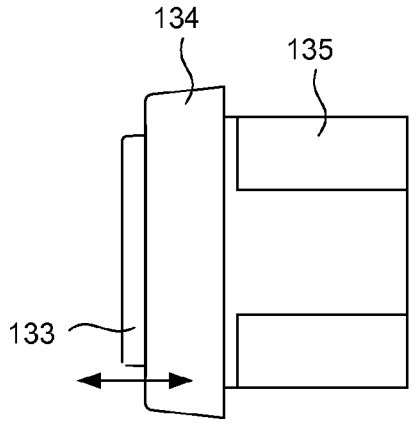
Figure 5C:
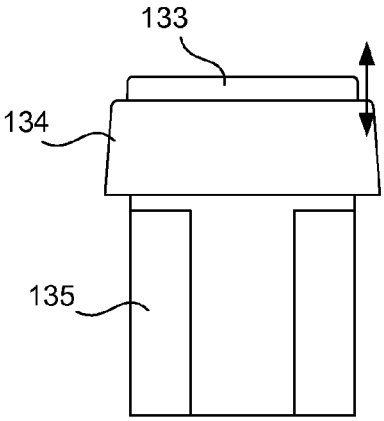
Figure 5D:
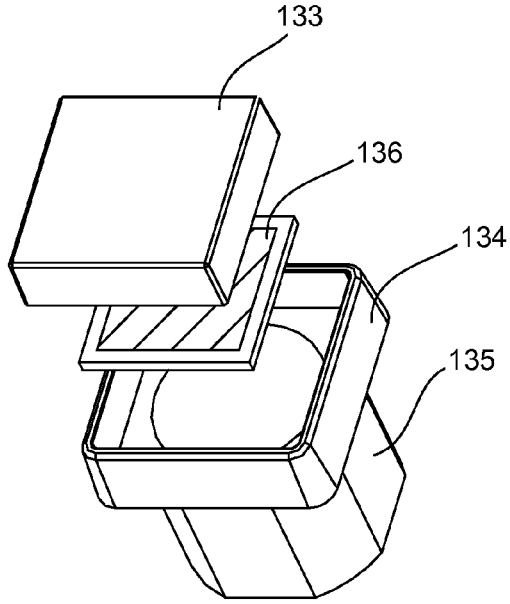

In another embodiment, button assembly 1602 includes more than one light emitting element 1618 to form a light emitting device. For example, light emitting element 1618 is an element of small display screen 136 (FIG. 5D). In yet another embodiment that includes more than one light emitting element 1618, a display driver 1616 including a plurality of driver circuits, such as transistors, is used instead of display driver 1616 and the number of driver circuits match the number of light emitting elements.

In another embodiment, LEC 1606 includes at least one storage device, such as more or less than two storage devices 1612 and 1614. In yet another embodiment, LEC memory 1610 includes a RAM and a read-only memory (ROM). In still another embodiment, display driver 1616 is located outside LEC 1606. In yet another embodiment, logic device 1604 converts data from a serial format to a parallel format.

In another embodiment, upon receiving 1404 (FIG. 14) power low signal 1226 from power detector 1204 during the time period, logic device 1604 sends a command to LEC 1606 to change the voltage amount within storage device 1612 to zero without sending a command to change the refresh rate within storage device 1614 to zero. LEC 1606 receives the command from logic device 1604 during the time period and changes the voltage amount within storage device 1612 to zero.

Figure 18:
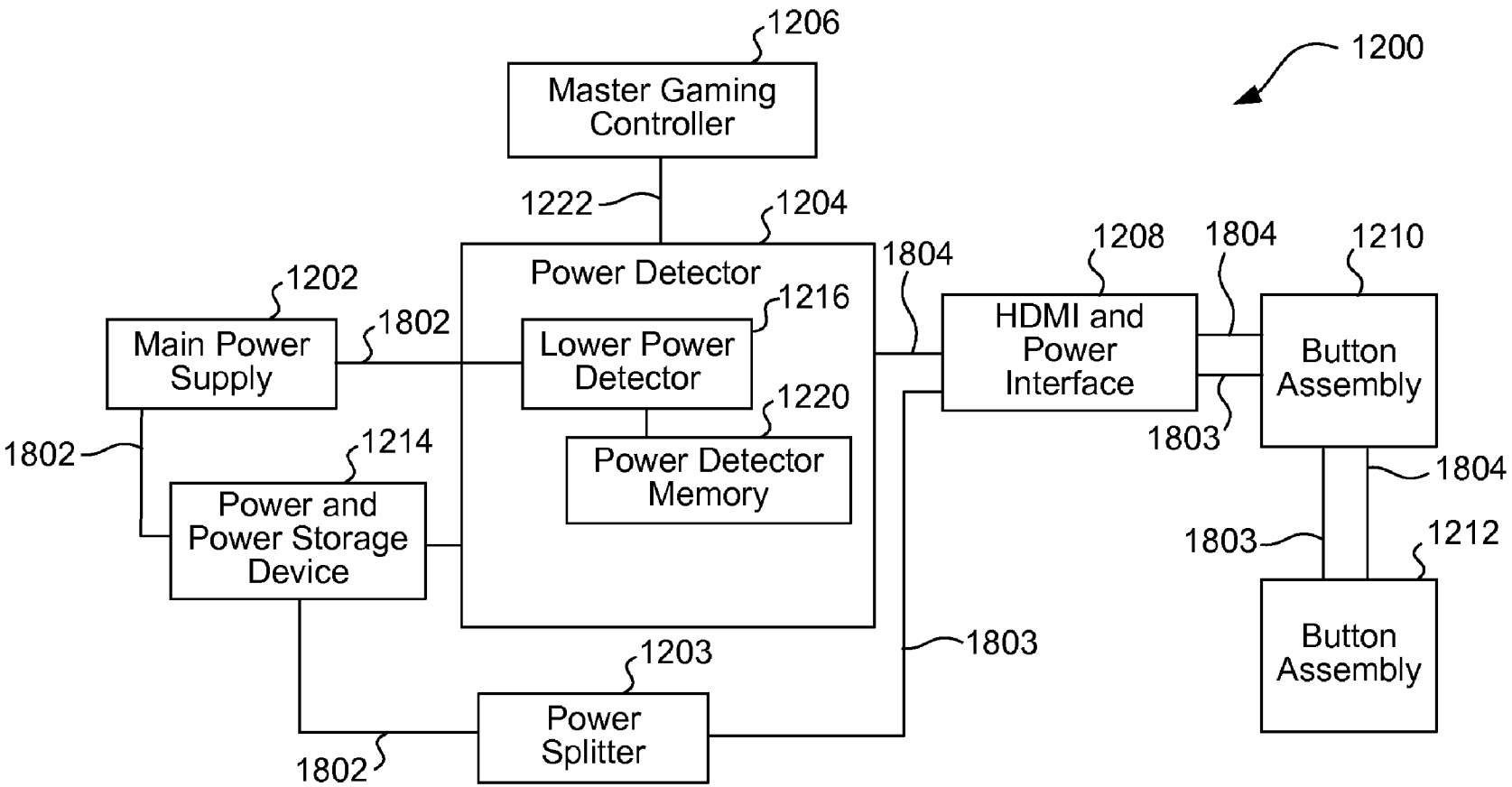
FIG. 18 is a block diagram of an embodiment of the system of FIG. 12.
Figure 19:
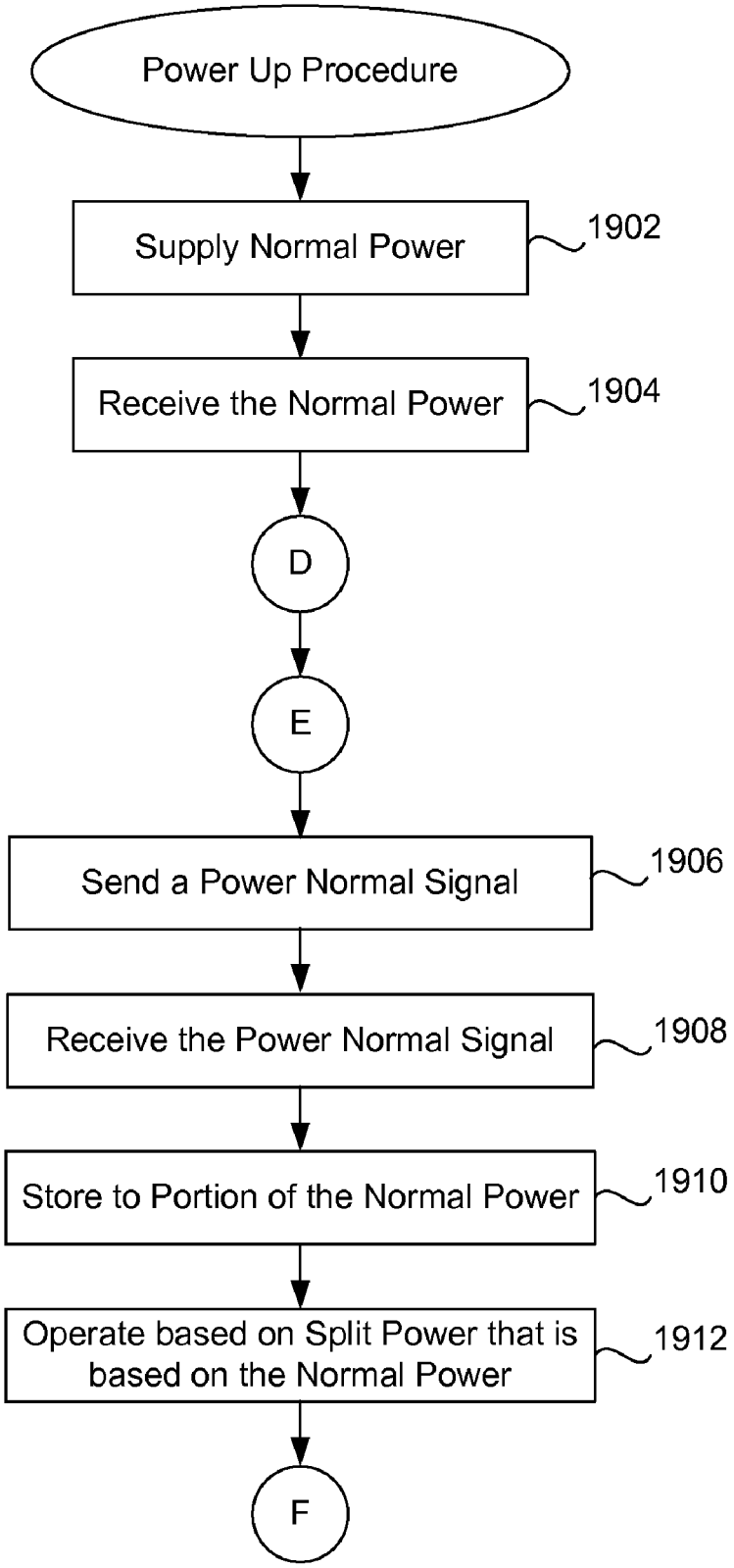
FIG. 19 is a flowchart illustrating an embodiment of a power up procedure for increasing a life of a light emitting element executed by using the system of FIG. 18.

FIG. 18 is a block diagram of an embodiment of system 1200 (FIG. 12) for increasing life of a light emitting element and FIG. 19 is a flowchart illustrating an embodiment of a method for increasing life of the light emitting element. FIG. 19 is used to describe an embodiment of a power up procedure. Main power supply 1202 supplies 1902 power 1802 that is not less than the threshold value to low power detector 1216 after a condition of the power failure or other malfunction ceases to exist. For example, the condition ceases to exist after a fault in main power supply 1202 is repaired. As an example, power 1802 may be 25, 26, or 27 V. Low power detector 1216 receives 1904 power 1802 from main power supply 1202 and determines 1306 (FIG. 13) whether the power 1802 is not less than the threshold value. Upon determining that power 1802 is greater than or equal to the threshold value, low power detector 1216 generates and sends 1906 a power normal signal 1804 indicating that power 1802 is greater than or equal to the threshold value to button assemblies 1210 and 1212 via HDMI and power interface 1208. The power normal signal 1804 is an inverse of power low signal 1226 and is sent via circuit line 21*c* (FIG. 6B), which is the dedicated line.

Button assembly 1210 receives 1908 power normal signal 1804 and extends life of a light emitting element 1618 within button assembly 1210 by executing a method for extending life of a light emitting element 1618. Similarly, button assembly 1212 receives 1908 power normal signal 1804 and extends life of light emitting element 1618 within button assembly 1212 by executing a method for extending life of a light emitting element 1618.

Power and power storage device 1214 stores 1910 a portion of power 1802, which is not used by button assemblies 1210 and 1212, to generate stored power 1228. Power splitter 1203 receives power 1802 from main power supply 1202 and splits power 1802 to generate split power 1803. An example of split power 1803 includes power having a voltage of 13.X V. Another example of split power 1803 includes a power having a voltage of 14.X V. As yet another example, power splitter 1203 splits power 1802 into D volts, E volts, and F volts. Power splitter 1203 supplies split power 1803 to button assemblies 1210 and 1212 (FIG. 12). For example, power splitter 1203 supplies split power 1803 having 14.3 V to button assembly 1210. As another example, power splitter 1203 supplies split power 1803 having 14.3 V to button assembly 1210. Button assemblies 1210 and 1212 receive split power 1803 and operate 1912 based on the split power 1803.

In another embodiment, low power detector 1218 stores power normal information, such as a time, a date, and an amount of power 1802, at a time at which power 1802 is greater than or equal to the threshold value. In yet another embodiment, HDMI and power interface 1208 receives power normal signal 1804 and may convert power normal signal 1804 into a differential power normal signal. In another embodiment, the power normal signal 1804 is sent via a different dedicated line than the dedicated line used to send power low signal 1226. In yet another embodiment, the power up procedure of FIG. 19 follows process 1708 of FIG. 17.

Figure 20:
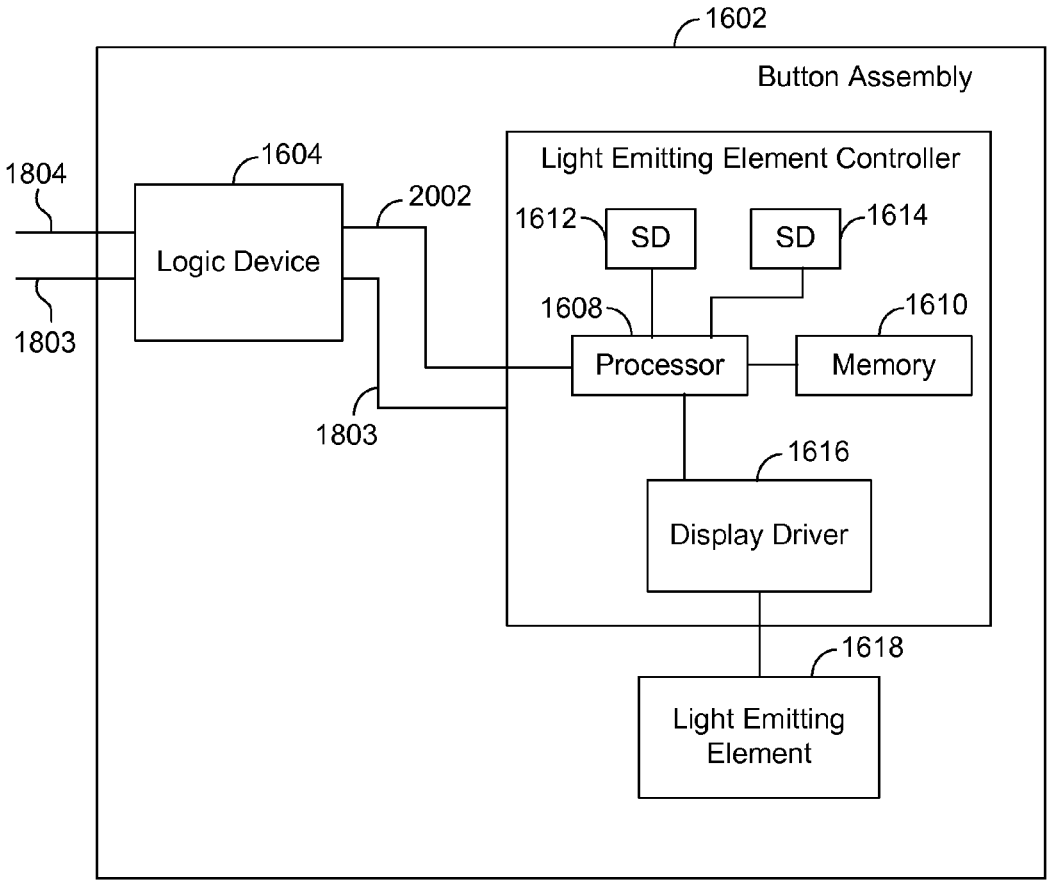
FIG. 20 is a block diagram of an embodiment of the button assembly of FIG. 16.
Figure 21:
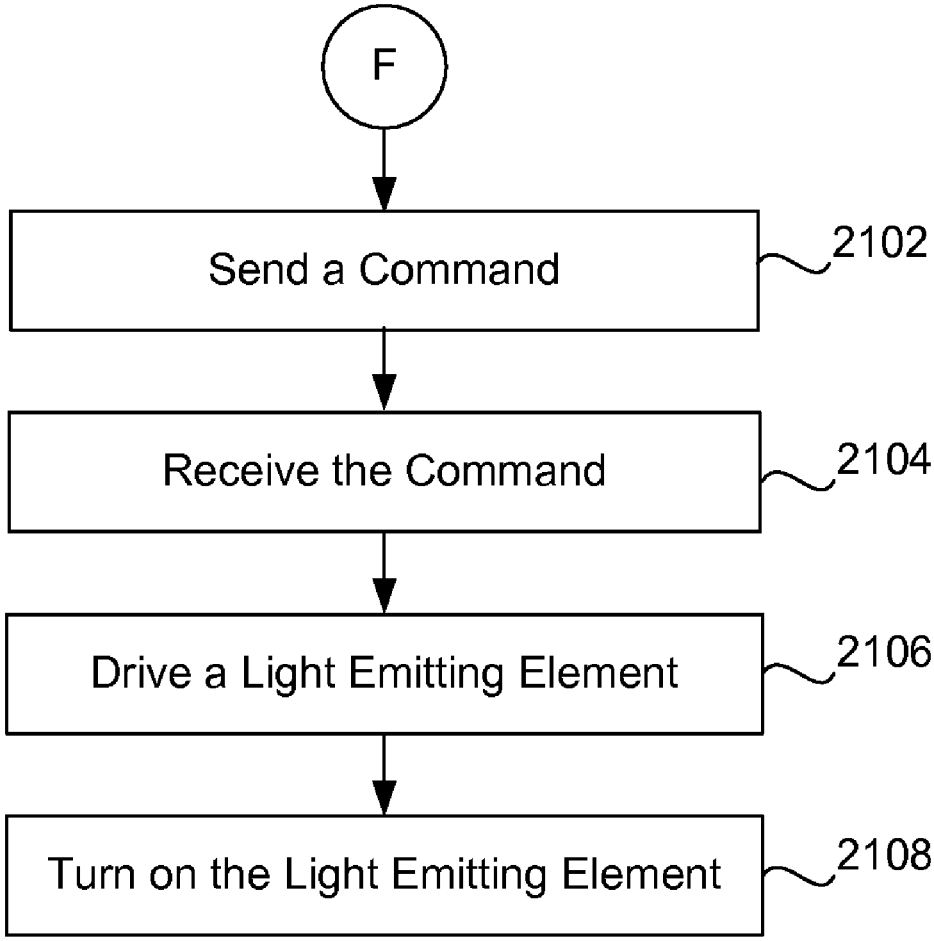
FIG. 21 is a flowchart of an embodiment of a method for increasing life of a light emitting element executed by using the button assembly of FIG. 20.

FIG. 20 is a block diagram of an embodiment of button assembly 1602 (FIG. 16) for increasing life of a light emitting element and FIG. 21 is a flowchart of an embodiment of a method for increasing life of the light emitting element. Logic device 1604 receives 1904 (FIG. 19) power 1802 from main power supply 1202 and supplies the power 1802 to light emitting element 1618 via LEC 1606. Light emitting element 1618 operates upon receiving power 1802 from main power supply 1202.

Upon receiving 1908 (FIG. 19) power normal signal 1804 from power detector 1204, logic device 1604 sends 2102 a command 2002 to LEC processor 1608 to change the voltage amount within storage device 1612 from zero to a specific voltage amount representing data stored within LEC memory 1610 and changes the refresh rate within storage device 1614 from zero to a specific refresh rate representing data stored within LEC memory 1610. LEC processor 1608 receives 2104 the command 2002 from logic device 1604 and changes the voltage amount within storage device 1612 from zero to the specific voltage amount representing data stored within LEC memory 1610 and the refresh rate from zero to the specific refresh rate representing data stored within LEC memory 1610.

LEC processor 1608 provides a voltage to display driver 1616 based on the specific voltage amount at the specific refresh rate, and display driver 1616 drives light emitting element 1618 by applying a current based on the specific voltage amount at the specific refresh rate. When display driver 1616 drives a light emitting device including light emitting element 1618, the light emitting device may display an advertisement or one of the primary gaming machine functions, such as hold, draw, a denomination, hit, stand, spin, of a game of chance or a game of skill. The function or advertisement may be in the form of an image, an animation, or a video. When display driver 1616 drives light emitting element 1618, a current is applied to a cathode and an anode of light emitting element 1618. If light emitting element 1618 is an OLED or an LED, positive and negative charges are injected by the current applied by display driver 1616 are recombined in an emissive layer to generate photons. If light emitting element 1618 is an element of a liquid crystal display device, light passes through a crystal of light emitting element 1618 when no current drives the light emitting element 1618 and the light does not pass through a crystal of light emitting element 1618 when a current supplied by display driver 1616 drives the light emitting element 1618. After the time period, since main power supply 1202 supplies power 1802 greater than or equal to the threshold value, the power requirements for operation of light emitting element 1618 are met and light emitting element 1618 turns on at 2108.

In the other embodiment, described above, in which logic device 1604 does not send a command to change the refresh rate within storage device 1614 to zero, upon receiving 1908 (FIG. 19) power normal signal 1804 from power detector 1204, logic device 1604 sends a command to LEC processor 1608 to change the voltage amount within storage device 1612 from zero to the specific voltage amount representing data stored within LEC memory 1610 and does not send a command to change the refresh rate within storage device 1614 from zero to the specific refresh rate. LEC processor 1608 receives the command from logic device 1604 and changes the voltage amount within storage device 1612 from zero to the specific voltage amount.

In another embodiment, the power down procedure (FIG. 13) follows process 2108 of FIG. 21. In yet another embodiment, if light emitting element 1618 is an element of a liquid crystal display device, light does not pass through a crystal of light emitting element 1618 when no current drives the light emitting element 1618 and the light passes through a crystal of light emitting element 1618 when a current supplied by display driver 1616 drives the light emitting element 1618.

Figure 22:
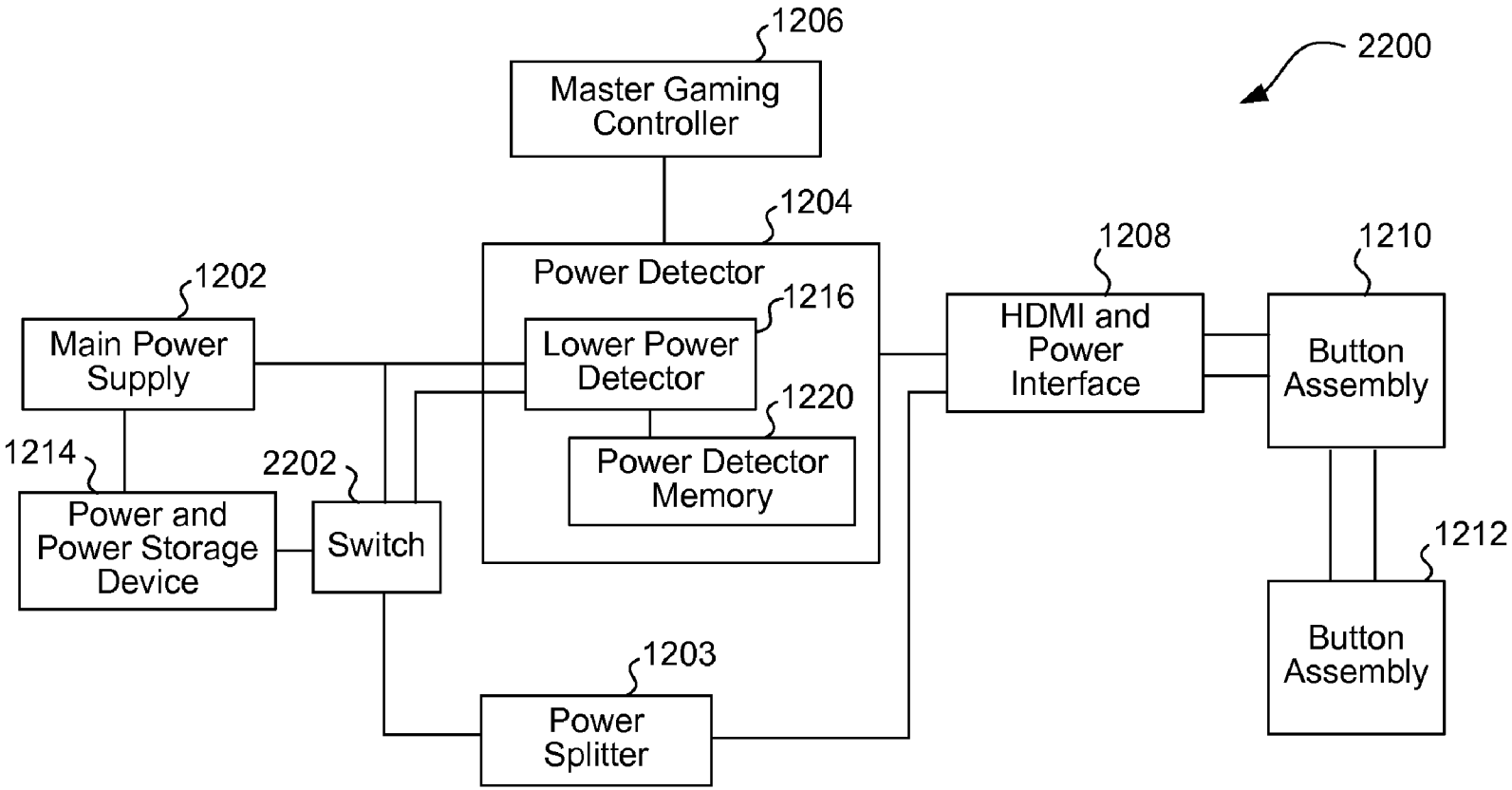
FIG. 22 is a block diagram of another embodiment of a system for increasing life of a light emitting element.

FIG. 22 is a block diagram of another embodiment of a system 2200 for increasing life of a light emitting element. System 2200 is similar to system 1200 (FIG. 12) except that system 2200 includes a switch 2202 connected between button assembly 1210 and power and power storage device 1214, and between button assembly 1210 and main power supply 1202. An example of switch 2202 includes a single pole, double throw switch that switches between connecting main power supply 1202 to button assembly 1210 and power and power storage device 1214 to button assembly 1210. Power and power storage device 1214 is charged by main power supply 1202 when button assemblies 1210 and 1212 are not using all of power 1802 supplied by main power supply 1202.

Upon determining that power 1224 (FIG. 12) supplied by main power supply 1202 is less than the threshold value, low power detector 1218 controls switch 2202 to connect switch 2202 to power and power storage device 1214 and power and power storage device 1214 supplies stored power 1228 to power splitter 1203 during the time period. Power splitter 1203 receives stored power 1228 to generate split power 1229 and supplies power 1229 to button assemblies 1210 and 1212 during the time period. On the other hand, upon determining that power 1802 supplied by main power supply 1202 is not less than the threshold value, low power detector 1218 controls switch 2202 to connect main power supply 1202 to power splitter 1203. Power splitter 1203 receives power 1802 from main power supply 1202 to generate split power 1803 and supplies power 1803 to button assemblies 1210 and 1212. The remaining functions of system 2200 are similar to those performed by system 1200 (FIGS. 12 and 16).

In another embodiment, power and power storage device 1214 is charged by an auxiliary power supply, which supplies the same amount of power as main power supply 1202. In yet another embodiment, power and power storage device 1214 is replaced by the auxiliary power supply.

Figure 23:
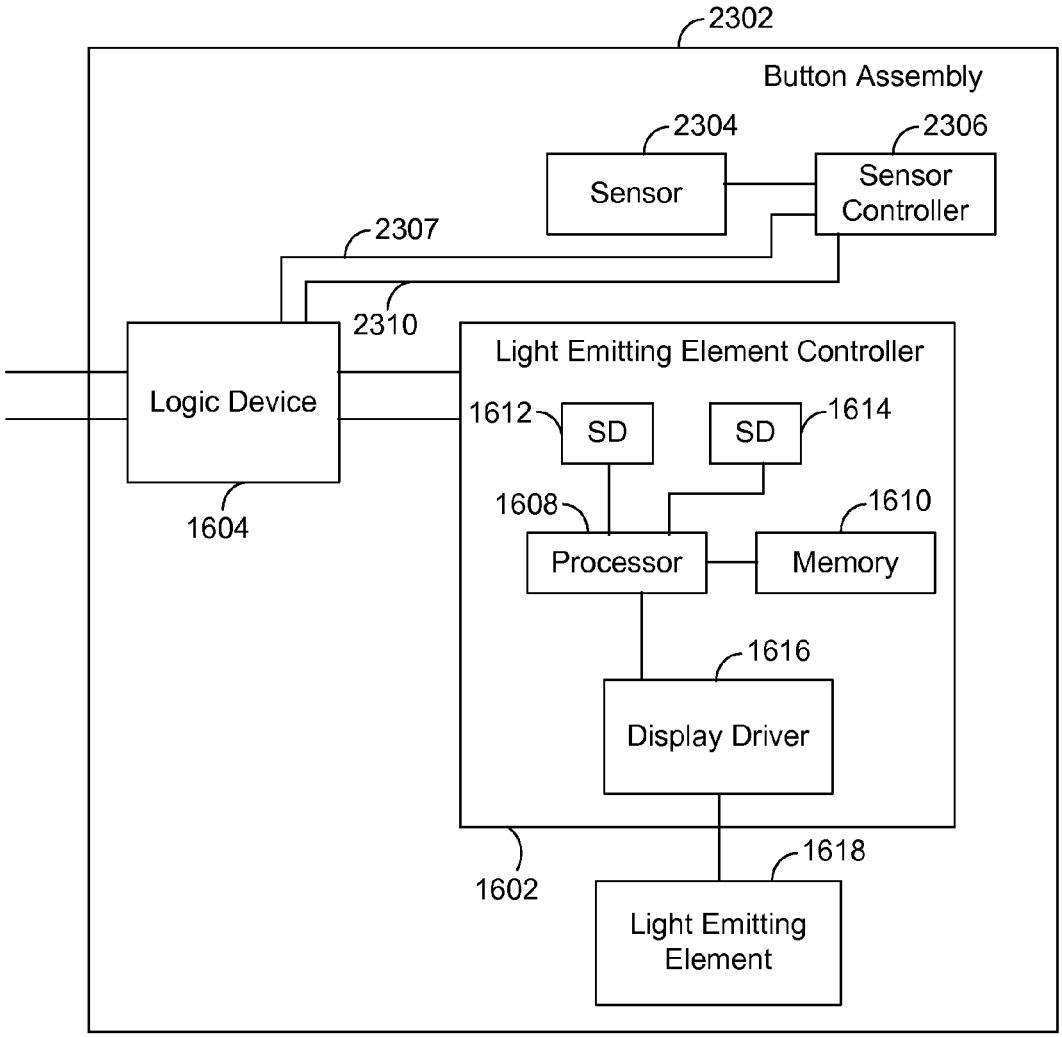
FIG. 23 is a block diagram of another embodiment of a button assembly for increasing life of a light emitting element within the assembly.
Figure 24:
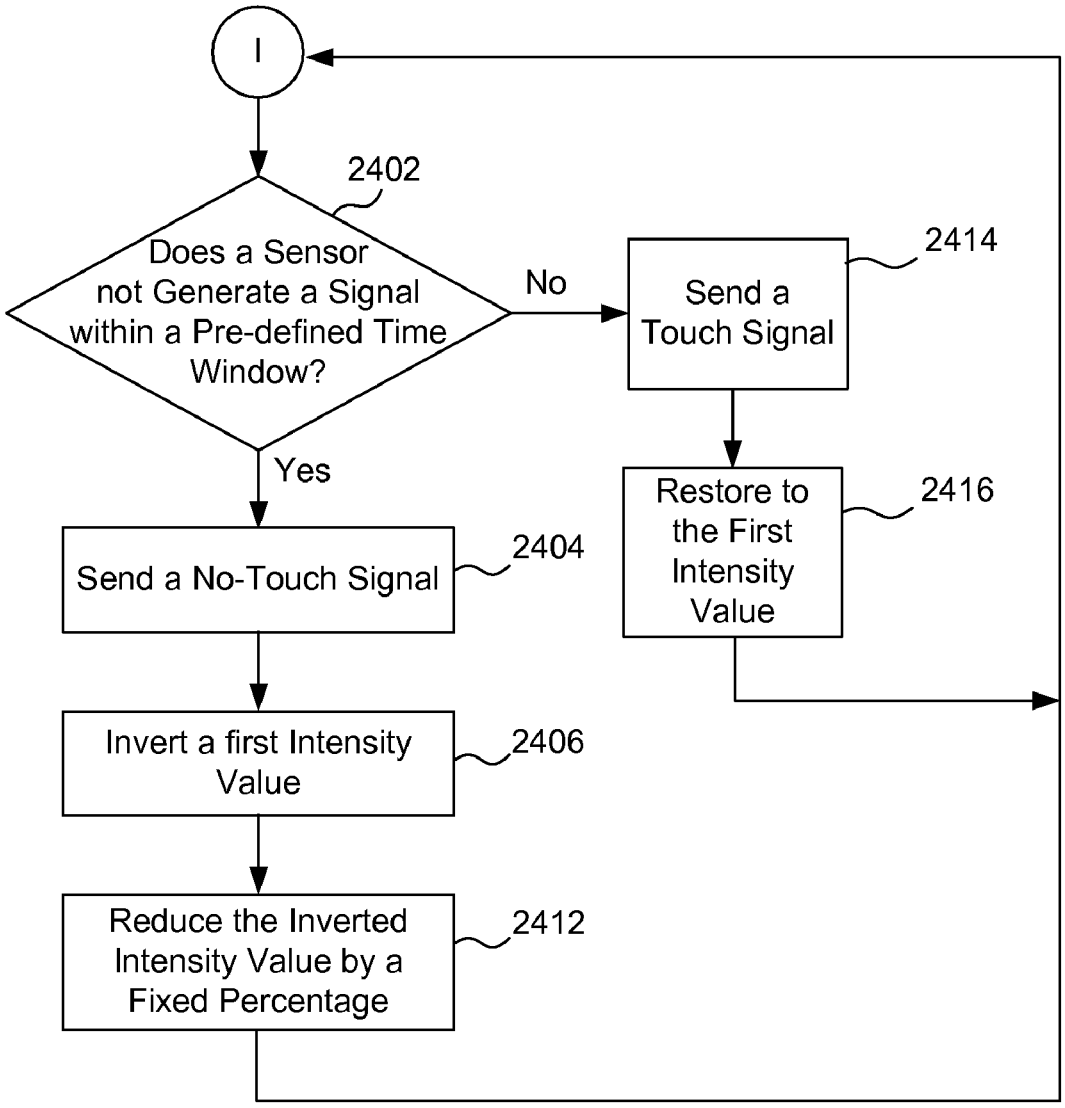
FIG. 24 is a flowchart of an embodiment of a method for increasing life of a light emitting element executed by using the system of FIG. 23.

FIG. 23 is a block diagram of an embodiment of a button assembly 2302 used to increase life of a light emitting element and FIG. 24 is a flowchart of an embodiment of a method for increasing the life. Button assembly 2302 includes all electrical components of button assembly 1602 (FIG. 16) and further includes a sensor 2304 and a sensor controller 2306. An example of sensor 2304 includes a touch sensor, such as a capacitor or a resistor. Another example of sensor 2304 includes an actuator of a switch of a switch assembly. The actuator, the switch, and switch assembly are described below. Sensor 2304 may be attached to top of a screen of the light emitting device or under the screen. Sensor 2304 may be overlaid on a substrate on which light emitting element 1618 is formed. Sensor 2304 does not generate a sensor output signal, which is an electrical signal, if the sensor 2304 is not touched within a pre-defined time window. The user may touch sensor 2304 directly or indirectly via a substrate. The pre-defined time window is provided by the administrator via an input device, such as a keyboard or a mouse, to dynamic button panel controller 180 that further sends the pre-defined time window to sensor controller 2306 and/or MGC 190.

Sensor controller 2306 determines 2402 whether sensor 2304 does not generate the sensor output signal within the pre-defined time window. Upon determining that sensor 2304 does not generate the sensor output signal within the pre-defined time window, sensor controller 2306 sends 2404 a no-touch signal 2307 to logic device 1604, which in turn may send the no-touch signal to dedicated dynamic button panel controller 180.

Upon receiving no-touch signal 2307, logic device 1604 inverts 2406 a first intensity value of light emitted by light emitting element 1618 to generate an inverted intensity value. For example, if an intensity value of intensity of light emitting element 1618 is 100%, logic device 1604 changes the intensity value to 0. As another example, if an intensity value of intensity of light emitting element 1618 is 20%, logic device 1604 changes the intensity value to 80%. As yet another example, if an intensity value of intensity of light emitting element 1618 is 80%, logic device 1604 changes the intensity value to 20%. As still another example, if an intensity value of intensity of light emitting element 1618 is 0, logic device 1604 changes the intensity value to 100%. As another example, if an intensity value of intensity of light emitting element 1618 is Q %, logic device 1604 changes the intensity value to (S−Q) %, where S and Q are real numbers greater than zero, S is greater than Q, S is a maximum intensity value, and (S−Q) % is the inverted intensity value. An example of S is 100.

Logic device 1604 inverts 2406 the first intensity value by instructing LEC processor 1608 to change a first voltage amount stored within storage device 1612. For example, if the first voltage amount that generates the first intensity value is equal to R % of a maximum voltage amount used to represent the data stored within LEC memory 1610 at the maximum intensity value, logic device 1604 instructs LEC processor 1608 to change the first voltage amount to (S−R) % to generate an inverted first voltage amount, where S is greater than R and R is a real number greater than zero. The maximum voltage amount may be a voltage when power 1802 (FIG. 18) is used at a maximum level by light emitting element 1618. LEC processor 1608 sends the inverted first voltage amount to display driver 1616. Display driver 1616 drives light emitting element 1618 with a current based on the inverted first voltage amount and light emitting element 1618 emits light having the inverted intensity value.

Logic device 1604 reduces 2412 the inverted intensity value by a fixed percentage, such as ranging from and including 40% to 60%, by instructing LEC processor 1608 to reduce the inverted intensity value by the fixed percentage. An example of the fixed percentage includes 50%. Logic device 1604 reduces 2412 the inverted intensity value by the fixed percentage to generate a reduced intensity value. Upon receiving the instruction to reduce the inverted intensity value by the fixed percentage, LEC processor 1608 reduces the inverted first voltage amount to satisfy a linear relation. For example, the linear relation is represented by $Y=aT+b$, where a and b are real numbers and T and Y are variables, T represents the inverted intensity value, and Y represents the inverted first voltage amount. In this example, upon determining that T is reduced by 20%, LEC processor 1608 reduces Y to keep a and b constant and to generate a reduced first voltage amount that is store within storage device 1612. Display driver 1616 drives light emitting element 1618 with a current based on the reduced first voltage amount and light emitting element 1618 emits light having the reduced intensity value.

If sensor 2304 is touched after not being touched within the pre-defined time window, sensor 2304 sends 2414 the sensor output signal to sensor controller 2306. Upon receiving the sensor output signal, sensor controller 2306 generates a touch signal 2310 and sends the touch signal 2310 to logic device 1604, which may send the touch signal 2310 to dedicated dynamic button panel controller 180. Upon receiving touch signal 2310, logic device 1604 restores 2416 the first intensity value by instructing LEC processor 1608 to restore 2416 the first intensity value. Upon receiving the instruction to restore the first intensity value, LEC processor 1608 changes the reduced first voltage amount to the first voltage amount within storage device 1612 and provides the first voltage amount to display driver 1616. Display driver 1616 drives light emitting element 1618 by applying a current based on the first voltage amount and light emitting element 1618 emits light having the first intensity value.

If the method illustrated in FIG. 24 is executed for a first time and the sensor output signal is received by sensor controller 2306, instead of restoring at 2416, logic device 1604 maintains the first intensity value by instructing LEC processor 1608 to maintain the first intensity value. Upon receiving the instruction to maintain the first intensity value, LEC processor 1608 maintains the first voltage amount within storage device 1612. Upon maintaining the first intensity value, the method returns to process 2402.

In another embodiment, functions performed by sensor controller 2306 can be instead performed by LEC processor 1608, logic device 1604, or dedicated dynamic button panel controller 180, or by a combination of at least two of logic device 1604, LEC processor 1608, sensor controller 2306, and dedicated dynamic button panel controller 180. In another embodiment, functions performed by logic device 1604 can be performed by MGC 190, dedicated dynamic button panel controller 180, LEC processor 1608, or by a combination of at least two of dedicated dynamic button panel controller 180, MGC 190, logic device 1604, and LEC processor 1608. In still another embodiment, the pre-defined time window is provided by the administrator via an input device, such as a keyboard or a mouse, directly to sensor controller 2306. In yet another embodiment, the pre-defined time window is provided by the administrator via an input device, such as a keyboard or a mouse, directly to MGC 190.

In yet another embodiment, MGC 190 determines that a game state of a game of chance or a game of skill has not changed to another game state within the pre-defined time window and sends a signal to indicate the determination to logic device 1604. In this embodiment, upon receiving the signal indicating the determination of the lack of the change of the game of state from MGC 190, logic device 1604 inverts 2406 the first intensity value and further reduces 2412 the inverted intensity value. For example, logic device 1604 inverts 2406 the first intensity value by changing the first voltage amount stored within storage device 1612. As another example, logic device 1604 reduces 2412 the inverted intensity value by the fixed percentage by reducing the inverted first voltage amount and generating the reduced first voltage amount. In this embodiment, MGC 190 determines that a game state of a game of chance or a game of skill has changed to another game state and sends a signal, such as an animation or a specific command, to indicate the determination to logic device 1604. Upon receiving the signal indicating the change of the game of state, logic device 1604 restores 2416 the first intensity value. For example, logic device 1604 restores 2416 the first intensity value by changing the reduced first voltage amount to the first voltage amount within storage device 1612.

In another embodiment, dedicated dynamic button panel controller 180 determines that a game state of a game of chance or a game of skill has not changed to another game state within the pre-defined time window. In this embodiment, dedicated dynamic button panel controller 180 may have lost connection with MGC 190. Further, in this embodiment, dedicated dynamic button panel controller 180 determines that a game state of a game of chance or a game of skill has changed to another game state.

In yet another embodiment, logic device 1604 performs 2406, 2412, 2414, and 2416 without instructing LEC processor 1608. For example, logic device 1604 inverts 2406 the first intensity value by changing the first voltage amount stored within storage device 1612. As another example, logic device 1604 reduces 2412 the inverted intensity value by the fixed percentage by reducing the inverted first voltage amount and generating the reduced first voltage amount. As still another example, logic device 1604 restores 2416 the first intensity value by changing the reduced first voltage amount to the first voltage amount.

In still another embodiment, MGC 190 determines that a game state of a game of chance or a game of skill has not changed to another game state within the pre-defined time window and sends a signal to indicate the determination to dynamic button panel controller 180. In this embodiment, upon receiving the signal indicating the determination of the lack of change from MGC 190, dedicated dynamic button panel controller 180 inverts 2406 and further performs 2412. For example, dedicated dynamic button panel controller 180 inverts 2406 the first intensity value by changing the first voltage amount stored within a storage device. As another example, dedicated dynamic button panel controller 180 reduces 2412 the inverted intensity value by the fixed percentage by reducing the inverted first voltage amount and generating the reduced first voltage amount within a storage device. In this embodiment, MGC 190 determines that a game state of a game of chance or a game of skill has changed to another game state and sends a signal, such as an animation or another command, to indicate the determination to dedicated dynamic button panel controller 180. Upon receiving the signal indicating the change of the game of state, dedicated dynamic button panel controller 180 restores 2416 the first intensity value. For example, dedicated dynamic button panel controller 180 restores 2416 the first intensity value by changing the reduced first voltage amount to the first voltage amount within a storage device. Further, in this embodiment, if the method illustrated in FIG. 24 is executed for a first time and the determination regarding the lack of change of game state is received within the pre-defined time window, instead of restoring at 2416, dedicated dynamic button panel controller 180 maintains the first intensity value by maintaining the first voltage amount within a storage device. Further in this embodiment, upon maintaining the first intensity value, the method returns to process 2402. In another alternative embodiment, logic device 1604 and/or LEC 1602 are located outside button assembly 2302.

It is noted that the functions illustrated in FIGS. 13, 14, 15, 17, 19, 21, and 24 may be performed sequentially, in parallel, or in an order other than that which is described. It should be appreciated that not all of the functions described are required to be performed, that additional functions may be added, and that some of the illustrated functions may be substituted with other functions.

Figure 25:
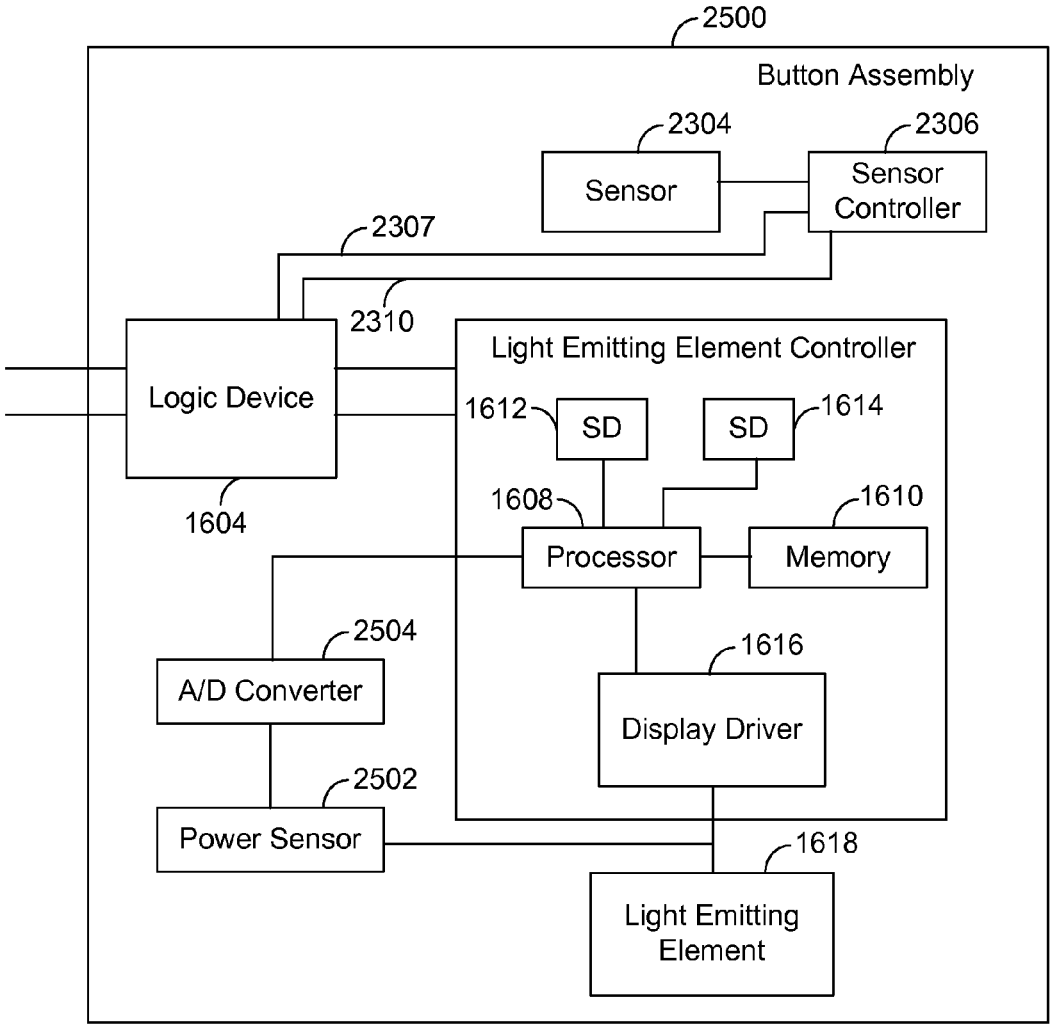
FIG. 25 is a block diagram of yet another embodiment of a button assembly for increasing life of a light emitting element within the assembly.

FIG. 25 is a block diagram of another embodiment of a button assembly 2500 for increasing life of a light emitting element. Button assembly 2500 includes all components of button assembly 2302 (FIG. 23). Button assembly 2500 further includes a power sensor 2502 and an analog-to-digital converter (A/D converter) 2504. Power sensor 2502 may be a voltage sensor that determines a voltage of a current used to drive light emitting element 1618. Power sensor 2502 determines a voltage of a current used to drive light emitting element 1618 to generate a first measured value of the voltage and sends the first measured value to A/D converter 2504. A/D converter 2504 converts the first measured value into a digital form and provides the first measured value in the digital form to LEC processor 1608. LEC processor 1608 receives the first measured value and stores the first measured value within LEC memory 1610.

In this embodiment of system 2500, processes 2402 and 2404 (FIG. 24) are performed. Upon receiving no-touch signal 2307, logic device 1604 performs process 2406 (FIG. 24) by using the first measured value instead of the first intensity value. For example, logic device 1604 inverts the first measured value of light emitted by light emitting element 1618 to generate an inverted measured value. For example, if a measured value of intensity of light emitting element 1618 is 100%, logic device 1604 changes the measured value to 0, which is the inverted measured value. As another example, if a measured value of intensity of light emitting element 1618 is 20%, logic device 1604 changes the measured value to 80%. As yet another example, if a measured value of intensity of light emitting element 1618 is 80%, logic device 1604 changes the measured value to 20%. As still another example, if a measured value of intensity of light emitting element 1618 is 0, logic device 1604 changes the measured value to 100%. As another example, if a measured value of intensity of light emitting element 1618 is M %, logic device 1604 changes the measured value to (S−M) %, where M is a real numbers greater than zero, S is greater than M, and (S−M) % is the inverted measured value.

Logic device 1604 inverts the first measured value by instructing LEC processor 1608 to invert the first measured value. Upon receiving the instruction to invert the first measured value, LEC processor 1608 changes a second voltage amount stored within storage device 1612. For example, if the second voltage amount that generates the first measured value is equal to P % of the maximum voltage amount, LEC processor 1608 changes the second voltage amount to (S−P) % to generate an inverted second voltage amount, where S is greater than P and P is a real number greater than zero. LEC processor 1608 sends the inverted second voltage amount to display driver 1616. Display driver 1616 drives light emitting element 1618 with a current based on the inverted second voltage amount and light emitting element 1618 emits light having the inverted measured value.

Moreover, in this embodiment, logic device 1604 performs 2412 (FIG. 24) by using the first measured value instead of the first intensity value. For example, logic device 1604 reduces the inverted measured value by the fixed percentage to generate a reduced measured value by instructing LEC processor 1608 to reduce the inverted measured value by the fixed percentage. Upon receiving the instruction to reduce the inverted measured value by the fixed percentage, LEC processor 1608 reduces the inverted second voltage amount to satisfy the linear relation to generate a reduced second voltage amount. Display driver 1616 drives light emitting element 1618 with a current based on the reduced second voltage amount and light emitting element 1618 emits light having the reduced measured value.

In this embodiment of system 2500, process 2414 is (FIG. 24) performed. Moreover, in this embodiment, logic device 1604 performs 2416 (FIG. 24) by using the first measured value instead of the first intensity value. For example, upon receiving touch signal 2310, logic device 1604 restores the first measured value by instructing LEC processor 1608 to restore the first measured value, LEC processor 1608 changes the reduced second voltage amount to the second voltage amount within storage device 1612 and provides the second voltage amount to display driver 1616. Display driver 1616 drives light emitting element 1618 by applying a current based on the second voltage amount and light emitting element 1618 emits light having the first measured value.

If the method illustrated by using the system of FIG. 25 is executed for a first time and the sensor output signal is received by sensor controller 2306, instead of restoring the first measured value, logic device 1604 maintains the first measured value by instructing LEC processor 1608 to maintain the first measured value. Upon receiving the instruction to maintain the first measured value, LEC processor 1608 maintains the second voltage amount within storage device 1612. In another embodiment, upon receiving the first measured value, LEC processor 1608 does not store the first measured value within LEC memory 1610.

An occurrence of an event may be a change of a game state or touching of a button by the user. For example, if the button is touched by the user, the event occurs and the if the button is not touched, the event does not occur. As another example, if the game state changes to another game state, the event occurs and if the game state does not change, the event does not occur.

In another embodiment, upon receiving the signal indicating the determination of the lack of the change of the game of state within the pre-defined time window from MGC 190, logic device 1604 inverts the first measured value by changing the second voltage amount stored within storage device 1612. As another example, logic device 1604 reduces the inverted measured value by the fixed percentage by reducing the inverted second voltage amount to generate the reduced second voltage amount. In this embodiment, MGC 190 determines that a game state of a game of chance or a game of skill has changed to another game state and sends a signal, such as an animation or a specific command, to indicate the determination to logic device 1604. Upon receiving the signal indicating the change of the game of state, logic device 1604 restores the first measured value. For example, logic device 1604 restores the first measured value by changing the reduced second voltage amount to the second voltage amount within storage device 1612.

In yet another embodiment, logic device 1604 performs 2406, 2412, 2414, and 2416 without instructing LEC processor 1608 and by using the first measured value instead of the first intensity value. For example, logic device 1604 inverts the first measured value by changing the second voltage amount stored within storage device 1612. As another example, logic device 1604 reduces the inverted measured value by the fixed percentage by reducing the inverted second voltage amount and generating the reduced second voltage amount. As still another example, logic device 1604 restores the second intensity value by changing the reduced second voltage amount to the second voltage amount.

In still another embodiment, upon receiving the signal indicating the determination of the lack of change within the pre-defined time window from MGC 190, dedicated dynamic button panel controller 180 inverts 2406 and further performs 2412 by using the first measured value instead of the first intensity value. For example, dedicated dynamic button panel controller 180 inverts the first measured value by changing the second voltage amount stored within a storage device. As another example, dedicated dynamic button panel controller 180 reduces the inverted measured value by the fixed percentage by reducing the inverted second voltage amount and generating the reduced second voltage amount within a storage device. In this embodiment, upon receiving the signal indicating the change of the game of state from MGC 190, dedicated dynamic button panel controller 180 restores the first measured value. For example, dedicated dynamic button panel controller 180 restores the first measured value by changing the reduced second voltage amount to the second voltage amount within a storage device. Further, in this embodiment, if the method illustrated in FIG. 24 is executed for a first time and the determination regarding the lack of change of game state is received within the pre-defined time window, instead of restoring the first measured value, dedicated dynamic button panel controller 180 maintains the second intensity value by maintaining the second voltage amount within a storage device. Further in this embodiment, upon maintaining the first measured value, the method returns to process 2402.

Figure 26A:
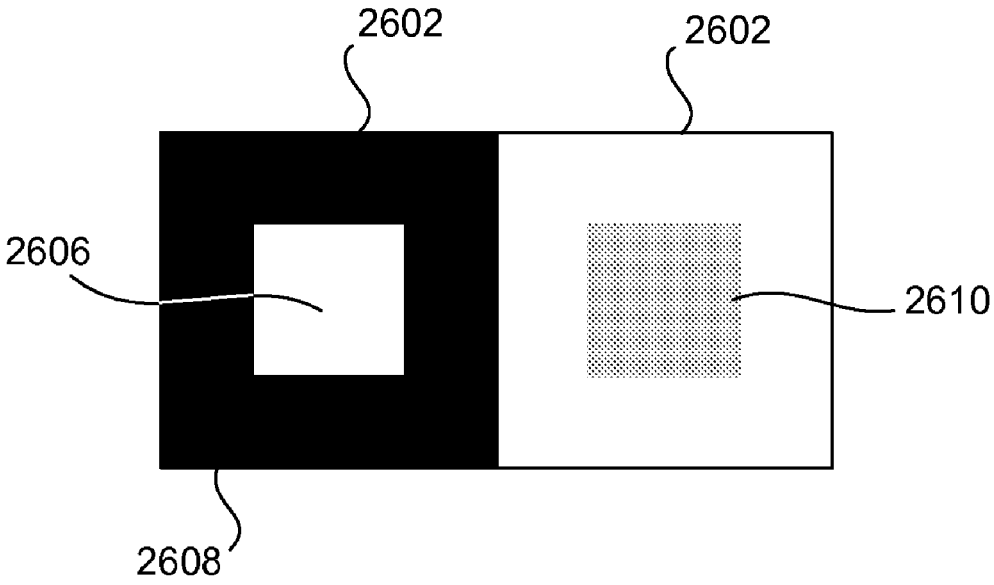
FIG. 26A is a diagram illustrating an embodiment of a plurality of pixels having various intensities.

FIG. 26A is a block diagram showing an embodiment of a plurality of intensities represented by a plurality of pixels 2602 and 2604, which are in a non-idle mode. Pixel 2602 has been used for a longer time than pixel 2604. The intensity of pixel 2602 starts reducing after being used for the longer time as evident by a white box 2606 within a black box 2608 of the pixel. Further, pixel 2602 generates a ghosting effect in pixel 2604 as evident by a gray box 2610 within pixel 2604.

Figure 26B:
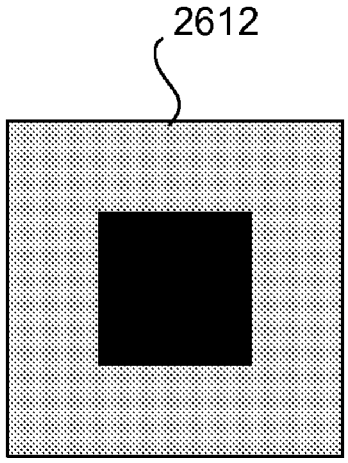
FIG. 26B is a diagram of an embodiment of a pixel having an intensity generated by using the methods illustrated using FIGS. 23-25.

FIG. 26B is a block diagram showing an embodiment of an intensity represented by a pixel 2612, which can be 2602 or pixel 2604 (FIG. 26A), in a screen saver mode, such as an idle mode, after applying the method illustrated by using FIGS. 23-25. Pixel 2612 may include light emitting element 1618.

A technical effect of the herein described systems and methods includes increasing life of a light emitting element within a pixel by dimming an intensity of the pixel and includes reducing the ghosting effect by inverting the intensity. The dimming is performed by reducing an intensity of light emitting element 1618. Further, a uniform image is displayed by a light emitting device including light emitting element 1618 by inverting an intensity of light emitting by light emitting element 1618.

Figure 27A:
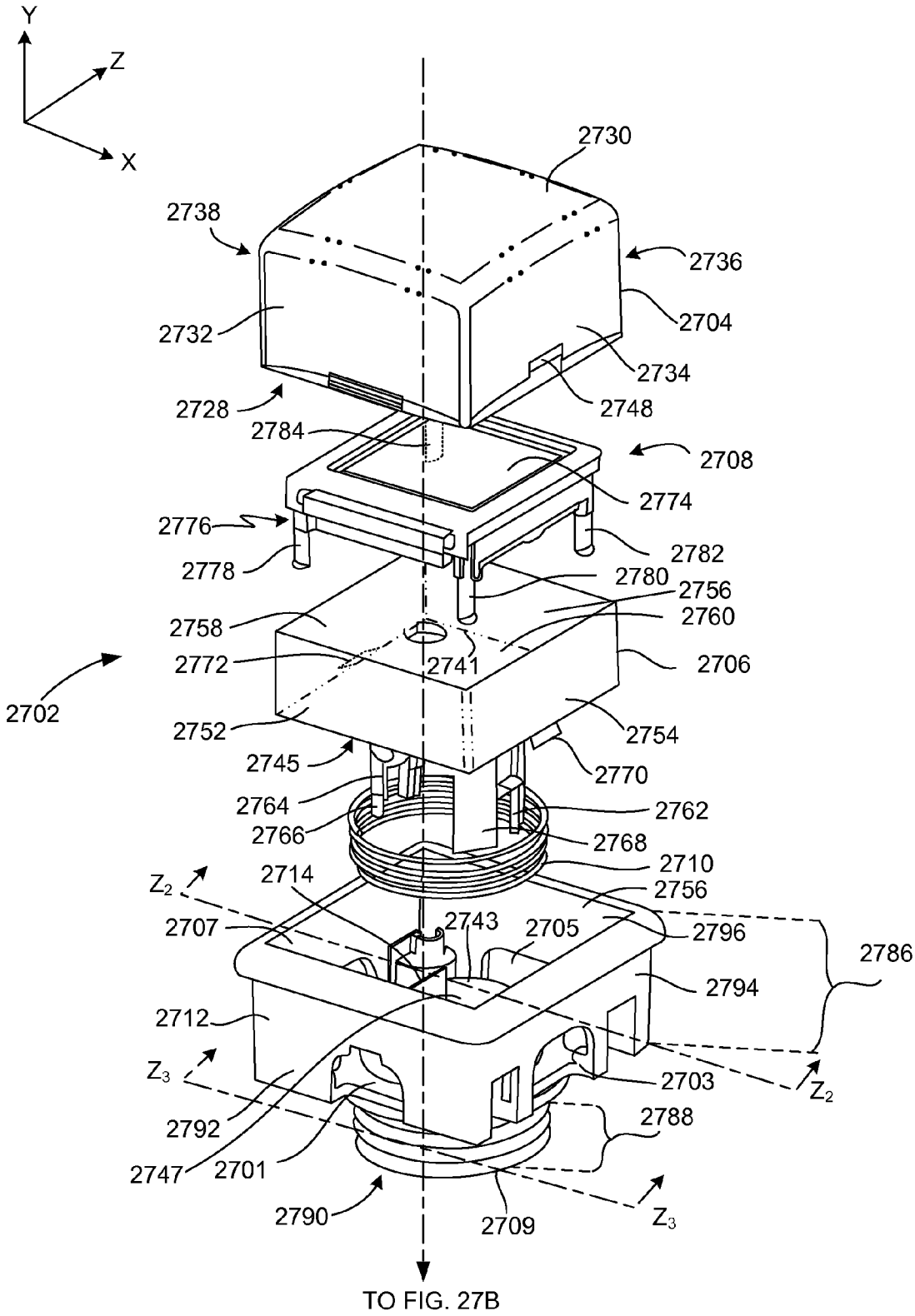
FIG. 27A is an isometric exploded view of an embodiment of a portion of a button assembly.
Figure 27B:
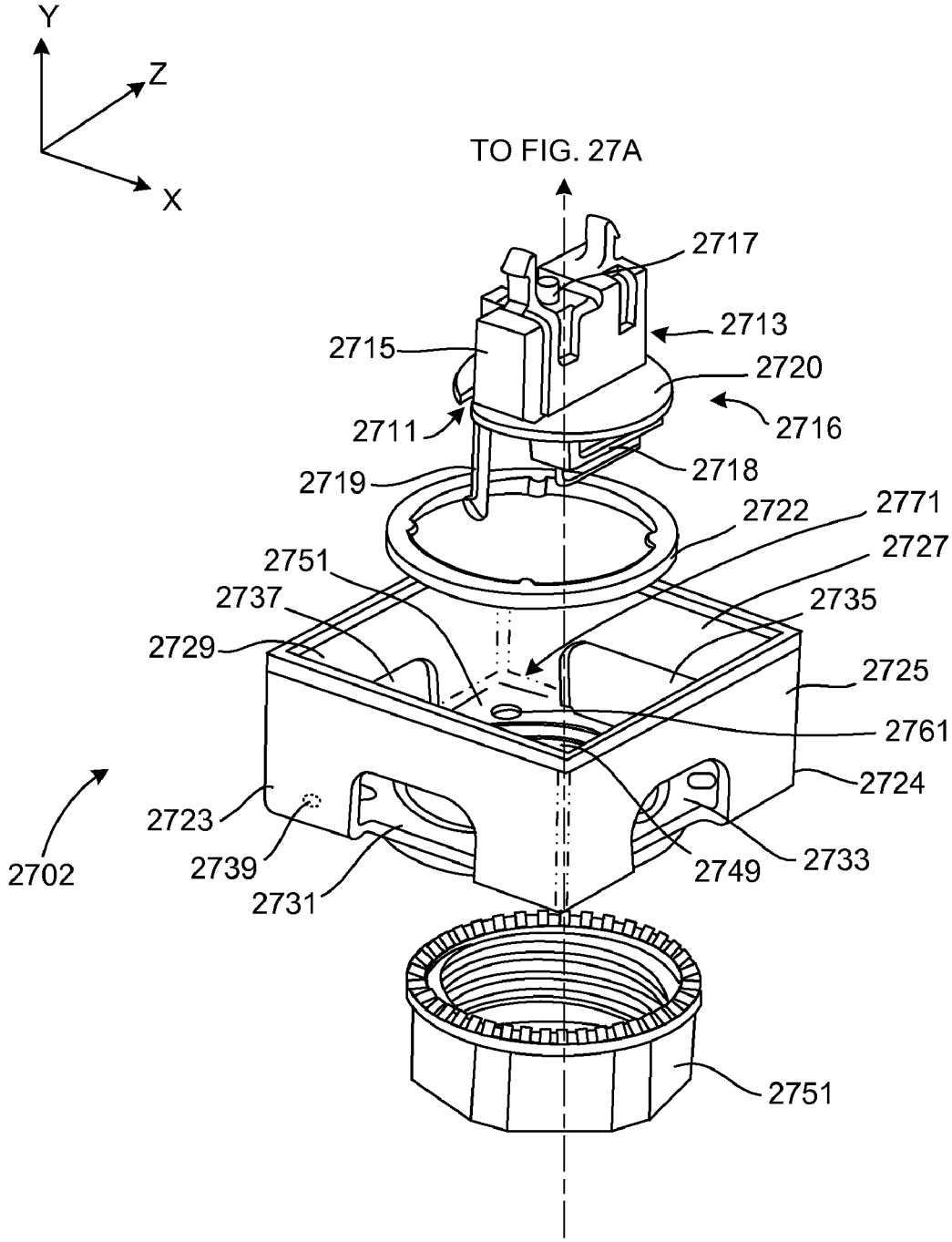
FIG. 27B is an isometric exploded view of an embodiment of the remaining portion of the button assembly of FIG. 27A.
Figure 28A:
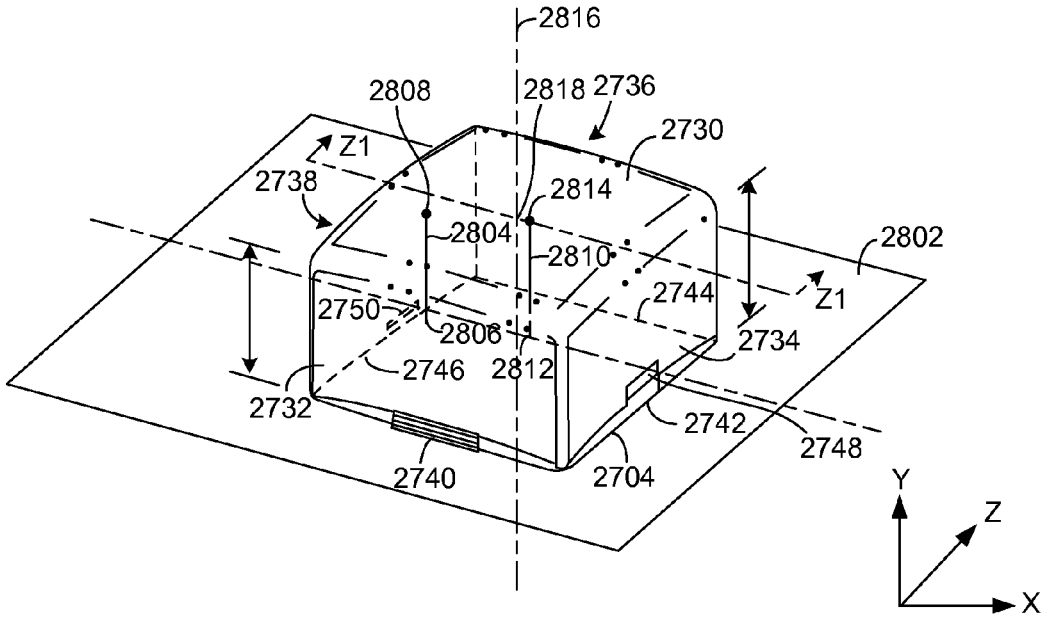
FIG. 28A is an isometric view of an embodiment of a lens cap of the button assembly of FIGS. 27A and 27B.
Figure 28B:
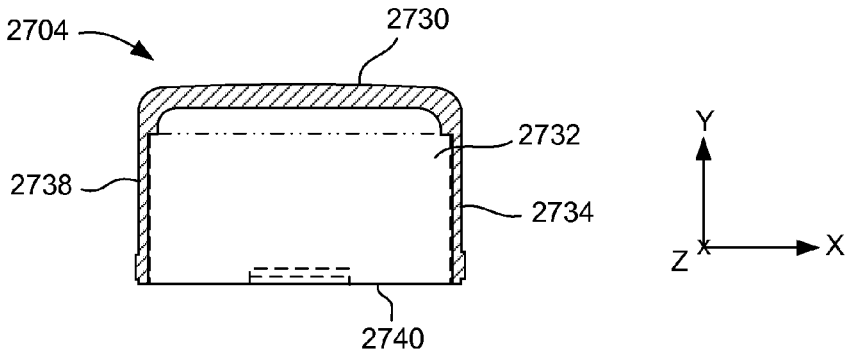
FIG. 28B is a front view of the lens cap of FIG. 28A.
Figure 29:
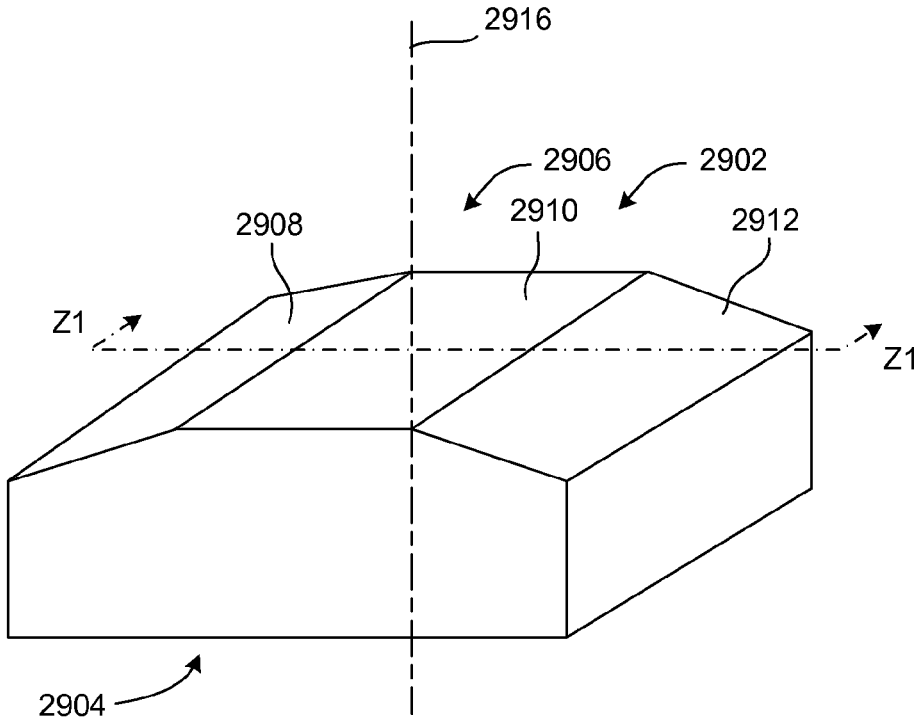
FIG. 29 is an isometric view of yet another embodiment of a lens cap that may be used in the button assembly of FIGS. 27A and 27B.
Figure 30:
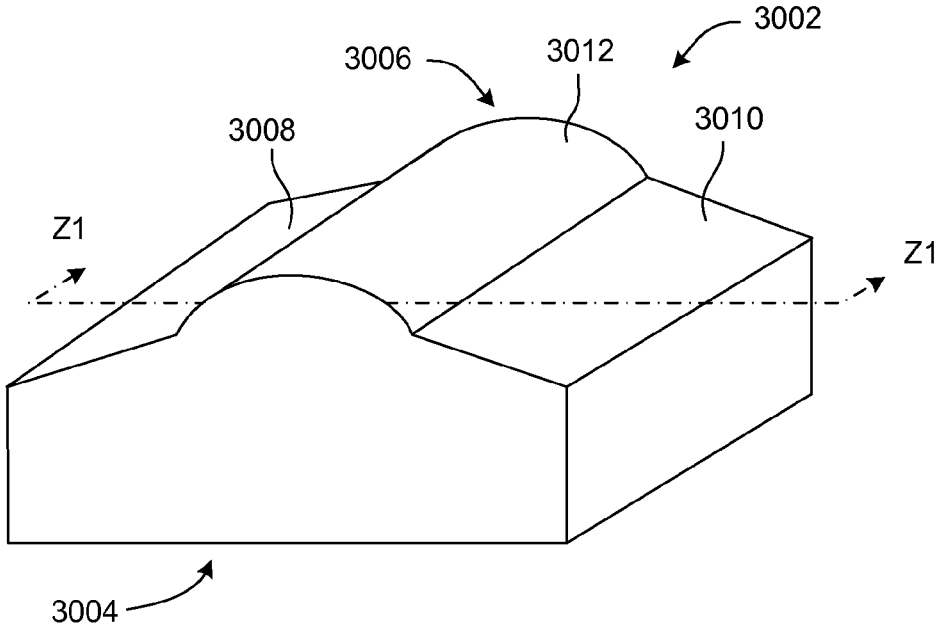
FIG. 30 is an isometric view of still another embodiment of a lens cap that may be used in the button assembly of FIGS. 27A and 27B.
Figure 31A:
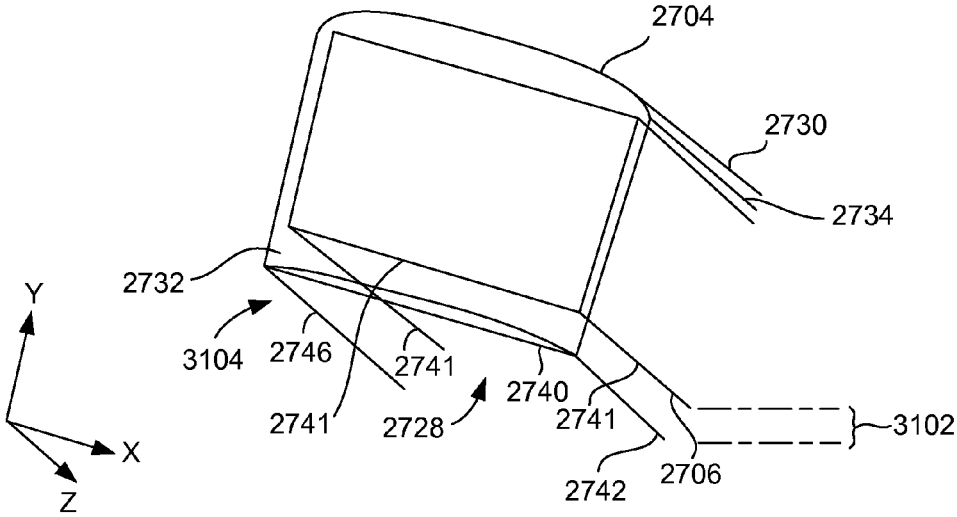
FIG. 31A is an isometric view of an embodiment of a portion of a lens cap of the button assembly of FIGS. 27A and 27B and a lens cap holder of the button assembly.
Figure 31B:
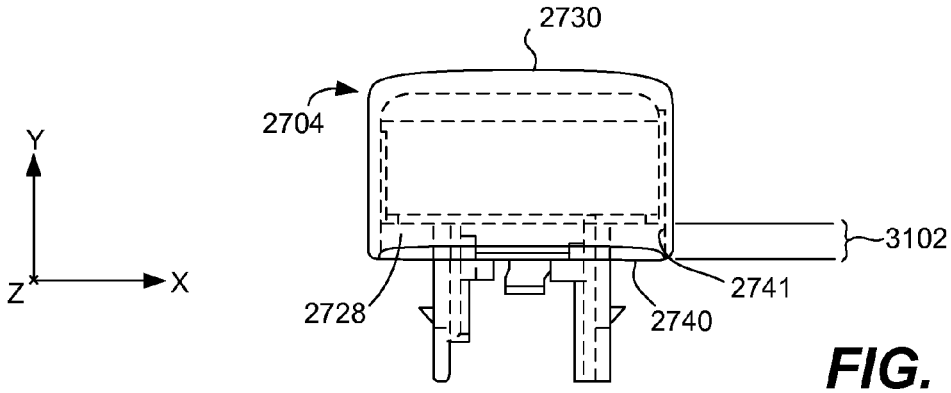
FIG. 31B is a front view of an embodiment of the lens cap holder and the lens cap of FIG. 31A.
Figure 31C:
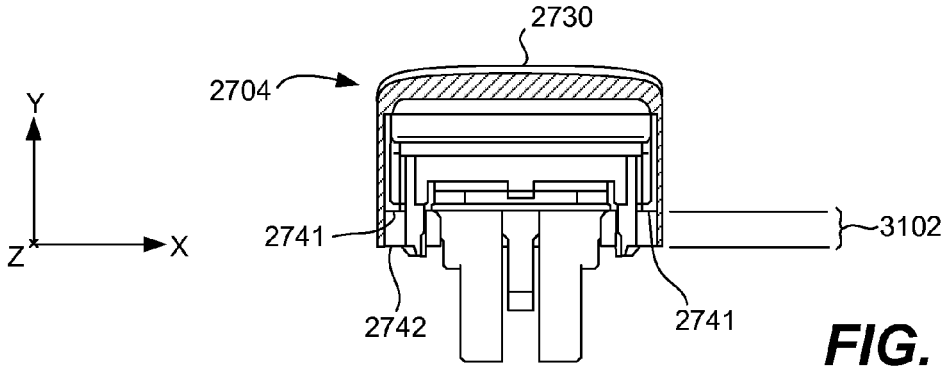
FIG. 31C is a side view of an embodiment of the lens cap holder and the lens cap of the FIG. 31A.
Figure 32A:
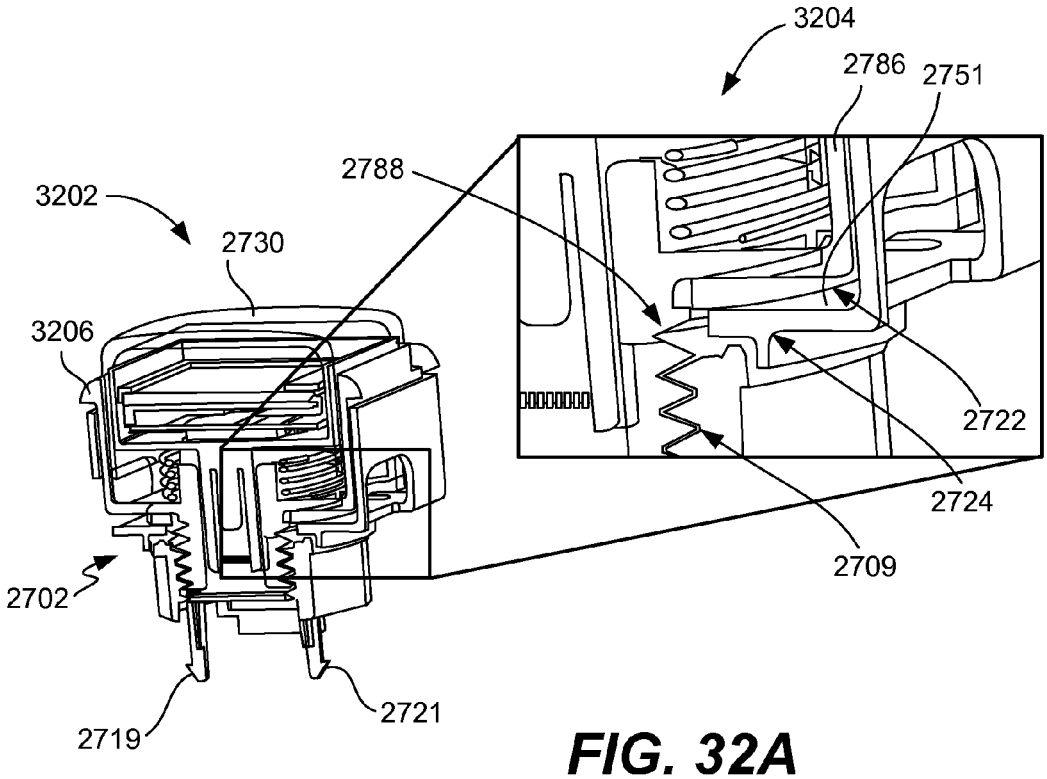
FIG. 32A shows a plurality of views of an embodiment of at least a portion of the button assembly of FIGS. 27A and 27B.

FIGS. 27A and 27B are an isometric exploded view of an embodiment of a button assembly 2702, FIG. 28A is an isometric view of an embodiment of a lens cap 2704 of button assembly 2702, FIG. 28B is a front view of the lens cap 2704, FIG. 29 is an isometric view of another embodiment of a lens cap 2902, FIG. 30 is an isometric view of yet another embodiment of a lens cap 3002, FIG. 31A is an isometric view of an embodiment of a portion of lens cap 2704 (FIG. 27A) and an embodiment of a portion of a lens cap holder 2706. FIG. 31B is a front view of an embodiment of the lens cap 2704 and lens cap holder 2706 and FIG. 31C is a side view of an embodiment of the lens cap 2704 and lens cap holder 2706. FIG. 32A is an isometric sectional view 3202 and an exploded view 3204 of an embodiment of button assembly 2702.

Figure 32B:
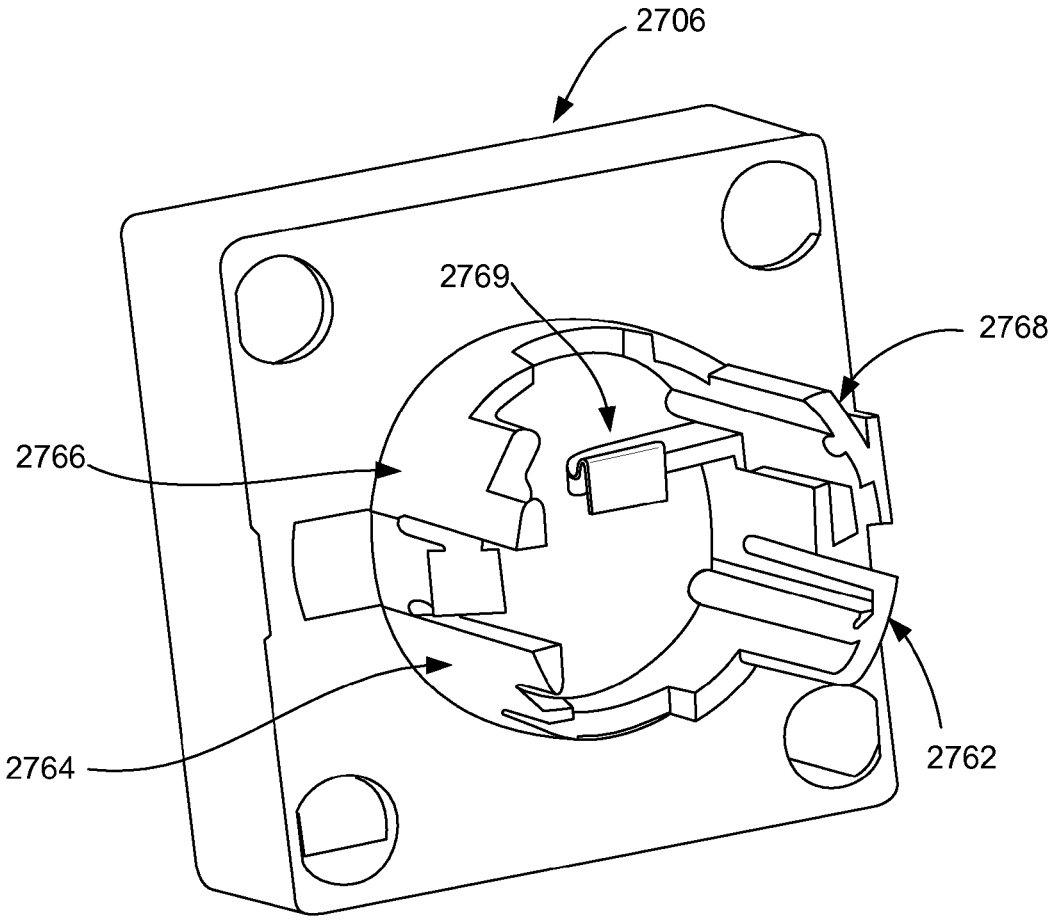
FIG. 32B shows an isometric view of an embodiment of a lens cap holder of the button assembly of FIGS. 27A and 27B.
Figure 32C:
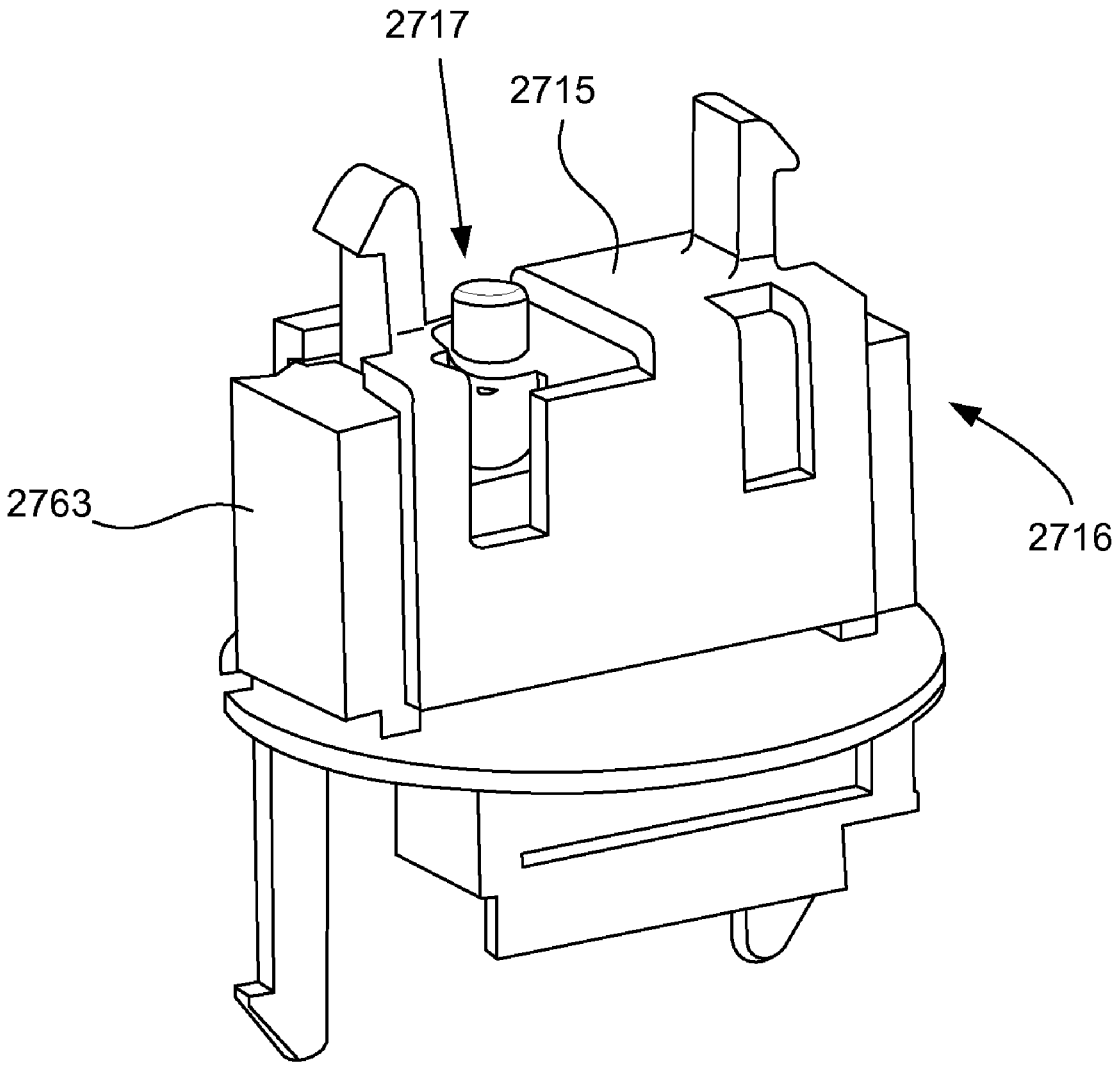
FIG. 32C shows an isometric illustrating an embodiment of a switch assembly of the button assembly of FIGS. 27A and 27B.
Figure 33A:
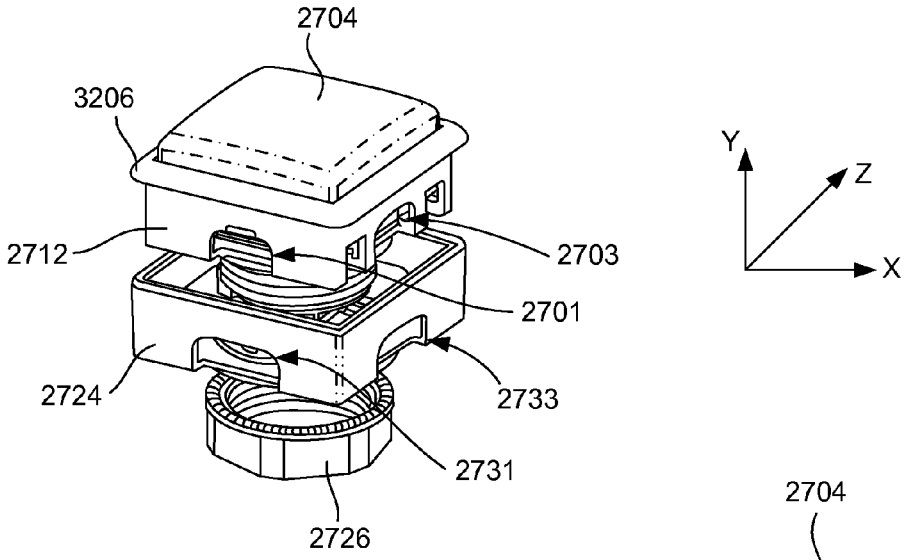
FIG. 33A is an isometric view of an embodiment of the button assembly of FIGS. 27A and 27B.
Figure 33B:
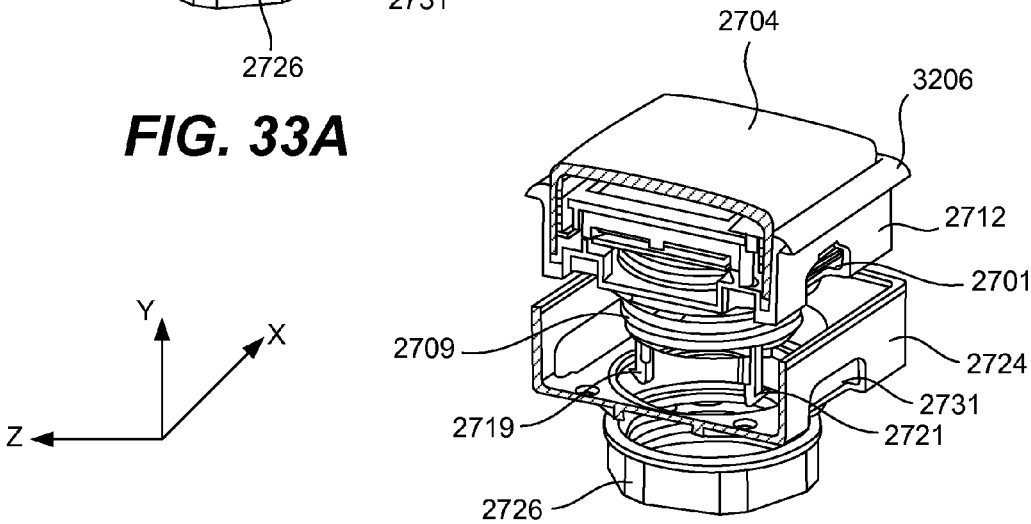
FIG. 33B is an isometric sectional view of an embodiment of the button assembly of FIGS. 27A and 27B.
Figure 33C:
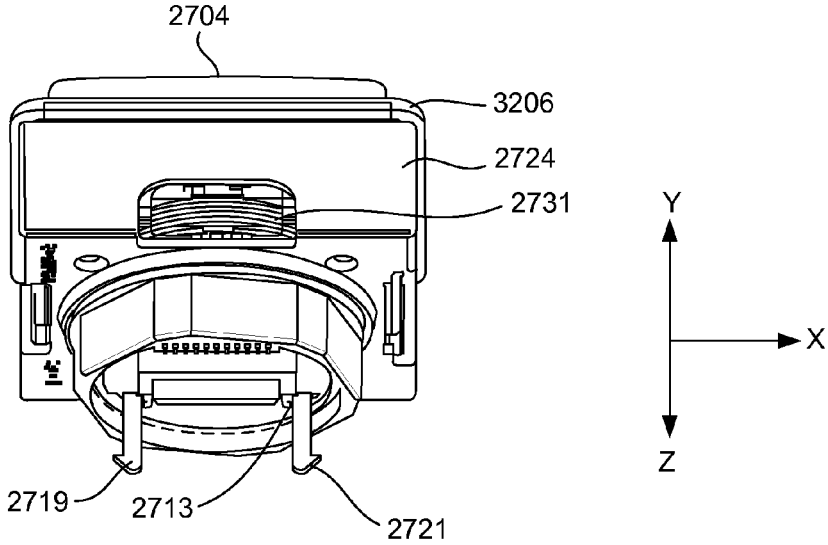
FIG. 33C is another isometric view of an embodiment of the button assembly of FIGS. 27A and 27B.
Figure 33D:
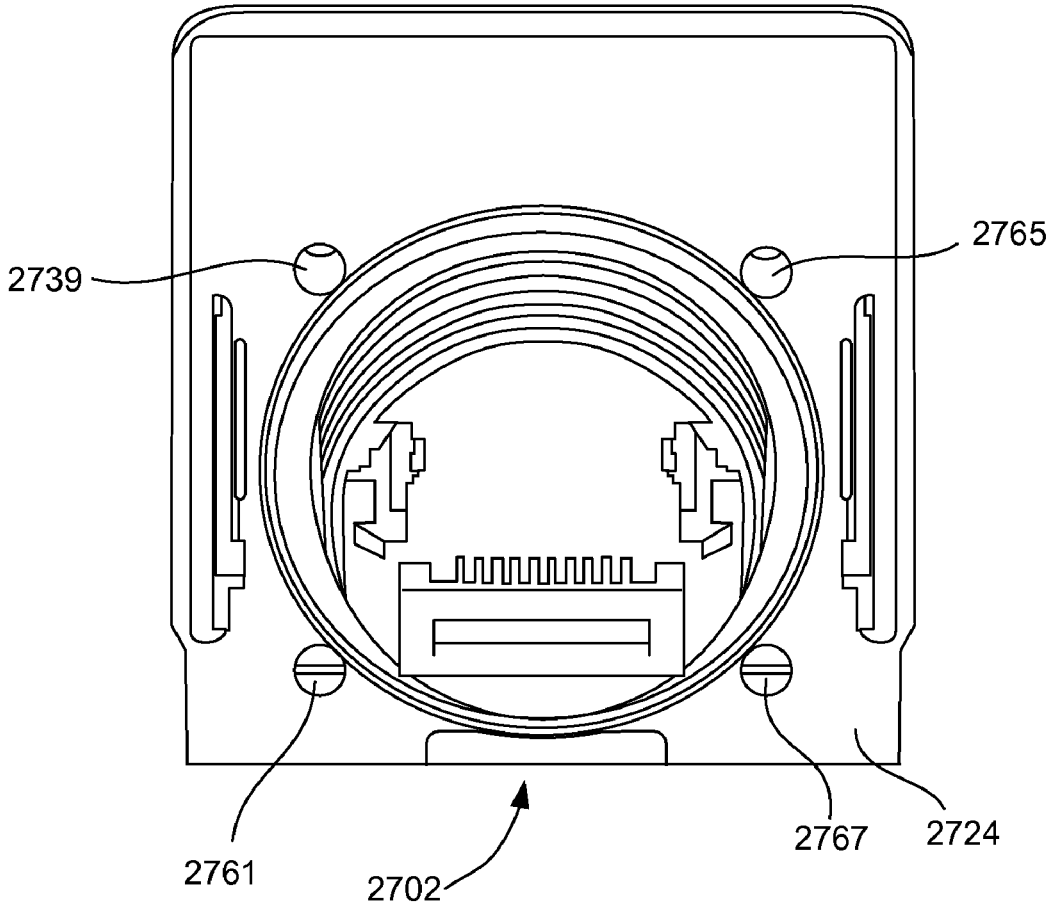
FIG. 33D is yet another isometric view of an embodiment of the button assembly of FIGS. 27A and 27B.
Figure 33E:
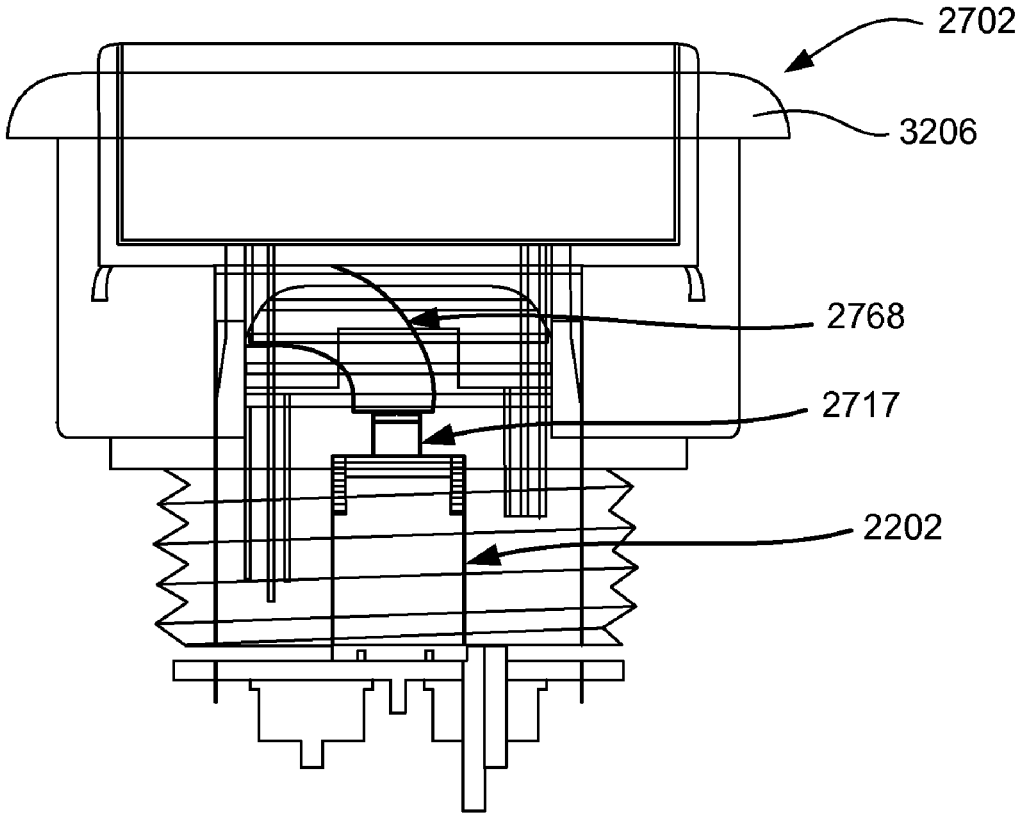
FIG. 33E is a front view of an embodiment of the button assembly of FIGS. 27A and 27B.
Figure 33F:
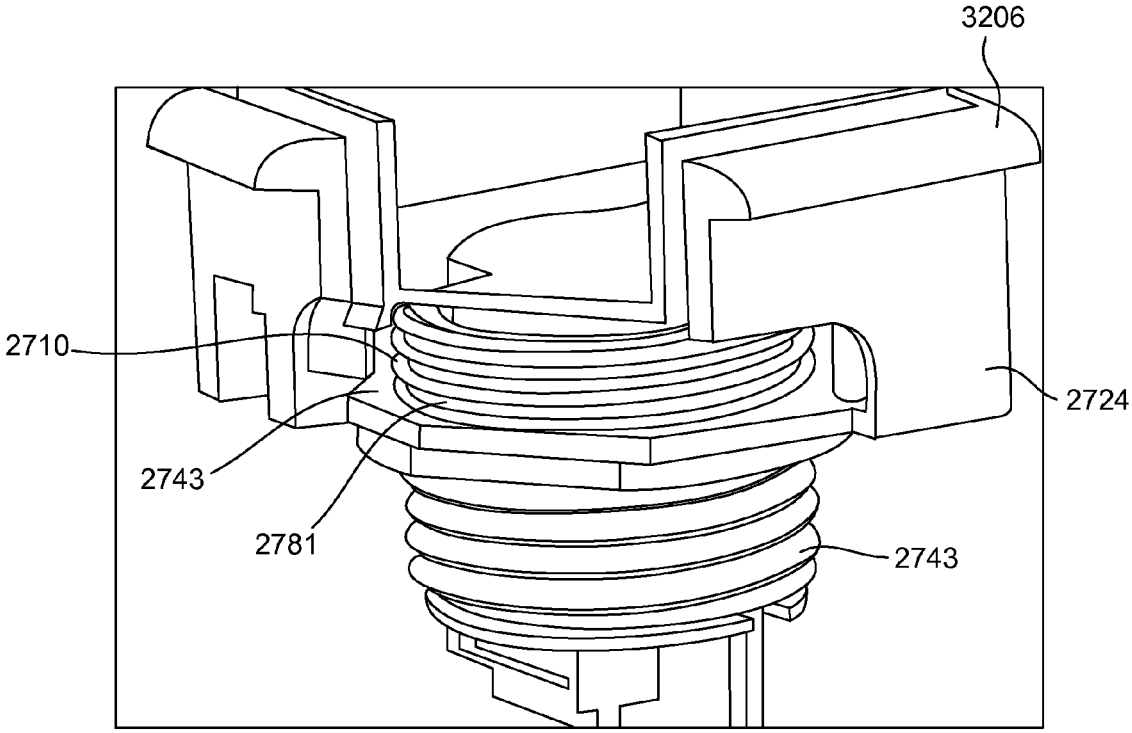
FIG. 33F is an isometric partially assembled view of an embodiment of the button assembly of FIGS. 27A and 27B.
Figure 34:
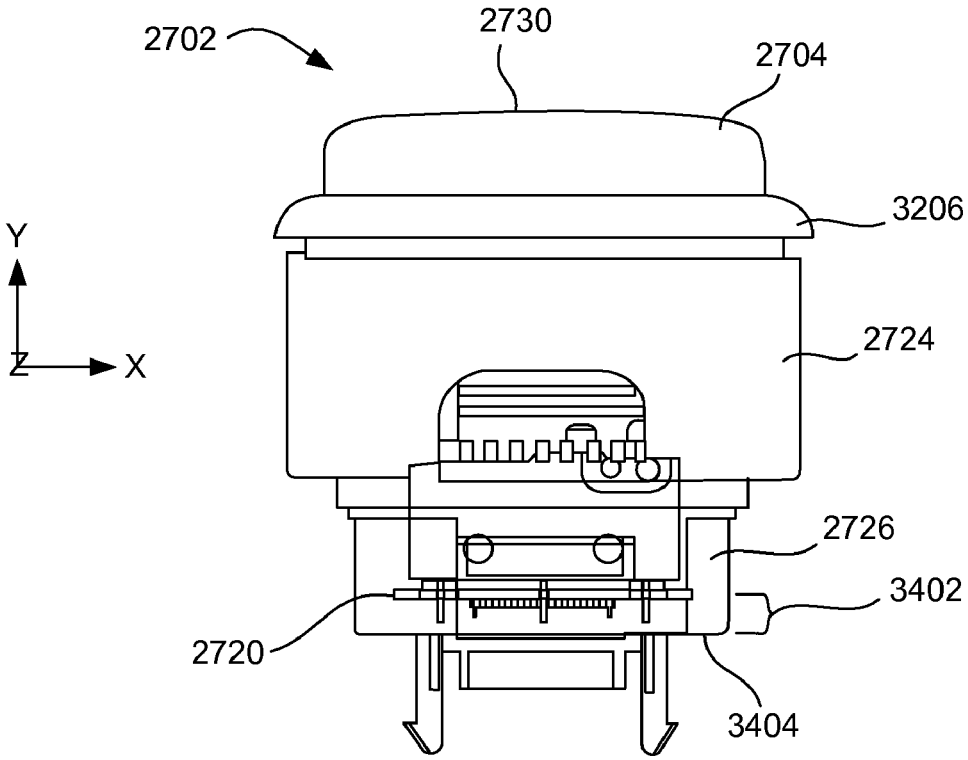
FIG. 34 is a front view of an embodiment of the button assembly of FIGS. 27A and 27B.

FIG. 32B is an isometric view of an embodiment of lens cap holder 2706. FIG. 32C shows an isometric of an embodiment of a switch assembly 2716 of button assembly 2702. FIG. 33A is an isometric view of an embodiment of button assembly 2702, FIG. 33B is an isometric sectional view of an embodiment of button assembly 2702, and FIG. 33C is another isometric view of an embodiment of button assembly 2702 and FIG. 33D is yet another isometric view of an embodiment of button assembly 2702. FIG. 33E is a front view of an embodiment of button assembly 2702. FIG. 33F is an isometric partially assembled view of an embodiment of button assembly 2702. FIG. 34 is a front view of an embodiment of button assembly 2702. Button assembly 2702 is an example of any of button assemblies 1210 and 1212 (FIG. 12).

Figure 35A:
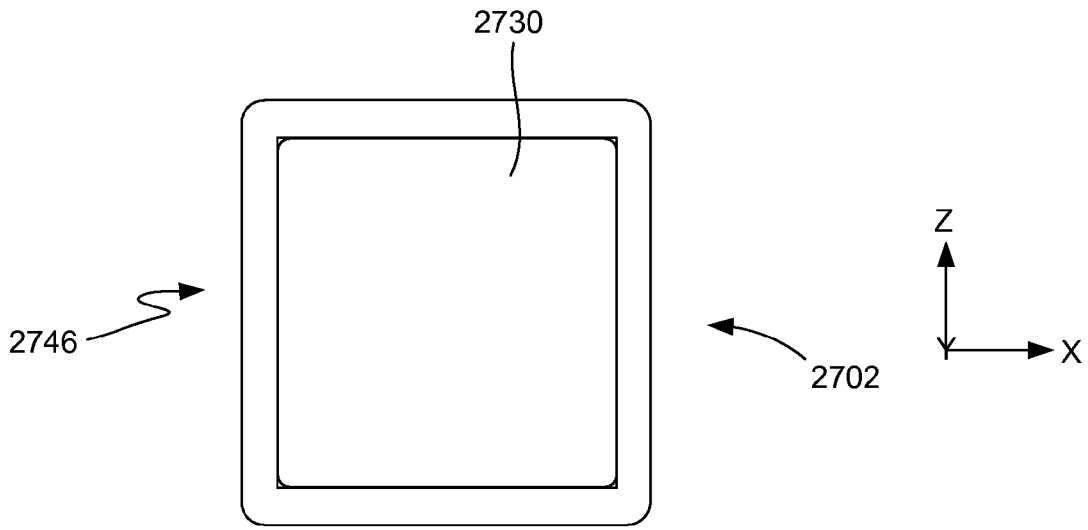
FIG. 35A is a top view of an embodiment of the button assembly of FIGS. 27A and 27B as assembled.
Figure 35B:
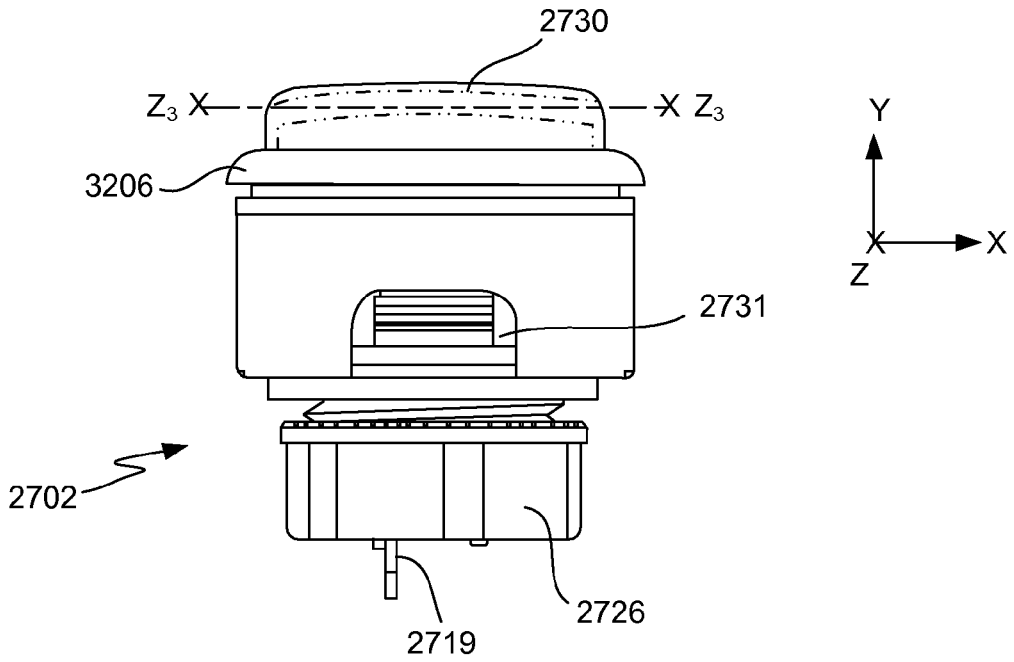
FIG. 35B is a front view of an embodiment of the button assembly of FIGS. 27A and 27B as assembled.
Figure 35C:
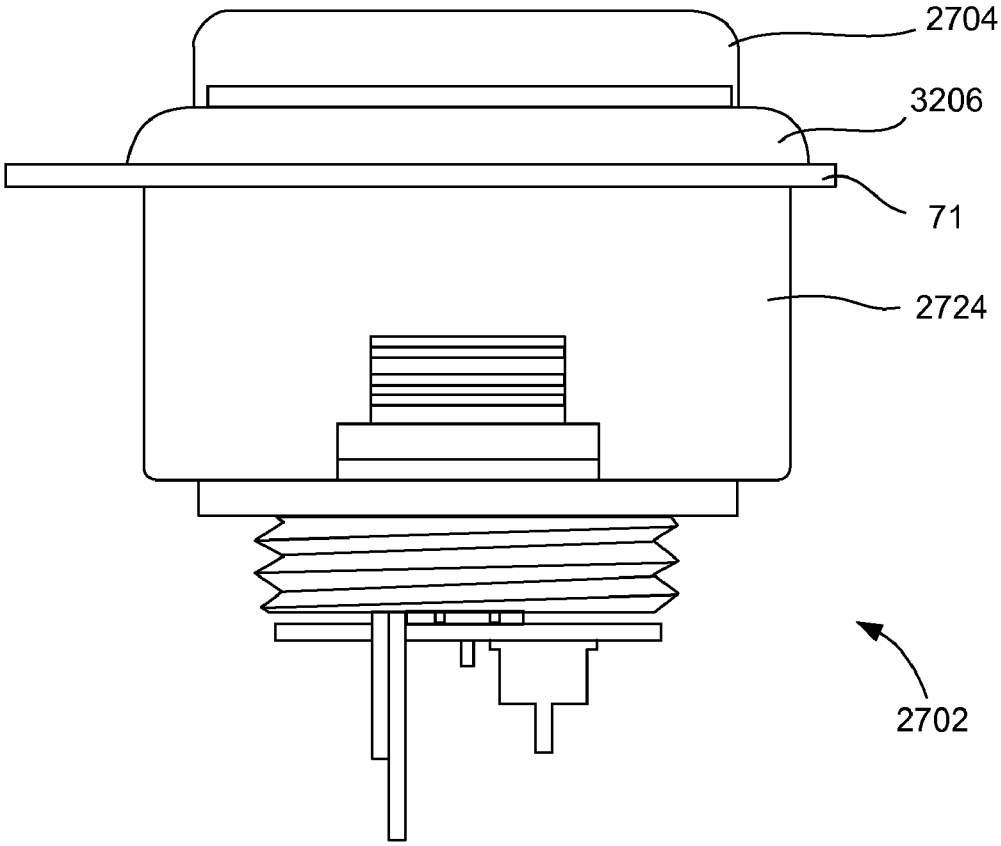
FIG. 35C is a view of an embodiment of the button assembly of FIGS. 27A and 27B as implemented within the gaming machine of FIG. 1.

FIG. 35A is a top view of button assembly 2702 (FIG. 26) as assembled, and FIG. 35B is a front view of button assembly 2702 (FIG. 26) as assembled. FIG. 35C is a view of an embodiment of button assembly 2702 as implemented within gaming machine 10 (FIG. 1).

Button assembly includes lens cap 2704, a light emitting device assembly 2708, lens cap holder 2706, a spring 2710, a button housing 2712, a digital interconnect board 2714, switch assembly 2716, a button mating component 2718, a controller board 2720, a gasket 2722, a clamp 2724, and a nut 2726. Button mating component 2718 is an example of button mating component 131 (FIGS. 3B and 4). A button includes a lens cap.

Lens cap 2704 is made of plastic, which is transparent or translucent. Lens cap 2704 is hollow and includes a cap cavity 2728. Lens cap 2704 further includes a top cap surface 2730, a first cap side 2732, a second cap side 2734 attached to first cap side 2732, a third cap side 2736 attached to second cap side 2734, and a fourth cap side 2738 attached to third cap side 2736 and to first cap side 2732. As shown in FIG. 28A, first cap side 2732 has a first lower portion 2740, second cap side 2734 has a second lower portion 2742, third cap side 2736 has a third lower portion 2744, and fourth cap side 2738 has a fourth lower portion 2746. Top cap surface 2730 is attached to first cap side 2732, second cap side 2734, third cap side 2736, and fourth cap side 2738. Second cap side 2734 includes a snap submitting member 2748 and fourth cap side 2738 includes another snap submitting member 2750 (shown in FIG. 28A).

As shown in FIG. 28A, a plane 2802 passes through lower portions 2740, 2742, 2744, and 2746. Plane 2802 is perpendicular to the first cap side 2732, second cap side 2734, third cap side 2736, and fourth cap side 2738. Each cap side 2732, 2734, 2836, and 2738 has the same length as measured parallel to a y-axis. For example, a length, parallel to the y-axis, of first cap side 2732 is equal to a length, parallel to the y-axis, of second cap side 2734. A perpendicular distance 2804 between a point 2806 on plane 2802 and a point 2808 on top cap surface 2730 is different, such as less than, a perpendicular distance 2810 between a point 2812 on plane 2802 and a point 2814 on top cap surface 2730. Top cap surface 2730 is symmetrical in all directions, including x, y, and z directions, with respect to a center line 2816 passing through a center 2818 of top cap surface 2730. Top cap surface 2730 is curved. For example, top cap surface 2730 is dome-shaped. As another example, top cap surface 2730 has a radius of curvature ranging from and including 3 inches to 7 inches. As another example, top cap surface 2730 has a curved cross-section along Z1-Z1.

Referring back to FIG. 27A, lens cap holder 2706 further includes a first holder side 2752, a second holder side 2754 attached to first holder side 2752, a third holder side 2756 attached to second holder side 2754, and a fourth holder side 2758 attached to third holder side 2756 and to first holder side 2752. Lens cap holder 2706 is hollow and includes a holder cavity 2760.

Lens cap holder 2706 is made from a non-conducting material, such as plastic, wood, or rubber. Referring to FIG. 32B, lens cap holder 2706 includes a plurality of holder legs 2762, 2764, 2766, and 2768, and an actuator arm 2769. Actuator arm 2769 extends from holder leg 2768

Moreover, referring back to FIG. 27A, lens cap holder 2706 includes a plurality of snap receiving members 2770 and 2772. Snap receiving member 2770 is a part of second holder side 2754 and snap receiving member 2772 is a part of fourth holder side 2758. The number of snap receiving members 2770 and 2772 are the same as the number of snap submitting members 2748 and 2750.

Light emitting device assembly 2708 includes a light emitting device 2774 attached, such as soldered, to a frame 2776. Frame 2776 has a plurality of device assembly legs 2778, 2780, 2782, and 2784. Light emitting device 2774 may be an OLED display device, an LED display device, an LCD display device, or an electroluminescence (EL) display device. An example of light emitting device 2774 includes small display screen 136 (FIG. 5D). Another example of light emitting device 2774 includes a plurality of light emitting elements including light emitting element 1618 (FIG. 16). Frame 2776 is fabricated from the non-conducting material. Each device assembly leg 2778, 2780, 2782, and 2784 has a hook.

Spring 2710 is fabricated from plastic or metal. Button housing 2712 includes a first housing portion 2786 and a second housing portion 2788. First housing portion 2786 has a first portion cavity 2747. First housing portion 2786 has a polygonal cross-section, such as a square or a rectangular cross-section, along Z2-Z2. Second housing portion 2788 has a curved, such as a circular or elliptical, cross-section along Z3-Z3. As shown in FIG. 34, second housing portion 2788 extends in a direction opposite to the y direction beyond controller board 2720 to form an extension 3402 and the extension 3402 reduces a chance of a liquid, such as water, soda, or a drink, from entering from outside second housing portion 2788 to within a second portion cavity 2790 (FIG. 27A) of second housing portion 2788. If the liquid enters from outside second portion cavity 2790 to within second portion cavity 2790, the liquid may damage button mating component 2718 and/or cable connector 120 (FIGS. 3A, 3B, and 4).

Referring back to FIG. 27A, first housing portion 2786 includes a first housing side 2792, a second housing side 2794 attached to the first housing side 2792, a third housing side 2796 attached to the second housing side 2794, and a fourth housing side 2798 attached to the third and first housing sides. First housing side 2792 includes a first housing notch 2701, second housing side 2794 includes a second housing notch 2703, third housing side 2796 includes a third housing notch 2705, and fourth housing side 2798 includes a fourth housing notch 2707. First housing notch 2701 extends through first housing side 2792, second housing notch 2703 extends through second housing side 2794, third housing notch 2705 extends through third housing side 2796, and fourth housing notch 2707 extends through fourth housing side 2798.

A housing notch has a curved shape, a polygonal shape, or a combination of the curved and polygonal shapes. For example, each housing notch 2701 and 2705 has a combination of a curved and polygonal shape as viewed in the z direction, and each housing notch 2703 and 2707 has a combination of a curved and polygonal shape as viewed in the x direction.

Second housing portion 2788 includes a plurality of threads on an outer surface 2709 of the portion. First housing portion 2786 is attached or integrally formed with second housing portion 2788. Digital interconnect board 2714, such as a printed circuit board (PCB), includes a plurality of digital interconnects and is attached to button housing 2712.

Referring to FIG. 27B, controller board 2720, such as a PCB, includes a plurality of board notches 2711 and 2713. Board notch 2713 is not visible in FIG. 27B. Switch assembly 2716 includes a switch 2763 (FIG. 32C) and a switch housing 2715 (FIG. 32C) for the switch 2763. Switch housing 2715 is fabricated from the non-conducting material. Switch 2763 of switch assembly 2716 has an actuator 2717. Switch housing 2715 includes a plurality of switch assembly prongs 2719 and 2721. Switch assembly prong 2721 is not visible in FIG. 27B. Switch assembly prong 2719 extends through board notch 2711 and switch assembly prong 2721 extends through board notch 2713 to fit switch assembly 2716 with controller board 2720. Button mating component 2718 is electrically connected to controller board 2720 and controller board 2720 includes LEC 1606 (FIGS. 16 and 20) and logic device 1604 (FIGS. 16 and 20).

Gasket 2722 is made of a flexible material, such as rubber or plastic. Clamp 2724 includes a first clamp side 2723, a second clamp side 2725, a third clamp side 2727, and a fourth clamp side 2729. Clamp 2724 is fabricated from the non-conducting material. Second clamp side 2725 is attached to first clamp side 2723, third clamp side 2727 is attached to second clamp side 2725, and fourth clamp side 2729 is attached to the third clamp side and the first clamp side. First clamp side 2723 includes a first clamp notch 2731, second clamp side 2725 includes a second clamp notch 2733, third clamp side 2727 includes a third clamp notch 2735, and fourth clamp side 2729 includes a fourth clamp notch 2737. First clamp notch 2731 extends through first clamp side 2723, second clamp notch 2733 extends through second clamp side 2725, third clamp notch 2735 extends through third clamp side 2727, and fourth clamp notch 2737 extends through fourth clamp side 2729.

Each clamp 2724 notch has a combination of straight and curved cross-sections. For example, as viewed in the z direction, each of first clamp notch 2731 and third clamp notch 2735 has a combination of a curved cross-section and a straight cross-section. As another example, as viewed in the x direction, each of second clamp notch 2733 and fourth clamp notch 2737 has a combination of a curved cross-section and straight cross-section. Clamp 2724 includes a plurality of clamp openings 2739, 2761, 2765, and 2767 (FIG. 33D).

Nut 2726 is fabricated from the non-conducting material and includes a plurality of threads. Lens cap 2704, frame 2776, lens cap holder 2706, button housing 2712, switch housing 2715, clamp 2724, and nut 2726 may be fabricated by a molding or extrusion process. For example, a mold having a cavity of the shape of button housing 2712 is used to fabricate button housing 2712 by pouring the non-conducting material into the mold cavity and heating and then cooling the material. As shown in FIG. 34, extension 3402 is formed between controller board 2720 and a bottom surface 3404 of nut 2726. Extension 3402 of nut 2726 reduces a chance of the liquid that exits from at least one of notches 2701, 2703, 2705, 2707, 2731, 2733, 2735, and 2737 from entering from outside nut 2726 to inside nut 2726. If the liquid enters from outside nut 2726 to inside nut 2726 via capillary action, the liquid may damage button mating component 2718 and/or cable connector 120 (FIGS. 3A, 3B, and 4).

Referring back to FIG. 27A, light emitting device assembly 2708 is attached to lens cap holder 2706 via the hooks of assembly legs 2778, 2780, 2782, and 2784. Snap submitting member 2748 snaps with snap receiving member 2770 and snap submitting member 2750 snaps with snap receiving member 2772 to attach lens cap 2704 to lens cap holder 2706. When lens cap 2704 is attached to lens cap holder 2706, lens cap 2704 extends below lens cap holder 2706 to from an extended portion 3102, shown in FIGS. 31A, 31B, and 31C. For example, as shown in FIG. 31, a lower portion 3104 including portions 2740, 2742, 2744, and 2746 of lens cap 2704, as seen in a direction opposite to the y direction, extends below a bottom portion 2741 of lens cap holder 2706 to form extended portion 3102. The extended portion 3102 prevents the liquid accidentally spilled by the user from entering from outside lens cap 2704 to inside, such as within, cap cavity 2728 and inside, such as within, holder cavity 2760.

Referring FIG. 33F, spring 2710 surrounds, such as encircles, a raised inside edge 2781 of button housing 2712, and spring 2710 abuts against a bottom surface 2743 of first housing portion 2786 and abuts against a bottom surface 2745 of lens cap holder 2706. Spring 2710 does not extend within second portion cavity 2790 of second housing portion 2788. Holder legs 2762, 2764, 2766, and 2768 are received within button housing 2712, at least a portion of light emitting device assembly 2708 is received within lens cap holder 2706, and at least a portion of lens cap holder 2706 is received within button housing 2712. Switch assembly 2716 is received within second portion cavity 2790 of second housing portion 2788 and controller board 2720 are received within second portion cavity 2790. Holder legs 2762, 2764, 2766, and 2768 are received within second housing portion 2788 to stabilize lens cap holder 2706 as lens cap holder 2706 moves up and down to prevent button assembly 2702 from tilting.

When the user presses lens cap 2704 to press the button, lens cap holder 2706 presses against spring 2710, the pressure creates tension between lens cap holder 2706 and button housing 2712, and actuator arm 2768 reaches actuator 2717 (FIG. 33E) to turn on switch 2763 within switch assembly 2716. Further, when the user releases lens cap 2704 to release the button, lens cap holder 2706 releases spring 2710 from tension, and actuator arm 2768 looses contact with actuator 2717 to turn off switch 2763 within switch assembly 2716.

A technical effect of a top cap surface having at least a curved portion is that the user may press or hit hard against the top cap surface 2730. An increase in a perpendicular distance between a top cap surface and light emitting device 2774 protects light emitting device 2774 from being damaged by the hard press or hard hit. For example, without the increase in perpendicular distance, the hard press or hard hit may damage light emitting device 2774. An example of the increase in the perpendicular distance is a difference between perpendicular distances 2810 and 2804. Moreover, another technical effect of a top cap surface that is curved is that the top cap surface creates a lower magnification than that created by a straight surface of a lens cap. The convexity of a top cap surface in the y-direction converges rays that reach an eye of the user to reduce magnification than that created by the straight surface of the lens cap.

Another technical effect of the herein described housing notches includes providing a plurality of openings from the liquid to be able to flow from inside first portion cavity 2747 and/or second portion cavity 2790 to outside button housing 2712. For example, spilled water or another drink that enters first portion cavity 2747 and/or second portion cavity 2790 can exit from housing cavity to outside button housing 2712 via at least one of first housing notch 2701, second housing notch 2703, third housing notch 2705, and fourth housing notch 2707. The exit of the liquid protects controller board 2720, switch assembly 2716, button mating component 2718, and cable connector 120 (FIGS. 3A, 3B, and 4) that is electrically connected to button mating component 2718.

Yet another technical effect of extended portion 3102 includes reducing chances of a capillary action of the liquid to prevent the liquid from entering into button assembly 2702. Without extended portion 3102, the liquid may enter inside button assembly 2702 and cause damage to controller board 2720 and/or light emitting device 2774. Another technical effect of the herein described clamp openings 2739, 2761, 2765, and 2767 includes providing openings to allow the liquid to drain from within button assembly 2702 to outside button assembly 2702.

As shown in FIG. 32A, gasket 2722 is fitted around second housing portion 2788. Gasket 2722 abuts against a bottom clamp surface 2751 and against first housing portion 2786. A technical effect of gasket 2722 includes reducing chances of the liquid from entering from outside button assembly 2702 into button assembly 2702. For example, gasket 2722 prevents spilled water or soda from traveling down the threads of second housing portion 2788 and entering inside button mating component 2718 from outside button assembly 2702. Further, gasket 2722 also reduces chances of the liquid from traveling down the threads of second housing portion 2788 and entering from outside button assembly 2702 to within cable connector 120 (FIGS. 3A, 3B, and 4). Moreover, gasket 2722 reduces chances of the liquid from entering into cable connector 120 or button mating component 2718 from first portion cavity 2747 or clamp cavity 2771.

Referring to FIGS. 27A and 27B, clamp 2724 is placed over button housing 2712 to surround a portion of the first housing portion 2786. For example, clamp 2724 surrounds first housing portion 2786 except a bezel 3206 of button housing 2712. Upon surrounding the portion of first housing portion 2786 with clamp 2724, first clamp side 2723 is adjacent to first housing side 2792, second clamp side 2725 is adjacent to second housing side 2794, third clamp side 2727 is adjacent to third housing side 2796, and fourth clamp side 2729 is adjacent to fourth housing side 2798. Further, upon surrounding the portion of first housing portion 2786 with clamp 2724 first clamp notch 2731 is adjacent to first housing notch 2701, second clamp notch 2733 is adjacent to second housing notch 2703, third clamp notch 2735 is adjacent to third housing notch 2705, and fourth clamp notch 2737 is adjacent to fourth housing notch 2707.

A technical effect of the herein describes clamp notches includes providing a plurality of openings for the liquid to be able to flow from inside button housing 2712 and/or clamp 2724 to outside button assembly 2702. For example, spilled water or soda that enters first portion cavity 2747 can exit to outside button assembly 2702 via first housing notch 2701 and first clamp notch 2731, second housing notch 2703 and second clamp notch 2733, third housing notch 2705 and third clamp notch 2735, and/or fourth housing notch 2707 and fourth clamp notch 2737. As another example, spilled drink that enters a clamp cavity 2771 exits from clamp cavity 2771 to outside button assembly via at least one of first clamp notch 2731, second clamp notch 2733, third clamp notch 2735, and fourth clamp notch 2737.

When button assembly 2702 is assembled, second housing portion 2788 extends through a clamp opening 2749 within a bottom clamp surface 2751. The threads of nut 2726 are mated with the threads of second housing portion 2788 to attach clamp 2724 with button housing 2712 and assemble button assembly 2702. As shown in FIG. 35C, button assembly 2702 is held with respect to panel 71 by bezel 3206 located on a top surface of panel 71 and by clamp 2724 and nut 2726 located below a bottom surface of panel 71. Button assembly 2702 is held in place with respect to panel 71 when clamp 2724 applies upward pressure towards bezel 3206 and clamp 2724 applies the upward pressure when the threads of nut 2726 are mated with the threads of second housing portion 2788.

When the user presses lens cap 2704, actuator arm 2768 presses actuator 2717 (shown in FIG. 33E), and the actuator actuates the switch 2763 of switch assembly 2716. Switch 2763 of switch assembly 2716 generates an actuation signal that is received by LEC processor 1608. LEC processor 1608 sends, via the digital interconnects, the voltage amount within storage device 1612 and the refresh rate within storage device 1614 to light emitting device 2774 to display an image on light emitting device 2774.

In another embodiment, first cap side 2732, second cap side 2734, third cap side 2736, and fourth cap side 2738, and top cap surface 2730 are integrally formed into a single piece. In yet another embodiment, lens cap 2704 includes at least one snap submitting member, such as one, three, or five snap submitting members formed on any of cap sides. In still another embodiment, lens cap holder 2706 includes at least one snap receiving member, such as three or four snap receiving members. In another embodiment, a button includes sensor 2304 (FIG. 23).

In still another embodiment, frame 2776 may have at least one device assembly leg, such as more or less that four device assembly legs. In yet another embodiment, not all device assembly legs include a hook.

In yet another embodiment, lens cap holder 2706 includes at least one holder leg, such as more or less than four holder legs. In another embodiment, top cap surface 2730 is asymmetrical in at least one of the x, y, and z directions with respect to center line 2816. In another embodiment, clamp 2724 includes more or less than four clamp openings 2739, 2761, 2765, and 2767.

In yet another embodiment, a top cap surface has a straight cross-section along Z1-Z1. An example of this embodiment is shown in FIG. 29. Lens cap 2902 includes a cavity 2904 and a top cap surface 2906 that includes a plurality of polygonal portions 2908, 2910, and 2912, and a cross-section of each polygonal portion 2908, 2910, and 2912 of top cap surface 2906 along Z1-Z1 is straight. Top cap surface 2906 is made from the same material as top cap surface 2730 (FIG. 27A). In another embodiment, top cap surface 2906 is made of at least one polygonal portion. In still another embodiment, a top cap surface has a combination of curved and straight cross-sections along Z1-Z1. An example of this embodiment is shown in FIG. 30. Lens cap 3002 includes a cavity 3004 and a top cap surface 3006 that includes a plurality of polygonal portions 3008 and 3010, and a curved portion 3012. A cross-section of each polygonal portion 3008 and 3010 along Z1-Z1 is straight and a cross-section of curved portion 3012 is curved along Z1-Z1.

In another embodiment, housing sides 2792, 2794, 2796, and 2798 are integrally formed into a single piece. In yet another embodiment, not all housing sides 2792, 2794, 2796, and 2798 include a housing notch. For example, housing side 2794 does not include housing notch 2703 and housing side 2796 does not include housing notch 2705. As another example, housing side 2796 does not include housing notch 2705. In still another embodiment, at least one housing notch of first housing portion 2786 is different in shape than the remaining housing notches of first housing portion 2786. In another embodiment at least two of housing notches 2701, 2703, 2705, and 2707 have the same shape. In another embodiment, a housing side includes more than one housing notch. For example, second housing side 2794 includes two housing notches of the same shape or of different shapes. As another example, second housing side 2794 includes three housing notches of the same or different shapes.

In another embodiment, at least one of clamp notches 2731, 2733, 2735, and 2737 is different in size than the remaining of the clamp notches. In another embodiment at least two of clamp notches 2731, 2733, 2735, and 2737 have the same shape. In still another embodiment, any of clamp notches 2731, 2733, 2735, and 2737 has a curved cross-section without having a straight cross-section. In yet another embodiment, any of clamp notches 2731, 2733, 2735, and 2737 has a straight cross-section without having a curved cross-section or has a curved cross-section without having a straight cross-section. In another embodiment, nut 2726 is fabricated from a conducting material, such as metal. In yet another embodiment, plane 2802 is not perpendicular to the first cap side 2732, second cap side 2734, third cap side 2736, and/or fourth cap side 2738.

Figure 36A:
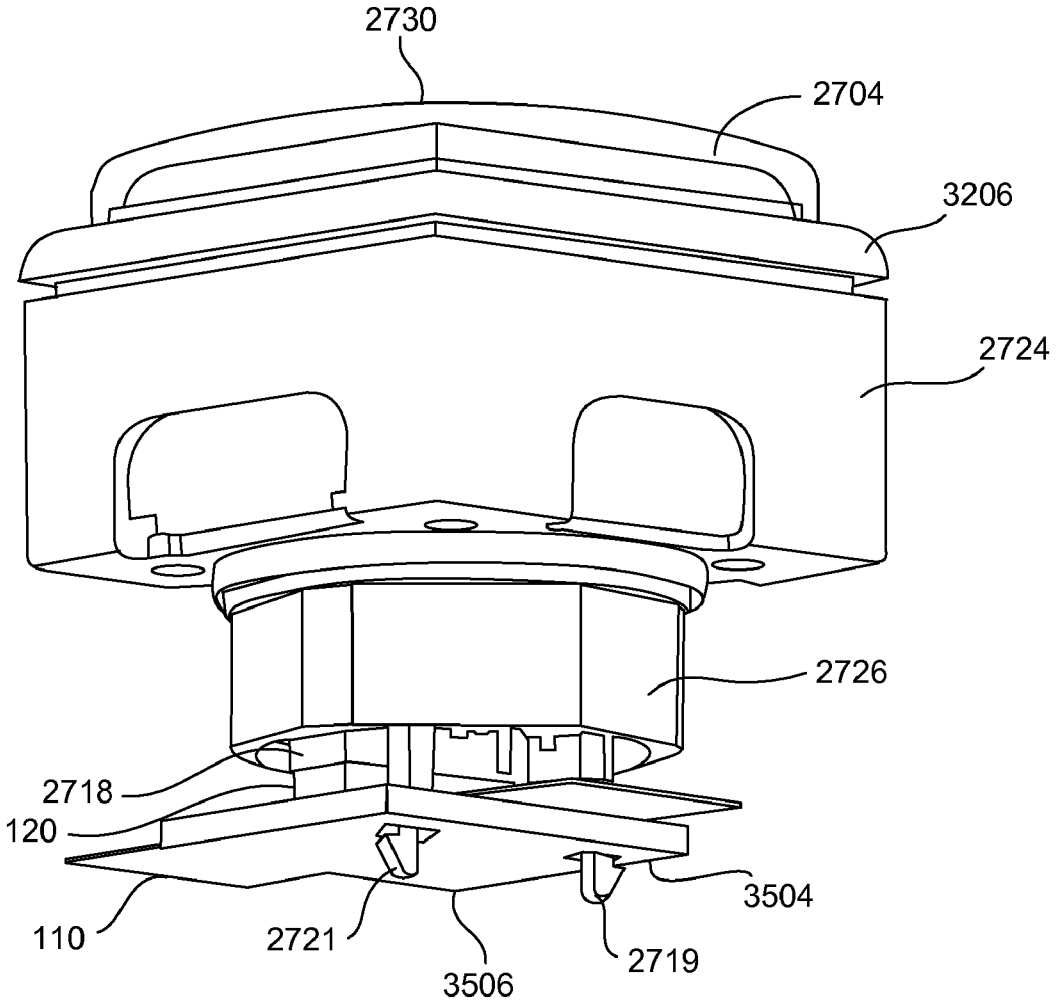
FIG. 36A is an isometric view of an embodiment of the button assembly of FIGS. 27A and 27B fitted with a flexible cable.
Figure 36B:
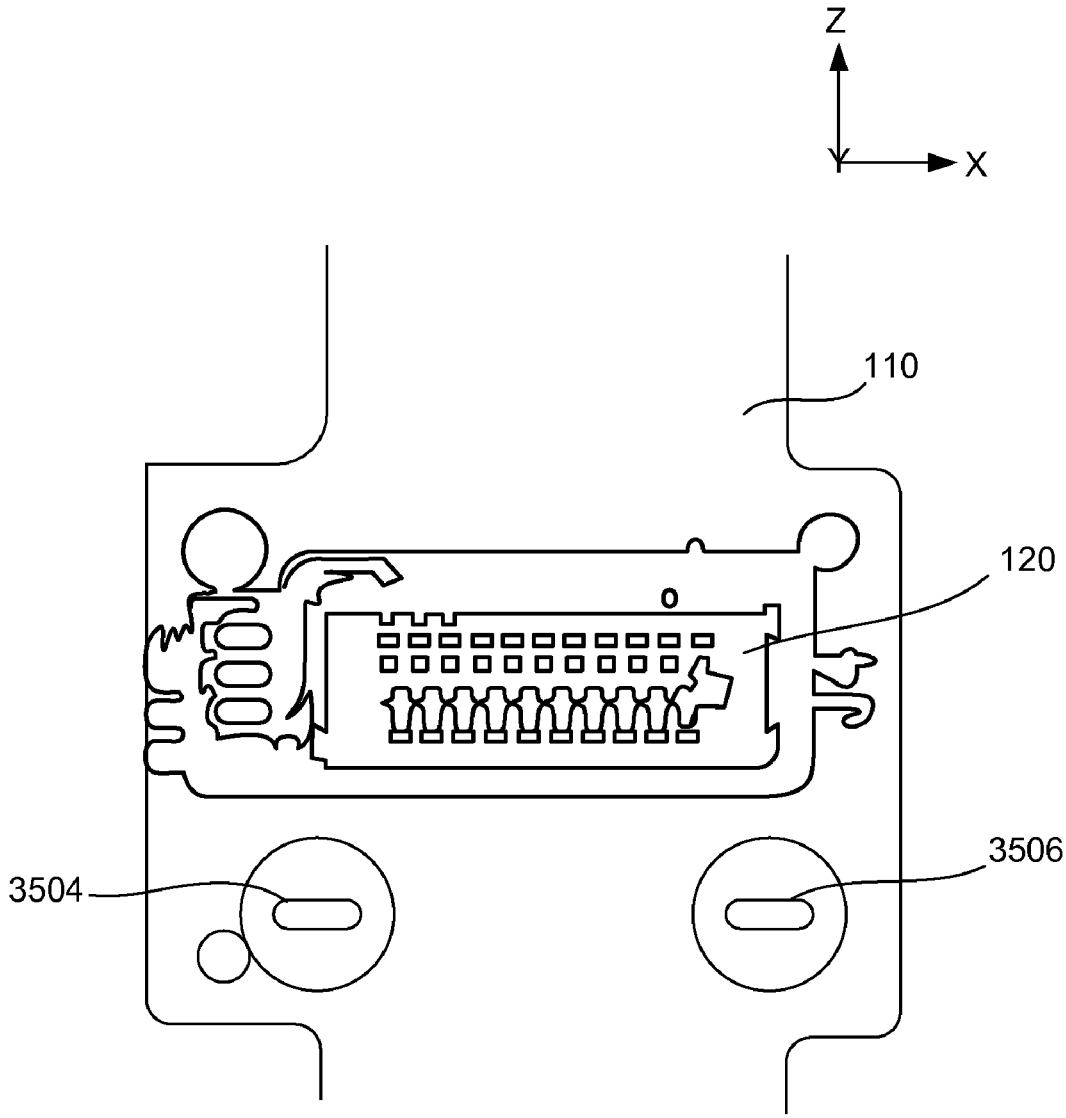
FIG. 36B is a top view of an embodiment of the flexible cable of FIG. 36A.

FIG. 36A is an isometric view of an embodiment of button assembly 2702 fitted with flexible cable 110 and FIG. 36B is a top view of the flexible cable 110. Button assembly 2702 includes button mating component 2718 and prongs 2719 and 2721. Button mating component 2718 and prongs 2719 and 2721 extend outside second portion cavity 2790 and clamp cavity 2771. Button mating component 2718 is connected to cable connector 120 attached to flexible cable 110.

Cable connector 120 is attached, such as soldered or screwed, to flexible cable 110. Flexible cable 110 includes a plurality of cable openings 3504 and 3506. The number of cable openings 3504 and 3506 is the same as the number of prongs 2719 and 2721. Prong 2719 is received within cable opening 3504 and extends through cable opening 3504. Prong 2721 is received within cable opening 3506 and extends through cable opening 3506. Prongs 2719 and 2721 are pushed towards each other to extend the prongs through respective cable openings 3504 and 3506. Once prongs 2719 and 2721 extend through respective cable openings 3504 and 3506, the prongs are released from the push. Upon release, prongs 2719 and 2721 push away from each other. Once prongs 2719 and 2721 push away from each other and button mating component 2718 is mated with cable connector 120 (FIGS. 3A, 3B, and 4), button assembly 2702 is fitted with flexible cable 110. Button assembly 2702 is detached from flexible cable 110 by detaching cable connector 120 from button mating component 2718, pushing prongs 2719 and 2721 towards each other, and pulling prongs 2719 and 2721 out of respective cable openings 3504 and 3506.

A technical effect of the herein described prongs 2719 and 2721 is that extension of prongs 2719 and 2721 through respective cable openings 3504 and 3506 provides additional support to button assembly 2702 to that provided by mating button mating component 2718 with cable connector 120 and reduces a chance of button assembly 2702 from detaching from cable connector 120 and flexible cable 110. In another embodiment, flexible cable 110 includes at least one cable opening, such as more than two cable openings.

Although the foregoing invention has been described in detail by way of illustration and example for purposes of clarity and understanding, it will be recognized that the above described invention may be embodied in numerous other specific variations and embodiments without departing from the spirit or essential characteristics of the invention. Certain changes and modifications may be practiced, and it is understood that the invention is not to be limited by the foregoing details, but rather is to be defined by the scope of the appended claims.

What is claimed is:

1. A button assembly comprising:

a light emitting device configured to emit light;

a lens cap configured to protect the light emitting device from being damaged;

the lens cap having a top surface, a first cap side, a second cap side, a third cap side, and a fourth cap side;

the second cap side connected to the first cap side, the third cap side connected to the second cap side, and the fourth cap side connected to the first cap side and the third cap side to form a plane;

wherein the plane passes through a portion of the first cap side, a portion of the second cap side, a portion of the third cap side, and a portion of the fourth cap side;

wherein a first perpendicular distance between the plane and a first point on the top surface is different than a second perpendicular distance between the plane and a second point on the top surface; and a button housing configured to receive at least a portion of the lens cap, the button housing having a threaded portion configured to prevent a liquid from entering from outside the button assembly to within the button assembly.

2. A button assembly in accordance with claim 1, wherein the top surface is curved.

3. A button assembly in accordance with claim 1, wherein the top surface is dome-shaped.

4. A button assembly in accordance with claim 1, further comprising:

a lens cap holder configured to hold the lens cap;

wherein the lens cap extends below an edge of the lens cap holder to prevent a liquid from flowing from outside the lens cap to inside the lens cap.

5. A button assembly in accordance with claim 1, further comprising a gasket configured to surround at least a section of the threaded portion to prevent a liquid from entering the button assembly.

6. A button assembly in accordance with claim 1, wherein the button housing includes a housing side;

wherein the housing side includes a housing notch configured to allow passage of a liquid from inside the button housing to outside the button housing.

7. A button assembly in accordance with claim 1, further comprising a switch configured to be activated to an on state by a user and trigger a change of a information displayed on the light emitting device.

8. A button assembly in accordance with claim 1, further comprising a clamp including a first clamp side further including a clamp notch configured to facilitate passage of a liquid from inside the clamp to outside the clamp.

9. A button assembly in accordance with claim 1, wherein the button housing includes a housing side;

wherein the housing side includes a housing notch configured to allow passage of a liquid from inside the button housing to outside the button housing; and a clamp including a first clamp side including a clamp notch configured to facilitate passage of the liquid from inside the clamp to outside the clamp;

wherein the liquid flows via the housing notch and the clamp notch.

10. A button assembly in accordance with claim 1, wherein the threaded portion includes a first set of threads; and further includes a nut having a second set of threads that are complementary to the first set of threads;

wherein the nut has a length configured to prevent a flow of a liquid from outside the nut to inside the nut.

11. A button assembly in accordance with claim 1, further comprising:

a switch housing including a plurality of switch assembly prongs; and a button mating component configured to connect to a cable connector connected to a flexible cable;

wherein one of the switch assembly prongs is configured to extend through an opening in the flexible cable to prevent the button assembly from disengaging from the flexible cable.

12. A gaming machine for playing a game, the gaming machine comprising:

a gaming controller configured to execute a game code;

a memory configured to communicate with the gaming controller;

a display device configured to communicate with the gaming controller; and a button assembly configured to display a presentation based on the game code, the button assembly including:

a light emitting device configured to emit light;

a lens cap configured to protect the light emitting device from being damaged, the lens cap having a top surface, a first cap side, a second cap side, a third cap side, and a fourth cap side, the second cap side connected to the first cap side, the third cap side connected to the second cap side, and the fourth cap side connected to the first cap side and the third cap side to form a plane;

wherein the plane passes through a portion of the first cap side, a portion of the second cap side, a portion of the third cap side, and a portion of the fourth cap side;

wherein a first perpendicular distance between the plane and a first point on the top surface is different than a second perpendicular distance between the plane and a second point on the top surface; and a button housing configured to receive at least a portion of the lens cap, the button housing having a threaded portion configured to prevent a liquid from entering from outside the button assembly to within the button assembly.

13. A gaming machine in accordance with claim 12, wherein the game includes a wagering game.

14. A button assembly for directing a flow of a liquid, the button assembly comprising:

a button housing configured to receive a light emitting device;

wherein the button housing includes a first notch configured to facilitate a flow of the liquid from inside the button housing to outside the button housing; and wherein the button housing includes a threaded portion configured to prevent a liquid from entering from outside the button assembly to within the button assembly.

15. A button assembly in accordance with claim 14, wherein the light emitting device is configured to display information related to a game played using a gaming machine.

16. A button assembly in accordance with claim 14, further comprising a clamp including a clamp notch configured to facilitate a flow of the liquid from inside the clamp to outside the clamp.

17. A button assembly in accordance with claim 14, further comprising:

a gasket;

wherein the button housing includes a polygonal cross-sectional portion and a curved cross-sectional portion;

wherein the gasket is configured to surround the curved cross-sectional portion to prevent a flow of the liquid from outside the button housing to inside the button housing.

18. A system for increasing life of a light emitting element, the system comprising:

a controller including a processor and a memory configured to communicate with the processor;

the processor configured to determine whether an event has occurred within a pre-defined time window;

the processor configured to invert a first intensity of a pixel including the light emitting element upon determining that the event has not occurred within the pre-defined time window;

the processor configured to generate an inverted intensity upon inverting the first intensity.

19. A system in accordance with claim 18, wherein the processor is configured to generate a reduced intensity by reducing the inverted intensity by a fixed percentage.

20. A system in accordance with claim 18, wherein the processor is configured to restore the pixel to the first intensity upon determining that the event has occurred after generating the inverted intensity.

21. A method for increasing life of a light emitting element, the method comprising:

determining, by a processor, whether an event has occurred within a pre-defined time window; and generating, by the processor, an inverted intensity upon determining that the event has not occurred within the pre-defined time window, wherein generating the inverted intensity is performed by inverting the first intensity.

22. A system in accordance with claim 21, further comprising generating a reduced intensity by reducing the inverted intensity by a fixed percentage.

23. A gaming machine comprising:

a gaming controller configured to execute a game code;

a memory configured to communicate with the gaming controller;

a display device configured to receive information from the gaming controller; and a processor coupled to the gaming controller and configured to determine whether an event has occurred within a pre-defined time window;

the processor configured to generate an inverted intensity upon determining that the event has not occurred within the pre-defined time window;

the processor configured to generate the inverted intensity by inverting the first intensity.

24. A gaming machine in accordance with claim 23, wherein the processor is configured to generate a reduced intensity by reducing the inverted intensity by a fixed percentage.

25. A gaming machine comprising:

a gaming controller;

a memory coupled to the master gaming controller;

a button assembly configured to display a function for playing a game executed by the gaming controller, the button assembly being further configured to receive at least a portion of the lens cap, the button housing having a threaded portion configured to prevent a liquid from entering from outside the button assembly to within the button assembly; and a flexible cable configured to accommodate a connector to form an electrical connection with the button assembly.

26. A system comprising:

a main power supply configured to supply main power;

a light emitting element; and a low power detector configured to determine whether the main power is less than a threshold value;

the low power detector configured to generate a low power detect signal upon determining that the main power is less than the threshold value;

wherein the low power detect signal informs the light emitting element that the main power is less than the threshold before power supplied to the light emitting element is removed.

27. A system in accordance with claim 26, further comprising a power storage device configured to supply power to the light emitting element at a time the main power is less than the threshold value and until a time power supplied to the light emitting element is removed.

28. A system in accordance with claim 26, further comprising:

a button assembly including the light emitting element; and a dedicated line configured to communicate the low power detect signal to the button assembly.

29. A system in accordance with claim 26, wherein the power detector is configured to determine whether the main power is greater than the threshold.

30. A method comprising:

determining, by a power detector coupled to a processor, whether a main power is less than a threshold value;

generating, by the power detector, a low power detect signal upon determining that the main power is less than the threshold value; and informing, by the power detector, a light emitting element that the main power is less than the threshold before power supplied to the light emitting element is removed.

31. A method in accordance with claim 30, further comprising supplying power to the light emitting element at a time the main power is less than the threshold value.

32. A gaming machine comprising:

a gaming controller configured to execute a game code;

a memory device coupled to the gaming controller;

a display device configured to display a game upon execution of the game code; and a low power detector coupled to the gaming controller and configured to determine whether a main power is less than a threshold value;

the low power detector configured to generate a low power detect signal upon determining that the main power is less than the threshold value;

wherein the low power detect signal informs a light emitting element that the main power is less than the threshold before power supplied to the light emitting element is removed.

33. A gaming machine in accordance with claim 32, further comprising a power storage device configured to supply power to the light emitting element at a time the main power is less than the threshold value.

* * * * *